US009772596B2

(12) United States Patent
Mitsui et al.

(10) Patent No.: US 9,772,596 B2
(45) Date of Patent: Sep. 26, 2017

(54) IMAGE FORMING APPARATUS AND ELECTROPHOTOGRAPHIC PHOTOSENSITIVE MEMBER

(71) Applicant: CANON KABUSHIKI KAISHA, Tokyo (JP)

(72) Inventors: Takahiro Mitsui, Kawasaki (JP); Tomohisa Itagaki, Abiko (JP); Koji Takahashi, Kashiwa (JP); Hiroki Uematsu, Mishima (JP); Yasuhiro Kawai, Abiko (JP); Tsutomu Nishida, Mishima (JP); Hideki Ogawa, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 239 days.

(21) Appl. No.: 14/716,827

(22) Filed: May 19, 2015

(65) Prior Publication Data

US 2015/0286182 A1 Oct. 8, 2015

Related U.S. Application Data

(63) Continuation of application No. PCT/JP2013/081984, filed on Nov. 21, 2013.

(30) Foreign Application Priority Data

Nov. 21, 2012 (JP) ..... 2012-255277

(51) Int. Cl.
*G03G 15/00* (2006.01)
*G03G 5/04* (2006.01)
*G03G 5/05* (2006.01)

(52) U.S. Cl.
CPC ..... *G03G 15/751* (2013.01); *G03G 5/04* (2013.01); *G03G 5/05* (2013.01); *G03G 5/0525* (2013.01); *G03G 15/75* (2013.01)

(58) Field of Classification Search
CPC combination set(s) only.
See application file for complete search history.

(56) References Cited

U.S. PATENT DOCUMENTS 7,186,489 B2 3/2007 Uematsu et al.
7,226,711 B2 6/2007 Amamiya et al.
(Continued)

FOREIGN PATENT DOCUMENTS

JP 2007-233355 A 9/2007
JP 2007-233359 A 9/2007
(Continued)

*Primary Examiner* — Minh Phan
(74) *Attorney, Agent, or Firm* — Fitzpatrick Cella Harper and Scinto

(57) ABSTRACT

In an image forming apparatus in which an electrostatic image is formed on an electrophotographic photosensitive member using at least a process of a pseudo halftone formed by dots as a method of representing gradation, the electrophotographic photosensitive member is provided on a surface thereof with a plurality of recessed portions of 0.5 μm more and 5 μm or less in depth and 20 μm or more and 80 μm or less in longest diameter of an opening, when a square region of 500 μm×500 μm is arbitrarily extracted on the surface of the electrophotographic photosensitive member, in the square region, a total area of the recessed portions is 10000 $\mu m^2$ or more and 90000 $\mu m^2$ or less and a total area of a flat portion contained in a portion other than the recessed portion is 80000 $\mu m^2$ or more and 240000 $\mu m^2$ or less, and an arrangement (A) of the plurality of recessed portions is such an arrangement that an image quality lowering index (f) calculated by specific processing is 14% or less.

8 Claims, 13 Drawing Sheets

(56) References Cited

U.S. PATENT DOCUMENTS

| | | | |
|---|---|---|---|
| 7,534,534 | B2 | 5/2009 | Nakata et al. |
| 7,551,878 | B2 | 6/2009 | Ogaki et al. |
| 7,718,331 | B2 | 5/2010 | Uematsu et al. |
| 8,846,281 | B2 | 9/2014 | Okuda et al. |
| 2011/0014557 | A1 | 1/2011 | Kim et al. |
| 2014/0093281 | A1 | 4/2014 | Takahashi et al. |

FOREIGN PATENT DOCUMENTS

| | | | |
|---|---|---|---|
| JP | 2009-14979 | A | 1/2009 |
| JP | 2010-8898 | A | 1/2010 |
| JP | 2011-2788 | A | 1/2011 |
| JP | 2011-22578 | A | 2/2011 |
| WO | 2005/093518 | A1 | 10/2005 |

(A)

(B)

(A)

(B)

(a)

| | | |
|---|---|---|
| | NOTING PIXEL | 7/16 |
| 3/16 | 5/16 | 1/16 |

(b)

(a)

(b)

| | | | | | | | | | | | | | | | | | | | |
|---|---|---|---|---|---|---|---|---|---|---|---|---|---|---|---|---|---|---|---|
| 92 | 94 | 95 | 96 | 98 | 99 | 100 | 101 | 103 | 104 | 151 | 152 | 154 | 155 | 156 | 157 | 159 | 160 | 161 | 163 |
| 91 | 54 | 55 | 57 | 58 | 59 | 61 | 62 | 63 | 105 | 150 | 192 | 193 | 194 | 196 | 197 | 198 | 200 | 201 | 164 |
| 90 | 53 | 26 | 27 | 29 | 30 | 31 | 33 | 64 | 106 | 149 | 191 | 222 | 224 | 225 | 226 | 228 | 229 | 202 | 165 |
| 89 | 52 | 25 | 8 | 10 | 11 | 12 | 34 | 65 | 108 | 147 | 189 | 221 | 243 | 244 | 245 | 247 | 230 | 203 | 166 |
| 87 | 50 | 24 | 7 | 1 | 2 | 13 | 35 | 67 | 109 | 146 | 188 | 220 | 242 | 253 | 254 | 248 | 231 | 205 | 168 |
| 86 | 49 | 22 | 6 | 4 | 3 | 15 | 36 | 68 | 110 | 145 | 187 | 219 | 240 | 252 | 251 | 249 | 233 | 206 | 169 |
| 85 | 48 | 21 | 20 | 18 | 17 | 16 | 38 | 69 | 112 | 143 | 186 | 217 | 239 | 238 | 237 | 235 | 234 | 207 | 170 |
| 84 | 47 | 46 | 44 | 43 | 41 | 40 | 39 | 71 | 113 | 142 | 184 | 216 | 215 | 214 | 212 | 211 | 210 | 208 | 171 |
| 82 | 81 | 80 | 78 | 77 | 76 | 75 | 73 | 72 | 114 | 141 | 183 | 182 | 180 | 179 | 178 | 177 | 176 | 174 | 173 |
| 127 | 126 | 124 | 123 | 122 | 120 | 119 | 118 | 117 | 115 | 140 | 138 | 137 | 136 | 135 | 133 | 132 | 131 | 129 | 128 |
| 152 | 153 | 154 | 156 | 157 | 158 | 159 | 161 | 162 | 163 | 93 | 94 | 96 | 97 | 98 | 99 | 101 | 102 | 103 | 105 |
| 150 | 193 | 194 | 195 | 196 | 198 | 199 | 200 | 201 | 164 | 92 | 55 | 56 | 57 | 59 | 60 | 61 | 62 | 64 | 106 |
| 149 | 191 | 223 | 224 | 226 | 227 | 228 | 230 | 203 | 166 | 91 | 54 | 27 | 28 | 29 | 31 | 32 | 33 | 65 | 107 |
| 148 | 190 | 222 | 244 | 245 | 246 | 247 | 231 | 204 | 167 | 89 | 52 | 25 | 9 | 10 | 11 | 13 | 34 | 66 | 108 |
| 147 | 189 | 221 | 242 | 254 | 255 | 249 | 232 | 205 | 168 | 88 | 51 | 24 | 8 | 1 | 3 | 14 | 35 | 68 | 110 |
| 145 | 187 | 219 | 241 | 252 | 251 | 250 | 233 | 207 | 170 | 87 | 50 | 23 | 6 | 5 | 4 | 15 | 37 | 69 | 111 |
| 144 | 186 | 218 | 240 | 238 | 237 | 236 | 235 | 208 | 171 | 85 | 48 | 22 | 20 | 19 | 18 | 17 | 38 | 70 | 112 |
| 143 | 185 | 217 | 215 | 214 | 213 | 212 | 210 | 209 | 172 | 84 | 47 | 46 | 45 | 43 | 42 | 41 | 40 | 71 | 113 |
| 142 | 184 | 182 | 181 | 180 | 179 | 177 | 176 | 175 | 173 | 83 | 82 | 80 | 79 | 78 | 77 | 75 | 74 | 73 | 115 |
| 140 | 139 | 138 | 136 | 135 | 134 | 133 | 131 | 130 | 129 | 128 | 126 | 125 | 124 | 122 | 121 | 120 | 119 | 117 | 116 |

Fig. 16

IMAGE FORMING APPARATUS AND ELECTROPHOTOGRAPHIC PHOTOSENSITIVE MEMBER

This application is a continuation of International Application No. PCT/JP2013/081984, filed Nov. 21, 2013.

TECHNICAL FIELD

The present invention relates to an image forming apparatus and an electrophotographic photosensitive member.

BACKGROUND ART

To a surface of the electrophotographic photosensitive member, an electrical external force and a mechanical external force in charging, cleaning and the like are applied, and therefore the electrophotographic photosensitive member surface is required to have a durability (anti-wearing property) against these external forces.

In order to meet this requirement, such an improving technique that a resin material having a high anti-wearing property has been conventionally used in a surface layer of the electrophotographic photosensitive member.

On the other hand, as a problem generated by enhancing the anti-wearing property of the surface of the electrophotographic photosensitive member, it is possible to cite image deletion (image flow). It would be considered that the image deletion is caused due to deterioration of a material used in the surface layer of the electrophotographic photosensitive member by oxidized gas such as ozone or nitrogen oxide generated by charging of the electrophotographic photosensitive member surface and due to a decrease in resistance of the electrophotographic photosensitive member surface by moisture (water) adsorption. Further, as the anti-wearing property of the electrophotographic photosensitive member surface becomes higher, refreshing (removal of a causative agent (substance) such as a deteriorated material or adsorbed water) on the electrophotographic photosensitive member surface is less liable to be made, and the image deletion is liable to generate.

As a technique for remedying the image deletion, in WO 05/093518 (International Publication No.) publication, a technique for imparting dimple-shaped recessed portions to the electrophotographic photosensitive member surface by dry blasting or wet honing is disclosed. According to WO 05/093518 (International Publication No.) publication, by providing a plurality of the dimple-shaped recessed portions on the surface of the electrophotographic photosensitive member, it is possible to suppress the image deletion from an initial stage to about 5000 sheets.

Further, in Japanese Laid-Open Patent Application (JP-A) Tokkai 2007-233355, a technique for satisfactorily maintaining dot reproducibility from an initial stage to about 5000 sheets even in a high-temperature and high-humidity environment, i.e., for suppressing the image deletion by providing a plurality of recessed portions on the electrophotographic photosensitive member surface at a high area ratio is disclosed.

Further, in JP-A (Tokkai) 2011-22578, a technique in which recessed portions are provided on the electrophotographic photosensitive member surface at a low area ratio is disclosed.

As mentioned above, as the technique for suppressing the image deletion, a technique for providing the plurality of recessed portions on the surface of the electrophotographic photosensitive member has been studied. When the plurality of recessed portions are designed, items such as surface roughness, a size of each of the recessed portions or the number of the recessed portions in a certain area is principally noted.

On the other hand, as a design item of the plurality of recessed portions, there is an item called "arrangement of recessed portions". In the conventional techniques, although a density of the recessed portions is studied, whether how to arrange the respective recessed portions is not noted.

As a technique noting the arrangement of the recessed portions, in JP-A (Tokkai) 2007-233359, a technique for suppressing growth of damage by arranging the recessed portions within 50 μm of the electrophotographic photosensitive member with respect to a rotational direction of the electrophotographic photosensitive member is disclosed.

DISCLOSURE OF THE INVENTION

The present invention has further developed the above-mentioned conventional techniques. That is, an object of the present invention is to provide an image forming apparatus and an electrophotographic photosensitive member which less generate image deletion and which are capable of suppressing an image quality lowering due to recessed portions on a surface of the electrophotographic photosensitive member.

According to the present invention, there is provided an image forming apparatus comprising:

an electrophotographic photosensitive member including at least a supporting member and a photosensitive layer formed on the supporting member; and an image forming portion configured to form an electrostatic latent image on the electrophotographic photosensitive member using at least a process of a pseudo halftone formed by dots as a method of representing gradation, wherein the electrophotographic photosensitive member is provided on a surface thereof with a plurality of recessed portions of 0.5 μm more and 5 μm or less in depth and 20 μm or more and 80 μm or less in longest diameter of an opening, wherein when a square region of 500 μm×500 μm is arbitrarily extracted on the surface of the electrophotographic photosensitive member, in the square region, a total area of the recessed portions is 10000 $\mu m^2$ or more and 90000 $\mu m^2$ or less and a total area of a flat portion contained in a portion other than the recessed portion is 80000 $\mu m^2$ or more and 240000 $\mu m^2$ or less, and wherein an arrangement (A) of the plurality of recessed portions is such an arrangement that an image quality lowering index (f) calculated by the following processing is 14% or less, <Processing>

(1) A portion overlapping with the plurality of recessed portions is deleted from a screen pattern (B) formed by the process of the pseudo halftone formed by the dots is an image (C), (2) Particle analysis of the image (C) is made to calculate an average SM of a dot area and a standard deviation (σ), and (3) The image quality lowering index (f) is obtained by the following formula (1):

$$f=\sigma/SM. \qquad \text{Formula (1):}$$

Further, according to the present invention, there is provided an image forming apparatus comprising:

an electrophotographic photosensitive member including at least a supporting member and a photosensitive layer formed on the supporting member;

an image forming portion configured to form an electrostatic latent image on the electrophotographic photosensitive member using at least a process of a pseudo halftone formed by dots as a method of representing gradation; and a blade configured to clean the electrophotographic photosensitive member in contact with the electrophotographic photosensitive member, wherein the electrophotographic photosensitive member is provided at least in a contact region with the blade on a surface thereof with a plurality of recessed portions of 0.5 μm more and 5 μm or less in depth and 20 μm or more and 80 μm or less in longest diameter of an opening, wherein when a square region of 500 μm×500 μm is arbitrarily extracted in the contact region, in the square region, a total area of the recessed portions is 10000 $\mu m^2$ or more and 90000 $\mu m^2$ or less and a total area of a flat portion contained in a portion other than the recessed portion is 80000 $\mu m^2$ or more and 240000 $\mu m^2$ or less, and wherein an arrangement (A) of the plurality of recessed portions is such an arrangement that an image quality lowering index (f) calculated by the following processing is 14% or less, <Processing>

(1) A portion overlapping with the plurality of recessed portions is deleted from a screen pattern (B) formed by the process of the pseudo halftone formed by the dots is an image (C), (2) Particle analysis of the image (C) is made to calculate an average SM of a dot area and a standard deviation (σ), and (3) The image quality lowering index (f) is obtained by the following formula (1):

$$f=\sigma/SM. \quad \text{Formula (1):}$$

Further, according to the present invention, there is provided an electrophotographic photosensitive member on which an electrostatic latent image is formed using at least a process of a pseudo halftone formed by dots as a method of representing gradation, the electrophotographic photosensitive member comprising:

a supporting member; and a photosensitive layer formed on the supporting member, wherein the electrophotographic photosensitive member is provided on a surface thereof with a plurality of recessed portions of 0.5 μm more and 5 μm or less in depth and 20 μm or more and 80 μm or less in longest diameter of an opening, wherein when a square region of 500 μm×500 μm is arbitrarily extracted on the surface of the electrophotographic photosensitive member, in the square region, a total area of the recessed portions is 10000 $\mu m^2$ or more and 90000 $\mu m^2$ or less and a total area of a flat portion contained in a portion other than the recessed portion is 80000 $\mu m^2$ or more and 240000 $\mu m^2$ or less, and wherein an arrangement (A) of the plurality of recessed portions is such an arrangement that an image quality lowering index (f) calculated by the following processing is 14% or less, <Processing>

(1) A portion overlapping with the plurality of recessed portions is deleted from a screen pattern (B) formed by the process of the pseudo halftone formed by the dots is an image (C), (2) Particle analysis of the image (C) is made to calculate an average SM of a dot area and a standard deviation (σ), and (3) The image quality lowering index (f) is obtained by the following formula (1):

$$f=\sigma/SM. \quad \text{Formula (1):}$$

Further, according to the present invention, there is provided an electrophotographic photosensitive member on which an electrostatic latent image is formed using at least a process of a pseudo halftone formed by dots as a method of representing gradation, on which a surface thereof is cleaned by a blade, the electrophotographic photosensitive member comprising:

a supporting member; and a photosensitive layer formed on the supporting member, wherein the electrophotographic photosensitive member is provided in a contact region with the blade on the surface thereof with a plurality of recessed portions of 0.5 μm more and 5 μm or less in depth and 20 μm or more and 80 μm or less in longest diameter of an opening, wherein when a square region of 500 μm×500 μm is arbitrarily extracted in the contact region, in the square region, a total area of the recessed portions is 10000 $\mu m^2$ or more and 90000 $\mu m^2$ or less and a total area of a flat portion contained in a portion other than the recessed portion is 80000 $\mu m^2$ or more and 240000 $\mu m^2$ or less, and wherein an arrangement (A) of the plurality of recessed portions is such an arrangement that an image quality lowering index (f) calculated by the following processing is 14% or less, <Processing>

(1) A portion overlapping with the plurality of recessed portions is deleted from a screen pattern (B) formed by the process of the pseudo halftone formed by the dots is an image (C), (2) Particle analysis of the image (C) is made to calculate an average SM of a dot area and a standard deviation (σ), and (3) The image quality lowering index (f) is obtained by the following formula (1):

$$f=\sigma/SM. \quad \text{Formula (1):}$$

BRIEF DESCRIPTION OF THE DRAWINGS

In FIG. 1, (A) and (B) are illustrations schematically showing a relationship among reference surfaces, a flat portion, recessed portions and the like.

FIG. 16 is an illustration showing a dot-concentration dither matrix with 1200 dpi, 106 lpi and 45 degrees.

EMBODIMENTS FOR CARRYING OUT THE INVENTION

Figure 1:
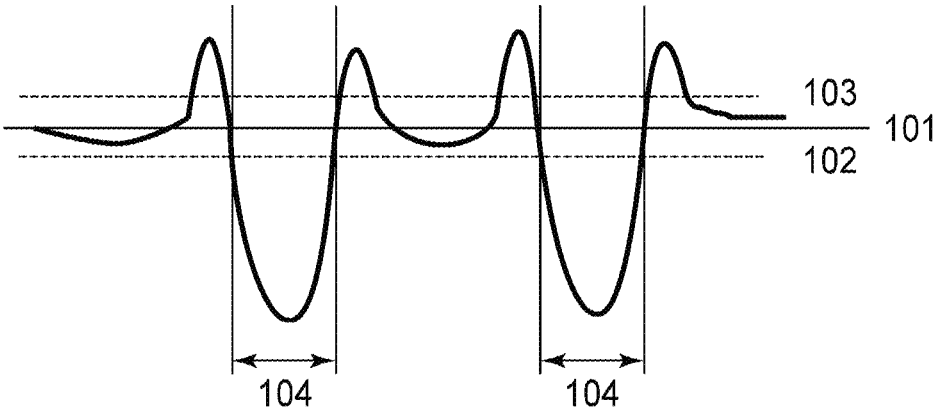
Figure 1:
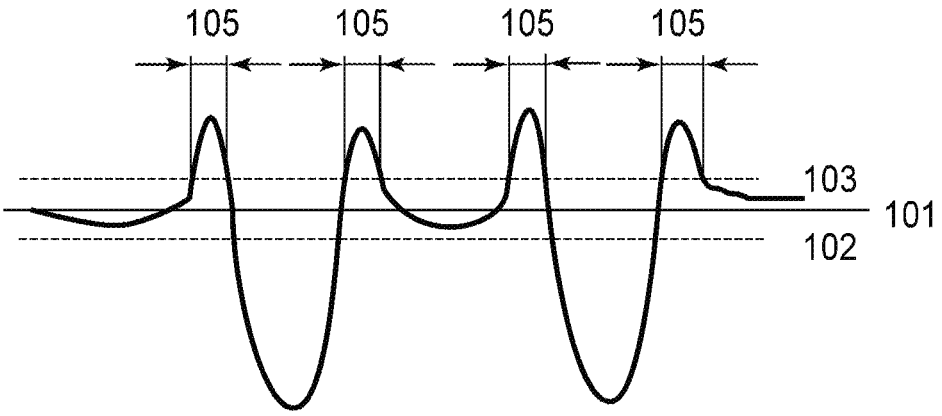

This embodiment is characterized in that the following four items are included in combination.

Feature 1: A longest diameter (long-axis diameter) of an opening of each of recessed portions is large.

Feature 2: A proportion of an area of the recessed portions is small.

Feature 3: A proportion of an area of a flat portion is large.

Feature 4: The recessed portions are arranged so as to satisfy a specific criterion.

The features 1-3 are items for suppressing an image deletion, and the feature 4 is an item for suppressing an image quality lowering. In the following, specific description will be made.

<Suppression of Image Deletion>

First, the features 1-3 which are the items for suppressing the image deletion (image flow) will be described. A feature against the above-described technique of WO05/093518 (International Publication No.) publication in the features 1-3 of this embodiment is that the proportion of the area of the flat portion on the surface of the electrophotographic photosensitive member is large. In the case where dimple-shaped recessed portions are provided on the surface of the electrophotographic photosensitive member by using dry blasting or wet honing, particles are randomly collided with the surface of the electrophotographic photosensitive member, and therefore of a portion other than the recessed portions, the proportion of the area of the flat portion is very small.

Further, with respect to the features 1-3 of this embodiment, also a feature against the technique of JP-A (Tokkai) 2011-22578 is, similarly as in the feature against WO05/093518 (International Publication No.) publication, that the proportion of the area of the flat portion on the surface of the electrophotographic photosensitive member is large.

Further, with respect to the features 1-3 of this embodiment, features against JP-A (Tokkai) 2007-233355 and JP-A (Tokkai) 2007-233359 are that the recessed portions each having the large longest diameter (long-axis diameter) are provided on the surface of the electrophotographic photosensitive member and that the area proportion of the recessed portions is small.

In this embodiment, the area of the recessed portions is an area of the recessed portions when the surface of the electrophotographic photosensitive member is seen from above substantially in parallel to a normal direction (radial direction in the case of a cylindrical photosensitive member) perpendicular to the surface of the photosensitive member, and means an area of openings of the recessed portions. This is similar to those with respect to the flat portion and recessed portions.

A result of study by the present inventors was as follows. The recessed portions each having the large longest diameter of the opening (preferably, the recessed portions each also having a large smallest diameter of the opening) are sparsely disposed on the surface of the electrophotographic photosensitive member and of a portion other than the recessed portions, particularly an area of the flat portion is made large. By this, it was found that an image deletion suppressing effect is drastically improved. That is, it was found that a sufficient effect on the image deletion noticeably generating in the neighborhood of a charging device and on the image deletion, immediately after actuation, liable to generate in the case where an electrophotographic apparatus is left standing for several days in a high-temperature and high-humidity environment can be obtained.

By sparsely disposing the recessed portions large in longest diameter of the opening, shuddering of a cleaning blade is properly suppressed, so that a stable rubbing (sliding) state between the electrophotographic photosensitive member surface and the cleaning blade is created. Together therewith, a pressure of the cleaning blade against the recessed portions becomes low relative to the recessed portions, and therefore a pressure of the cleaning blade against the portion other than the recessed portions becomes high relative to the portion other than the recessed portions. Further, of the portion, other than the recessed portions, where the pressure becomes high, the flat portion where efficient refreshing of the electrophotographic photosensitive member surface is readily performed is made large in area, whereby removal of an image deletion causative agent deposited on the electrophotographic photosensitive member surface becomes easy to be made.

The present inventors consider that the image deletion suppressing effect is drastically improved by such a mechanism.

Specifically, on the surface of the electrophotographic photosensitive member, a plurality of recessed portions of 0.5 μm or more and 5 μm or less in depth and 20 μm or more and 80 μm or less in longest diameter of the opening are provided. The plurality of recessed portions of 0.5 μm or more and 5 μm or less in depth and 20 μm or more and 80 μm or less in longest diameter of the opening is hereinafter also referred to as "specific recessed portions".

The specific recessed portions are provided on the electrophotographic photosensitive member surface in the following manner when a square region (250000 $\mu m^2$ in area) of 500 μm×500 μm is disposed (extracted) at an arbitrary position on the electrophotographic photosensitive member surface. That is, the specific recessed portions are provided so that the area of the specific recessed portions in the square region of 500 μm×500 μm is 1000 $\mu m^2$ or more and 90000 $\mu m^2$ or less.

Incidentally, in the case where the electrophotographic photosensitive member surface in a curved surface, the arrangement is as follows. For example, in the case where the electrophotographic photosensitive member has a cylindrical shape, the surface (peripheral surface) of the electrophotographic photosensitive member is such a curved surface that the surface is curved with respect to a circumferential direction. In this case, "a square region of 500 μm×500 μm is disposed at an arbitrary position on the electrophotographic photosensitive member surface" means that in the case where the curved surface is corrected to a flat surface, such a region that has a square shape on the flat surface is disposed at the arbitrary position on the electrophotographic photosensitive member surface.

Further, on the electrophotographic photosensitive member surface, the flat portion is provided in addition to the specific recessed portions. Further, the flat portion is provided on the electrophotographic photosensitive member surface in the following manner. That is, when the square region of 500 μm×500 μm is disposed at the arbitrary position on the electrophotographic photosensitive member surface, the area of the flat portion in the square region of 500 μm×500 μm is 80000 $\mu m^2$ or more and 240000 $\mu m^2$ or less.

The specific recessed portions, the flat portion and the like on the electrophotographic photosensitive member surface can be observed using a microscope such as a laser microscope, an optical microscope, an electron microscope or an atomic force microscope.

As the laser microscope, e.g., the following devices are available: an ultra-deep shape measurement microscope "UK-8550", an ultra-deep shape measurement microscope "UK-9000", and ultra-deep shape measurement microscope "UK-9500" and UK-X200" manufactured by Keyence Corp.; a surface shape measurement system "Surface Explorer SX-520DR" manufactured by Ryoka Systems Inc.; a confocal laser scanning microscope "OLS3000" manufactured by Olympus Corp.; and a real color confocal microscope "Optelics C130" manufactured by Lasertec Corp.

As the optical microscope, e.g., the following devices are available: a digital microscope "UHX-500" and a digital microscope "UHX-200" manufactured by Keyence Corp.; and a 3D digital microscope "VC-7700" manufactured by Omron Corp.

As the electron microscope, e.g., the following devices are available: a 3D real surface view microscope "VE-9800" and a 3D real surface view microscope "VE-8800" manufactured by Keyence Corp.; a scanning electron microscope "Conventional/Variable Pressure SEM" manufactured by SII Nano Technology Inc.; and a scanning electron microscope "SUPERSCAN SS-550" manufactured by Shimadzu Corp.

As the atomic force microscope, e.g., the following devices are available: a nano-scale hybrid microscope "UN-8000" manufactured by Keyence Corp.; a scanning probe microscope "Nano Navi Station" manufactured by SII Nano Technology Inc.; and a scanning probe microscope "SPM-9600" manufactured by Shimadzu Corp.

Observation of the square region of 500 μm×500 μm described above and observation for obtaining the image (C) described later may be performed at a low magnification so long as the specific recessed portions are discriminable or may also be performed in such a manner that partial observation is made at a high magnification and thereafter a plurality of partial images are connected using a software or the like.

Discrimination (definition) of the specific recessed portions and the flat portion in the square region of 500 μm×500 μm and the like will be described.

First, the surface of the electrophotographic photosensitive member is observed through the microscope. For example, in the case where the surface (peripheral surface) of the electrophotographic photosensitive member is the curved surface which is curved with respect to the circumferential direction, such as in the case where the electrophotographic photosensitive member has the cylindrical shape, a cross-sectional profile of the curved surface is extracted, and a curved line (an arc if the electrophotographic photosensitive member has the cylindrical shape) is subjected to fitting.

Figure 7:
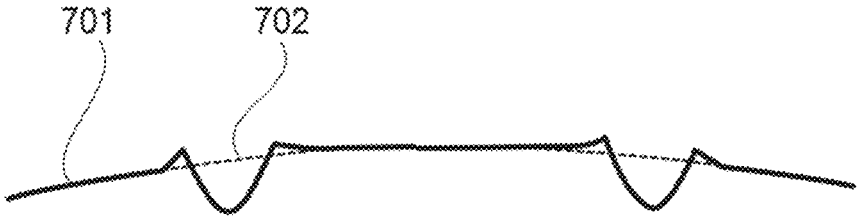
FIG. 7 is an illustration showing an example of fitting.

FIG. 7 shows an example of the fitting. The example shown in FIG. 7 is an example in the case where the electrophotographic photosensitive member has the cylindrical shape. In FIG. 7, a solid line 701 is the cross-sectional profile of the surface (peripheral surface) of the electrophotographic photosensitive member, and a broken line 702 is the curved line fitted with the cross-sectional profile 701. A surface obtained by correcting the cross-sectional profile 701 so that the curved line 702 becomes a rectilinear line and by extending the obtained rectilinear line in a longitudinal direction (direction perpendicular to the circumferential direction) of the electrophotographic photosensitive member is a reference surface. Also in the case where the electrophotographic photosensitive member does not have the cylindrical shape, the reference surface is obtained similarly as in the case of the cylindrical shape.

A surface which is positioned 0.2 μm below the obtained reference surface and which is parallel to the reference surface is a second reference surface, and a surface which is positioned 0.2 μm above the reference surface and which is parallel to the reference surface is a third reference surface. Of the square region of 500 μm×500 μm, a portion sandwiched between the second reference surface and the third reference surface is the flat portion in the square region. A portion positioned above the third reference surface is a projected portion in the square region. A portion positioned below the second reference surface is the recessed portion.

A distance from the second reference surface to a lowest point of the recessed portion is a depth of the recessed portion. A cross-section of the recessed portion by the second reference surface is an opening, and of line segments crossing with the opening, a length of a longest line segment is a longest diameter of the opening of the recessed portion.

The thus-obtained portion where the depth is in a range of 0.5 μm or more and 5 μm or less and the longest diameter is in a range of 20 μm or more and 80 μm or less corresponds to the specific recessed portion of the recessed portions. The depth of the specific recessed portion in this embodiment may preferably be in a range of 1 μm or more and 5 μm or less. Further, a distance when a distance between two parallel lines sandwiching the opening of the recessed portion is shortest is a shortest diameter of the opening of the recessed portion. The shortest diameter of the opening of the specific recessed portion in this embodiment may preferably be in the range of 20 μm or more and 80 μm or less.

A relationship among a reference surface 101, the flat portion (portion sandwiched between a second reference surface 102 and a third reference surface 103), a recessed portion 104 (specific recessed portion), a projected portion 105 and the like is schematically shown in (A) and (B) of FIG. 1. In FIG. 1, (A) and (B) are cross-sectional profiles after the above-described correction.

Figure 2:
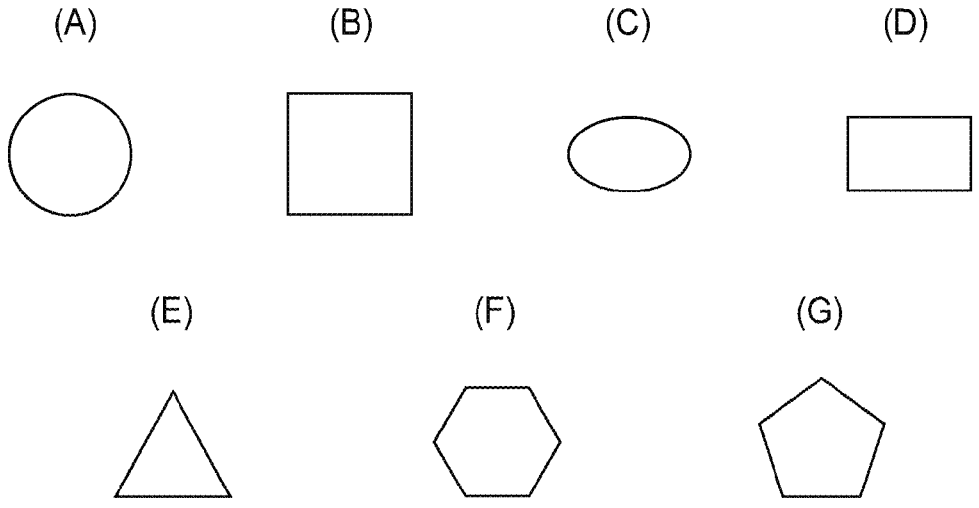
In FIG. 2, (A)-(G) are illustrations each showing an example of a shape of an opening of a recessed portion on a surface of an electrophotographic photosensitive member.
Figure 3:
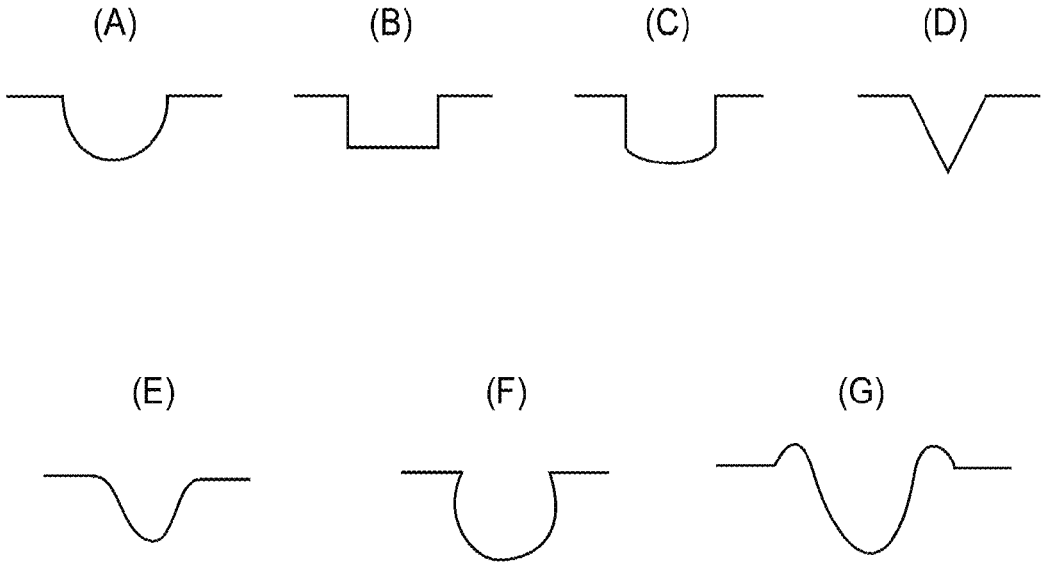
In FIG. 3, (A)-(G) are illustrations each showing an example of a cross-sectional shape of the opening of the recessed portion on the surface of the electrophotographic photosensitive member.

Examples of the shape (shape when the specific recessed portion is seen from above) of the opening of the specific recessed portion are shown in (A)-(G) of FIG. 2. Examples of the cross-sectional shape of the specific recessed portion are shown in (A)-(G) of FIG. 3.

As the shape of the opening of the specific recessed portion, it is possible to cite a circle, an ellipse, a square, a rectangle, a triangle, a quadrangle, a hexagon, and the like, e.g., as shown in (A)-(G) of FIG. 2. Further, as the cross-sectional shape of the opening of the specific recessed portion, it is possible to cite those having edges such as the triangle, the quadrangle, a polygon and the like, a wavy shape consisting of a continuous curved line, and those in which a part or all of the edges such as the triangle, the quadrangle, the polygon and the like are deformed, e.g., as shown in (A)-(G) of FIG. 3.

All the plurality of specific recessed portions provided on the electrophotographic photosensitive member surface may have the same shape, the same longest diameter of the opening and the same depth, but the specific recessed portions having different shapes, different longest diameters of the openings and different depths exist in a mixed manner.

The above-described specific recessed portions may be formed in a whole region of the electrophotographic photosensitive member surface but may also be formed at a part of the electrophotographic photosensitive member surface. In the case where the specific recessed portions are formed at a part of the electrophotographic photosensitive member surface, it is preferable that the specific recessed portions are formed in a whole region of at least a contact region with a cleaning member.

Further, the flat portion provided on the electrophotographic photosensitive member surface may preferably have a size to some extent and may preferably include a narrow flat portion (narrow portion) in a small amount from a viewpoint that a removing property of the image deletion causative agent is enhanced. Specifically, of the flat portion in the square region of 500 μm×500 μm disposed at the arbitrary position on the electrophotographic photosensitive member surface, a proportion of an area of the narrow portion where a square region with a side of 10 μm cannot be disposed may preferably be as follows. That is, the proportion may preferably be 30% or less per a total area of the flat portion in the square region of 500 μm×500 μm is 30% or less. However, even when the area of the narrow portion is 30% or more, an effect in this embodiment is obtained.

Figure 10:
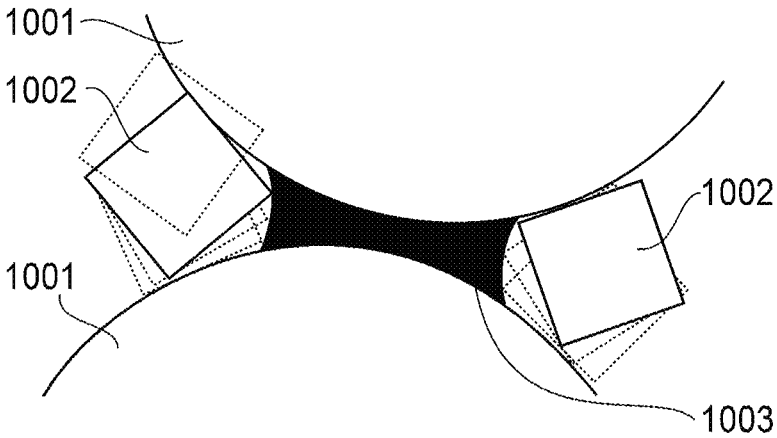
FIG. 10 is an illustration for explaining a narrow portion.

FIG. 10 is an illustration for explaining the narrow portion. FIG. 10 shows an example of a shape when a part of the surface of the electrophotographic photosensitive member is viewed from above. In FIG. 10, for ease of explanation, the case where all the portions which are not the specific recessed portions are the flat portion is cited as the example.

In FIG. 10, 1001 is the specific recessed portion on the electrophotographic photosensitive member surface, 1002 is the square region with the side of 10 μm, and 1003 is the narrow portion (portion of a solid fill of black in the figure). The square region 1002 may be disposed with respect to any direction at the flat portion as shown by squares indicated by broken lines in the figure. In the flat portion, a portion where the square region 1002 cannot be obtained even when the square region 1002 is positioned with respect to any direction is the narrow portion 1003 at the flat portion.

<Suppression of Image Quality Lowering>

Next, the feature 4 which is the item for suppressing the image quality lowering will be described. As a result of study by the present inventors. The reason for this is that the recessed portion tends to deteriorate in electrophotographic characteristic compared with a portion which is not the recessed portion. The electrophotographic characteristic is charging power, latent image reproducibility, developing efficiency or transfer efficiency. When the electrophotographic characteristic of the recessed portion deteriorates, of image data, a portion where the image is formed on the recessed portion of the electrophotographic photosensitive member cannot be faithfully reproduced. As a result thereof, light and shade generate on an output image depending on arrangement of the recessed portions, so that graininess (roughness) of the image lowers.

Further, as a method of representing gradation (level), in the case where a process of pseudo halftone formed by dots is used, in addition to the lowering in graininess (roughness), also moire generates. The lowering in graininess and the moire are generated by the following mechanism.

First, the halftone is converted by the pseudo halftone process (pseudo halftoning) into image data constituted by a group of small dots called a screen. When the screen is formed, portions overlapping with the recessed portions are not faithfully reproduced, and therefore dropped dots occur. A degree of the dropped dots depend on a degree of overlapping of the recessed portions with the dots, and therefore the dropped dots are not uniform but vary. At this time, when a variation in dropped dots is large, the graininess lowers. Further, depending on a relationship between a screen pattern and the recessed portion arrangement, the variation in dropped dots periodically appears. As a result, a periodical change in light and shade, i.e., the moire generates on the output image.

As a result of study by the present inventors, in the case where the process of the pseudo halftone formed by dots was used as the method of representing the gradation, it turned out that the image quality lowering was able to be suppressed by disposing the recessed portions so as to satisfy a specific criterion. The image quality lowering is the graininess (roughness) and the moire. An outline of these will be described.

First, the lowering in graininess (roughness) will be described. In the electrophotographic apparatus, in general, the pseudo halftone process is used as the method of representing the gradation. The pseudo halftone process is a method in which the number of pixels and a degree of gathering of the pixels for a gray scale are controlled using only two colors of white and black. It is naturally possible to use the pseudo halftone process also for (other) colors.

A pattern (screen) of the pseudo halftone process exists in various forms such as parallel lines, a wavy line, grain and the like, but among others, a method of representing the pattern by a group (gathering) of small dots goes mainstream. In the process of the pseudo halftone formed by the dots, AM screening in which light and shade are represented by changing a size and a density of the dots in a regular dot arrangement and FM screening in which irregular dot arrangement is made with a fixed dot diameter and light and shade are represented by changing the dot density exits. In the following, description will be made with respect to the AM screening, but the pseudo halftone process in this embodiment may be either of the AM screening and the FM screening.

Figure 11:
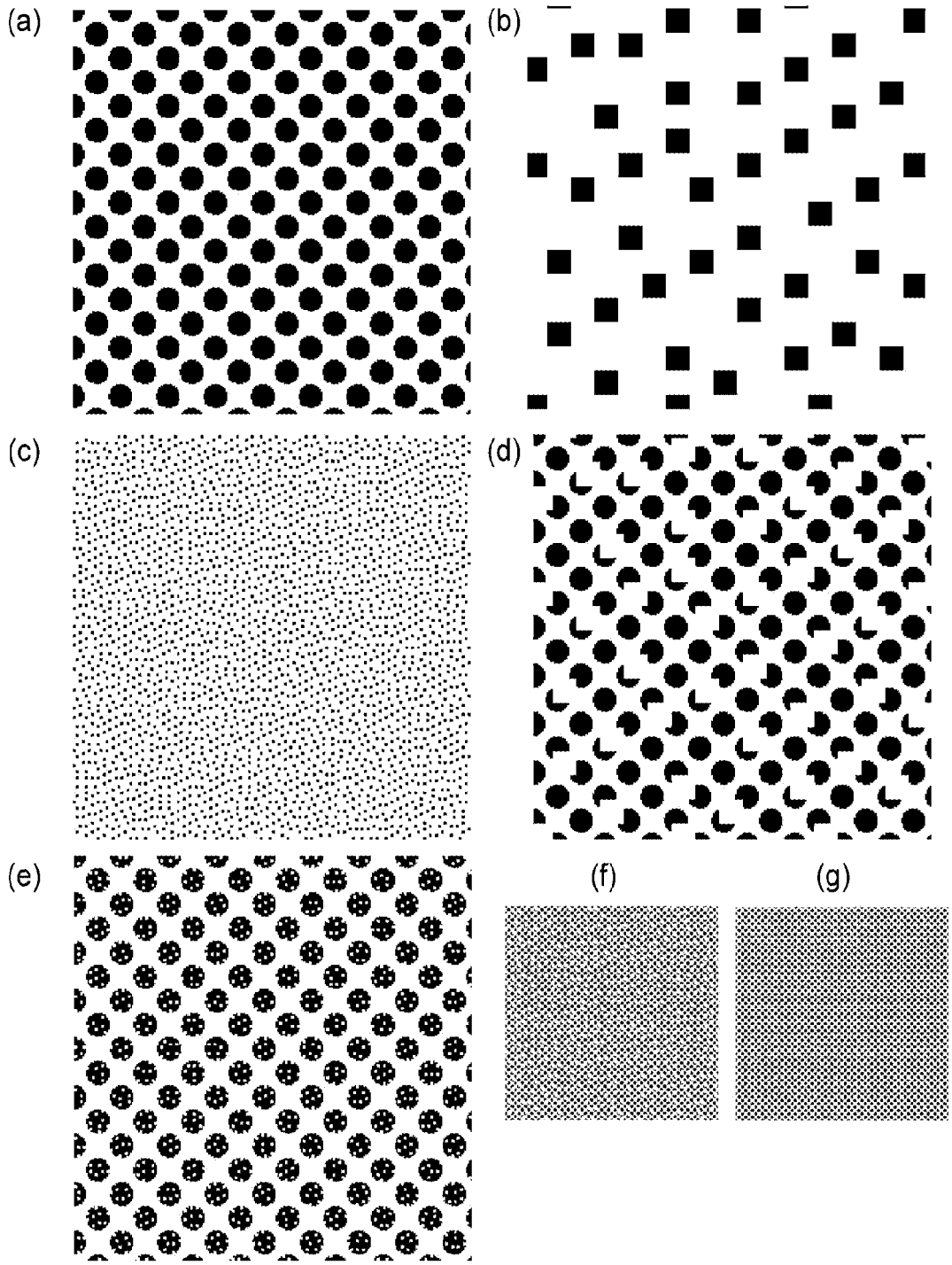
In FIG. 11, (a) is an enlarged illustration of an example of a screen used in pseudo halftone processing, (b) is an illustration showing an example of recessed portion arrangement in which recessed portions each having an opening diameter close to a dot size of a screen pattern are irregularly arranged, (c) is an illustration showing an example of recessed portion arrangement in which recessed portions each having an opening diameter extremely smaller than the dot size of the screen pattern are irregularly arranged, (d) is an assumed illustration of an output image in the case where the screen image of (a) is outputted using the electrophotographic photosensitive member on which the recessed portion arrangement of (b) is made, (e) is an assumed illustration of an output image in the case where the screen image of (a) is outputted using the electrophotographic photosensitive member on which the recessed portion arrangement of (c) is made, (f) is an illustration of (d) displayed in a reduction manner, and (g) is an illustration of (e) displayed in a reduction manner.

In FIG. 11, (a) is an illustration of an enlarged screen obtained by the AM screening. On the other hand, the surface of the electrophotographic photosensitive member can be variously designed with respect to the size and arrangement of the recessed portions. An example of a figure in which the openings of the recessed portions are represented by black and a portion other than the recessed portions is represented by white is shown in (b) and (c) of FIG. 11. (b) is an illustration of irregular arrangement of recessed portions where the openings are squares and a recessed portion opening size is close to a dot size. (c) is an illustration of irregular arrangement of recessed portions where the openings are squares and a recessed portion opening size is smaller than the dot size. (b) and (c) are examples for explanation, and the recessed portion arrangement is not limited thereto.

The recessed portions have a tendency that the electrophotographic characteristic lowers, and depending on the case, the image is not formed on the recessed portions. That is, in the case where the dots of the above-described screen are formed on the recessed portions, the dots are dropped. In the case where the screen image of (a) is outputted using the electrophotographic photosensitive member in which the recessed portion arrangements of (b) and (c) are made, it is assumed that the output images are as shown in (d) and (e). Each of the dots depending on a degree of overlapping thereof with the recessed portion, so that it is understood that a variation in dropped dot is larger in (d) than in (e).

In this case, the screen is shown in an enlarged state, but in actuality, the pseudo halftone process uses an optical illusion, and the screen is used with a dot size which cannot be recognized by human eyes. In (f) and (g), images obtained by reducing (d) and (e) to some extent are shown. It is found that in (f) in which the variation in dropped dot is large, a variation in light and shade is large and the graininess (roughness) lowers.

Next, the moire will be described. In the above-described example in which the graininess (roughness) lowers, the graininess (roughness) lowers by a combination of the regular screen and the irregular recessed portion arrangement. On the other hand, in the case of a combination of the regular screen and a regular recessed portion arrangement, an interference occurs between patterns, and the variation (light and shade) in dropped dot periodically appears, and therefore a so-called moire (interference fringe) generates.

As an example of the regular screen, a screen in a square arrangement with an angle of 45° when a main scan direction of exposure light (a horizontal direction in this figure) is 0°. As an example of the regular recessed portion arrangement, (b) and (c) in which the opening shape is a circle and the arrangement is the square arrangement are shown. In (b), an angle of the square arrangement is 41.2°, and is 26.6° in (c). In the case where the screen image of (a) is outputted using the electrophotographic photosensitive members in which the recessed portion arrangements of (b) and (c) are made, output images are as shown in (d) and (e). When these images are microscopically observed, interference occurs in both of (d) and (e), so that the variation in dropped dot periodically appears.

However, when (d) and (e) are macroscopically observed, in (d), periodical light and shade are conspicuous. This is because, as a period of light and shade is longer, visual resolving power is higher. On the other hand, when the period of light and shade becomes very short as in (e), the periodical light and shade are not visually recognized as the moire by the human eyes.

Further, the interference has a characteristic that the period is long, i.e., the wave number is low when the recessed portion arrangement is close to the line number and the amount of the screen. In the recessed portion arrangements of (b) and (c), the angle of 41.2° in (b) is closer to the screen angle of 45° in (a) than the angle of 26.6° in (c) is.

As a result, the period of interference in (d) is longer than that in (e), i.e., the low wave number is obtained in (d), and therefore the periodically light and shade are liable to be recognized. Therefore, an image quality problem is low-wave number moire.

As described above, in a technique in which the plurality of recessed portions are provided on the surface of the electrophotographic photosensitive member, there are problems of a lowering in image quality, i.e., a lowering in graininess and the moire.

<Image Quality Lowering Index>

Arithmetic processing (1)-(3) which is a calculating method of an image quality lowering index (f) will be specifically described.

(1) A portion overlapping with the plurality of recessed portions is deleted from a screen pattern (B) generated by the process of pseudo halftone formed by dots to obtain an image (C).

Figure 12:
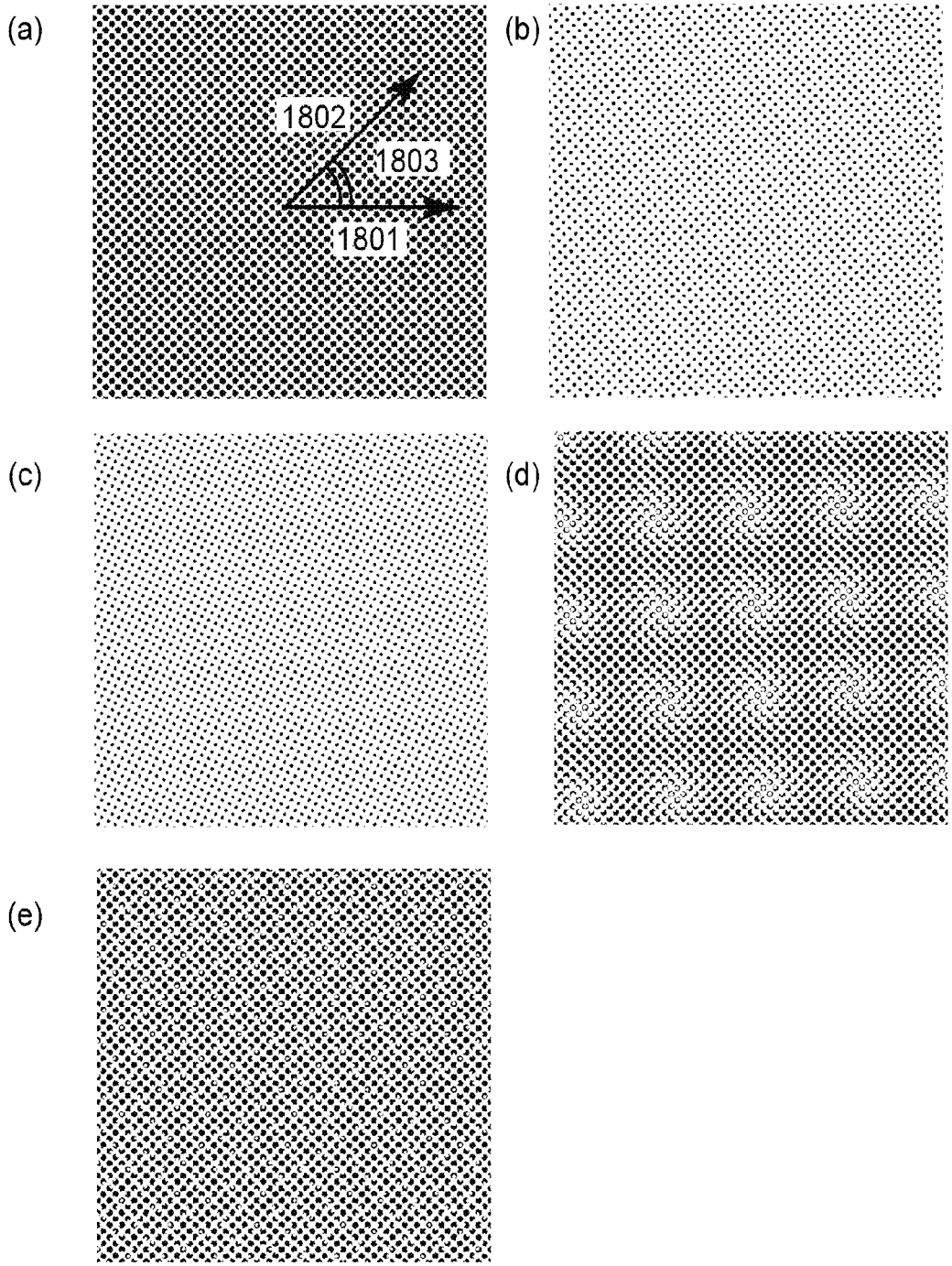
In FIG. 12, (a) is an enlarged illustration of a screen in a square arrangement with an angle of 45° when a main scan direction of exposure light is 0°, (b) is an illustration showing an example of a recessed portion arrangement which is a square arrangement with an angle of 41.2° when the main scan direction of the exposure light is 0°, (c) is an illustration showing an example of a recessed portion arrangement which is a square arrangement with an angle of 26.6° when the main scan direction of the exposure light is 0°, (d) is an assumed illustration of an output image in the case where the screen image of (a) is outputted using the electrophotographic photosensitive member on which the recessed portion arrangement of (b) is made, and (e) is an assumed illustration of an output image in the case where the screen image of (a) is outputted using the electrophotographic photosensitive member on which the recessed portion arrangement of (c) is made.

This process is such a process that an assumed output image is prepared in a pseudo manner by image processing. The screen pattern (B) generated by the process of pseudo halftone formed by the dots is, e.g., (a) of FIG. 11 and (a) of FIG. 12. The image (C) obtained by deleting the portion overlapping with the plurality of recessed portions from the screen is, e.g., (d) and (e) of FIG. 11 and (d) and (e) of FIG. 12.

As described above, the recessed portion tends to deteriorate in electrophotographic characteristic compared with a non-recessed portion, so that the image drops. The electrophotographic characteristic is charging power, latent image reproducibility, developing efficiency or transfer efficiency. At the recessed portion, compared with the non-recessed portion, a film thickness of a photosensitive layer is thin and an electrostatic capacity is larger or contact with a charging member becomes insufficient, and therefore the charging power lowers in some cases. Further, at the recessed portion, compared with the non-recessed portion, the film thickness of the photosensitive layer is thin and sensitivity lowers or exposure light is refracted by the recessed portion shape, so that the latent image reproducibility lowers in some cases.

Further, at the recessed portion, contact with a transfer member or the toner carried on a develop member becomes in sufficient, and therefore the transfer efficiency and the developing efficiency lower in some cases. The electrophotographic characteristic at the recessed portion depends on the photosensitive layer, the size of the recessed portion, the toner, an electrophotographic process or an ambient environment, and therefore is not necessary lowered.

However, an object in this embodiment is to provide an electrophotographic apparatus in which an image quality lowering by the recessed portions is suppressed even under any condition, and therefore in calculation of the image quality lowering index (f), of image data, a portion where the image is formed at the recessed portions is treated as a portion where the image is not printed.

The screen pattern (B) is, when a grayscale is outputted by the electrophotographic apparatus, formed by a pseudo halftone process algorithm set in the electrophotographic apparatus. Therefore, the screen pattern (B) can be obtained from a density of the grayscale and the pseudo halftone process algorithm. Alternatively, the density, a resolution (resolving power), a dot shape and a line number are set using "Photoshop" (registered trademark) of Adobe Systems Inc., so that the screen pattern (B) can be obtained.

Incidentally, when the apparatus is the electrophotographic apparatus using a multi-value pseudo halftone process using PWM (pulse width modulation) or the like, the screen pattern (B) can be obtained by performing conversion to binary with a threshold of a half value (50%) of multi-value information.

Further, the screen pattern (B) can also be obtained by observing the toner image formed on the photosensitive member. Specifically, image output is made using a photosensitive member including no recessed shape on a surface thereof, and a power source for the electrophotographic apparatus is turned off during the output, so that the electrophotographic apparatus is stopped in a state in which the toner image exists on the photosensitive member. By this, the toner image from image quality lowering can be obtained on the photosensitive member. This toner image on the photosensitive member is observed through the above-described microscope such as the laser microscope or the optical microscope, so that a microphotograph of the screen pattern (B) can be obtained.

Subsequently, the obtained microphotograph is subjected to image processing, so that binarized image data is generated. As a method of generating the binarized image data, any method may be used. For example, the binarized image data can be obtained by subjecting the obtained microphotograph to the following binarization.

Correction of a curvature component in the case where the photosensitive member is the cylindrical member (similar to the above-described fitting in FIG. 7)

Removal of a noise component with a medium filter while leaving an edge

Binarization with a 50%-threshold of a difference between minimum brightness (toner image) and maximum brightness (photosensitive member)

Removal of a minute area portion (removed of fine particles such as a minute toner)

Fill (filling) of a portion surrounded by the toner image

Such an arithmetic processing for the image processing can be performed using a particle analysis software ("GRADING ANALYSIS") manufactured by Keyence Corp., or the like.

Also a plurality of recessed portion arrangements (A) on the photosensitive member can be obtained by the observation through the above-described microscope such as the laser microscope, the optical microscope, the electron microscope or the atomic force microscope and by the binarization. The binarization can be performed by a method similar to that for the image processing used for the screen pattern (B). However, the specific recessed portion is the portion not higher than the second reference surface, and therefore there is a need to reflect an opening shape of the specific recessed portion determined by a microscope capable of obtaining stereoinformation (three-dimensional information). Alternatively, by using an analysis software attached to the microscope capable of obtaining the stereoinformation, the obtained microphotographic can also be directly binarized at portions above and below the second reference surface.

Further, in the case where the method of forming the recessed portions on the surface of the photosensitive member is a method of causing a mold including recessed portions described later to press-contact the surface of the electrophotographic photosensitive member, the recessed portions can be formed so that an outer peripheral shape of the projected portions of the mold and an opening shape of the recessed portions are the same shape. For that reason, the recessed portion arrangement may also be provided by observation of the mold or electronic data when the mold is designed.

Further, also in the case where the method of forming the recessed portions is laser light irradiation described later, the recessed portions can be formed so that the recessed portion opening shape is the same shape as an opening shape of a mask. For that reason, the recessed portion arrangement may also be provided by observation of a laser mask or electronic data when the mask is designed.

The shape of the image (C), i.e., an obtained shape of the plurality of the recessed portion arrangements (A) and the screen pattern (B) on the photosensitive member may preferably be such a shape that contribution to all directions is equal to the possible extent, and may preferably be a square or a circle in order to accurately evaluate the moire generating with respect to a specific direction.

Figure 13:
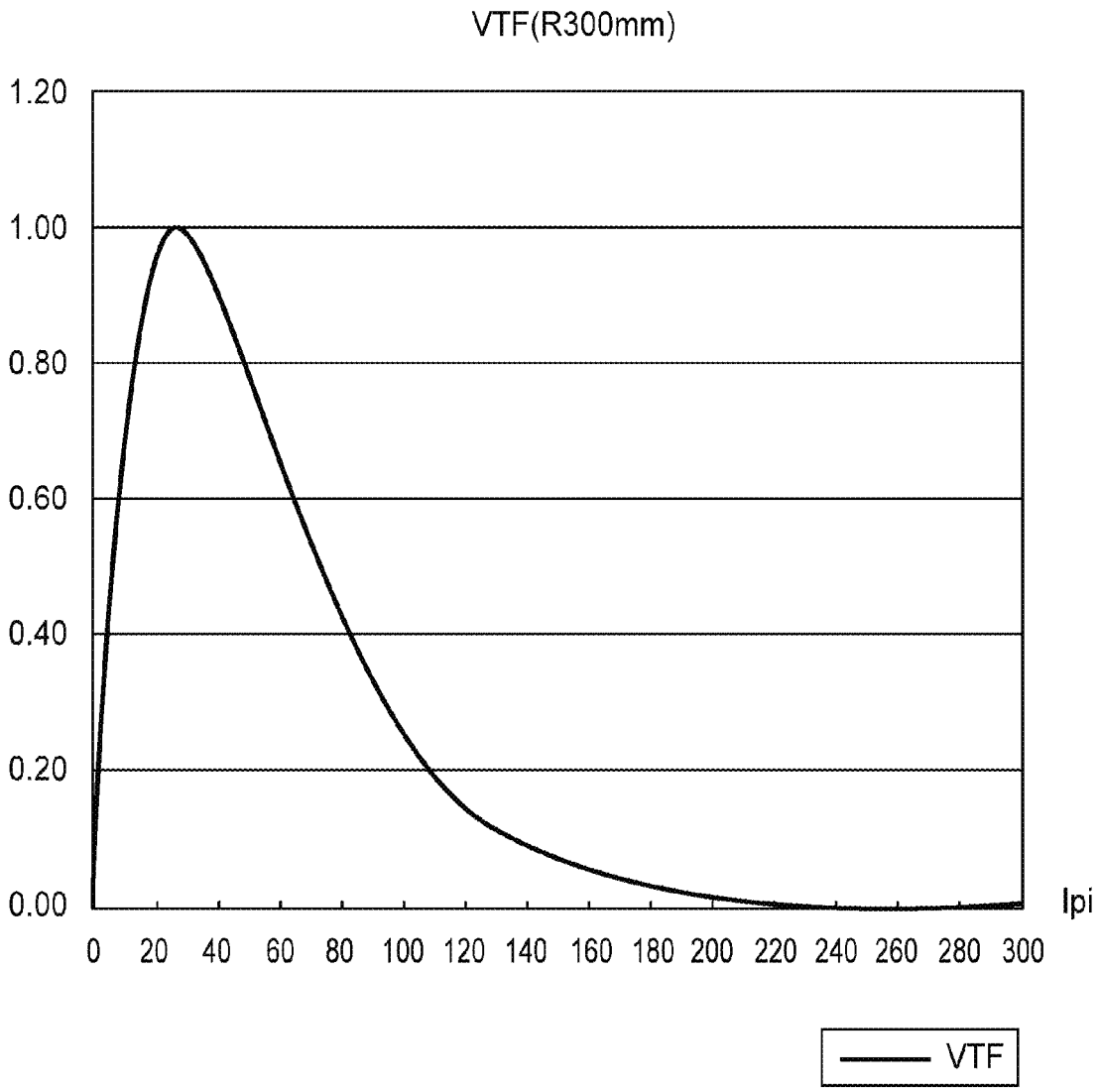
FIG. 13 is a graph showing an example of a VTF function (visual spatial frequency characteristic).

The area of the image (C), i.e., an obtained area of (A) and (B) may preferably be, from a viewpoint of reliability of standard deviation ($\sigma$) of a dot area described later, an area in which the number of dots of the screen pattern (B) is 400 (dots) or more. Further, in order to properly make image quality evaluation, an appropriate area is selected based on a human visual sense property. For example, the area can be determined from a VTF function (visual spatial frequency characteristic) representing visual revolting power with respect to a wave number (line number) shown in FIG. 13. FIG. 13 is the VTF function with an observation distance of 300 mm, in which an ordinate represents visual sensitivity and an abscissa represents the wave number (line number).

In FIG. 13, the visual sensitivity (ordinate) when the wave number (abscissa) is on the order of 1 (lpi) is sufficient low, i.e., even when a change in light and shade generates at a period longer than 1 (lpi), FIG. 13 shows that the change is not visible to human eyes. Therefore, the obtained area can be a square region with a side of 25.4 mm.

Or, in accordance with an image quality attribute and its measuring method shown in ISO 13660, the obtained area can be square region with a side of 21.2 mm. Or, the obtained area can be not less than an area in which the standard deviation (σ) of the dot area described later does not depend on the obtained area. For example, if the pattern of (A) and (B) is uniform, even when the obtained area is small, the dot area standard deviation (σ) does not depend on the obtained area. Therefore, the obtained area can be appropriately set depending on the pattern of (A) and (B).

In this embodiment, an area in which (σ) does not depend on the obtained area will be verified. Then, an obtained range of the plurality of recessed portion arrangements (A) and the screen pattern (B) on the photosensitive member was taken as a square region of 10.84 mm (10.84 mm=corresponding to 1024 dots at 2400 lpi). However, needless to say, the range of (A) and (B) in this embodiment may only be required to be properly set from the above-described viewpoint, and may also be one which is not the square region of 10.84 mm.

Figure 17:
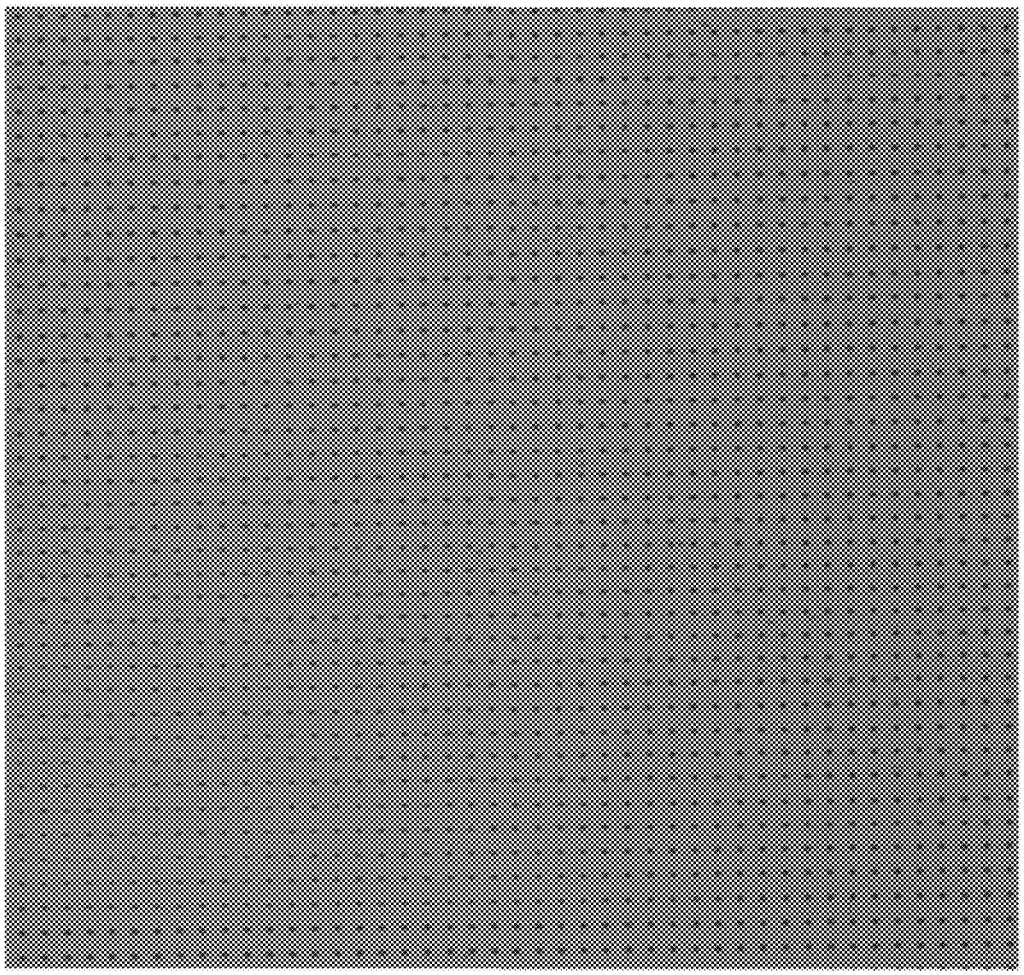
FIG. 17 is an illustration showing an example of a photograph, of an electrophotographic photosensitive member surface having recessed portions, obtained by GX-700.

In the case where the obtained range of the plurality of recessed portion arrangements (A) and the screen pattern (B) on the photosensitive member is a wide range, an image connecting function of the above-described group of the microscopes is effective. Or, the area may also be obtained using "GX-700", manufactured by Revox Inc., capable of wide-range phototaking with a CCD camera. A photograph, of the electrophotographic photosensitive member surface including the recessed portions, obtained by "GX-700" is shown in FIG. 17. The plurality of recessed portion arrangements (A) and the screen pattern (B) can be obtained by subjecting this CCD photograph to binarization. In the case of the plurality of recessed portion arrangements (A), it is preferable that the shape of the specific recessed portions is grasped by the above-described gradation of microscopes and is reflected in a binarized image.

Further, in the case where the screen pattern (B) generated by the process of the pseudo halftone formed by dots is obtained by the microscope observation, if the method is the AM screening, the following method may also be used. That is, on the basis of a result of the microscope observation at a part of the area, binarized image data having a large area can also be formed using a commercially available software. After the obtaining the microphotograph at a part of the area and the binarization, the resolution can be determined from the dot diameter. Further, a shortest dot interval between adjacent dots is measured with respect to a main scan direction and a sub-scan direction of image exposure light, so that an angle and a line number can be determined by calculation. As an example, the case of a square arrangement with a resolution of 2400 dpi is shown in Table 1.

For example, when the shortest dot interval between adjacent dots measured from the binarized image corresponds to main scanning 2 dots and sub-scanning 9 dots, it can be said that the dot period is main scanning 3rd period and sub-scanning 10-th period. In Table 1, when an intersection of the main scanning 3rd period and the sub-scanning 10-th period is viewed, it is understood that a screen angle is 73.3° and the line number is 230 (lpi ("L" in Table 1)). In this way, if the resolution, the angle and the line number can be grasped, the binarized image data having a large area can be generated using a conversion method, of "Photoshop" of Adobe Systems Inc., from a grayscale into monochromatic 2 gradation levels (halftone screen).

Also with respect to the plurality of recessed portion arrangements (A) on the photosensitive member, in the case where the recessed portions are arranged as in the AM screening, a similar method can be used. The image quality lowering index (f) may also be calculated using the binarized image data generated in the above-described manner.

Incidentally, in either means described above, in the case where the plurality of recessed portion arrangement, (A) on the photosensitive member is grasped, the recessed portion arrangements (A) are determined in accordance with the criterion described with respect to the opening shape of the specific recessed portion with reference to FIG. 1.

TABLE 1

| | | MAIN SCAN PIXEL PERIOD SCANNING FREQUENCY 2400 DPI | | | | | | | | | |
|---|---|---|---|---|---|---|---|---|---|---|---|
| | | 0 | 1 | 2 | 3 | 4 | 5 | 6 | 7 | 8 | 9 |
| SUB-SCAN PIXEL PERIOD | 0 | | 0.0° 2400 L | 0.0° 1200 L | 0.0° 800 L | 0.0° 600 L | 0.0° 480 L | 0.0° 400 L | 0.0° 343 L | 0.0° 300 L | 0.0° 267 L |
| | 1 | 90.0° 2400 L | 45.0° 1697 L | 26.6° 1073 L | 18.4° 759 L | 14.0° 582 L | 11.3° 471 L | 9.5° 395 L | 8.1° 339 L | 7.1° 298 L | 6.3° 265 L |
| | 2 | 90.0° 1200 L | 63.4° 1073 L | 45.0° 849 L | 33.7° 666 L | 26.6° 537 L | 21.8° 446 L | 18.4° 379 L | 15.9° 330 L | 14.0° 291 L | 12.5° 260 L |
| | 3 | 90.0° 800 L | 71.6° 759 L | 56.3° 666 L | 45.0° 566 L | 36.9° 480 L | 31.0° 412 L | 26.6° 358 L | 23.2° 315 L | 20.6° 281 L | 18.4° 253 L |
| | 4 | 90.0° 600 L | 76.0° 582 L | 63.4° 537 L | 53.1° 480 L | 45.0° 424 L | 38.7° 375 L | 33.7° 333 L | 29.7° 298 L | 26.6° 268 L | 24.0° 244 L |
| | 5 | 90.0° 480 L | 78.7° 471 L | 68.2° 446 L | 59.0° 412 L | 51.3° 375 L | 45.0° 339 L | 39.8° 307 L | 35.5° 279 L | 32.0° 254 L | 29.1° 233 L |
| | 6 | 90.0° 400 L | 80.5° 395 L | 71.6° 379 L | 63.4° 358 L | 56.3° 333 L | 50.2° 307 L | 45.0° 283 L | 40.6° 260 L | 36.9° 240 L | 33.7° 222 L |
| | 7 | 90.0° 343 L | 81.9° 339 L | 74.1° 330 L | 66.8° 315 L | 60.3° 298 L | 54.5° 279 L | 49.4° 260 L | 45.0° 242 L | 41.2° 226 L | 37.9° 210 L |
| | 8 | 90.0° 300 L | 82.9° 298 L | 76.0° 291 L | 69.4° 281 L | 63.4° 268 L | 58.0° 254 L | 53.1° 240 L | 48.8° 226 L | 45.0° 212 L | 41.6° 199 L |
| | 9 | 90.0° 267 L | 83.7° 265 L | 77.5° 260 L | 71.6° 253 L | 66.0° 244 L | 60.9° 233 L | 56.3° 222 L | 52.1° 210 L | 48.4° 199 L | 45.0° 189 L |
| | 10 | 90.0° 240 L | 84.3° 239 L | 78.7° 235 L | 73.3° 230 L | 68.2° 223 L | 63.4° 215 L | 59.0° 206 L | 55.0° 197 L | 51.3° 187 L | 48.0° 178 L |
| | 11 | 90.0° 218 L | 84.8° 217 L | 79.7° 215 L | 74.7° 210 L | 70.0° 205 L | 65.6° 199 L | 61.4° 192 L | 57.5° 184 L | 54.0° 176 L | 50.7° 169 L |
| | 12 | 90.0° 200 L | 85.2° 199 L | 80.5° 197 L | 76.0° 194 L | 71.6° 190 L | 67.4° 185 L | 63.4° 179 L | 59.7° 173 L | 56.3° 166 L | 53.1° 160 L |
| | 13 | 90.0° 185 L | 85.6° 184 L | 81.3° 182 L | 77.0° 180 L | 72.9° 176 L | 69.0° 172 L | 65.2° 168 L | 61.7° 163 L | 58.4° 157 L | 55.3° 152 L |

TABLE 1-continued

| | MAIN SCAN PIXEL PERIOD SCANNING FREQUENCY 2400 DPI | | | | | | | | | |
|---|---|---|---|---|---|---|---|---|---|---|
| 14 | 90.0° | 85.9° | 81.9° | 77.9° | 74.1° | 70.3° | 66.8° | 63.4° | 60.3° | 57.3° |
| | 171 L | 171 L | 170 L | 168 L | 165 L | 161 L | 158 L | 153 L | 149 L | 144 L |
| 15 | 90.0° | 86.2° | 82.4° | 78.7° | 75.1° | 71.6° | 68.2° | 65.0° | 61.9° | 59.0° |
| | 160 L | 160 L | 159 L | 157 L | 155 L | 152 L | 149 L | 145 L | 141 L | 137 L |
| 16 | 90.0° | 86.4° | 82.9° | 79.4° | 76.0° | 72.6° | 69.4° | 66.4° | 63.4° | 60.6° |
| | 150 L | 150 L | 149 L | 147 L | 146 L | 143 L | 140 L | 137 L | 134 L | 131 L |
| 17 | 90.0° | 86.6° | 83.3° | 80.0° | 76.8° | 73.6° | 70.6° | 67.6° | 64.8° | 62.1° |
| | 141 L | 141 L | 140 L | 139 L | 137 L | 135 L | 133 L | 131 L | 128 L | 125 L |
| 18 | 90.0° | 86.8° | 83.7° | 80.5° | 77.5° | 74.5° | 71.6° | 68.7° | 66.0° | 63.4° |
| | 133 L | 133 L | 133 L | 132 L | 130 L | 128 L | 126 L | 124 L | 122 L | 119 L |
| 19 | 90.0° | 87.0° | 84.0° | 81.0° | 78.1° | 75.3° | 72.5° | 69.8° | 67.2° | 64.7° |
| | 126 L | 126 L | 126 L | 125 L | 124 L | 122 L | 120 L | 119 L | 116 L | 114 L |

| | | 10 | 11 | 12 | 13 | 14 | 15 | 16 | 17 | 18 | 19 |
|---|---|---|---|---|---|---|---|---|---|---|---|
| SUB-SCAN PIXEL PERIOD | 0 | 0.0° | 0.0° | 0.0° | 0.0° | 0.0° | 0.0° | 0.0° | 0.0° | 0.0° | 0.0° |
| | | 240 L | 218 L | 200 L | 185 L | 171 L | 160 L | 150 L | 141 L | 133 L | 126 L |
| | 1 | 5.7° | 5.2° | 4.8° | 4.4° | 4.1° | 3.8° | 3.6° | 3.4° | 3.2° | 3.0° |
| | | 239 L | 217 L | 199 L | 184 L | 171 L | 160 L | 150 L | 141 L | 133 L | 126 L |
| | 2 | 11.3° | 10.3° | 9.5° | 8.7° | 8.1° | 7.6° | 7.1° | 6.7° | 6.3° | 6.0° |
| | | 235 L | 215 L | 197 L | 182 L | 170 L | 159 L | 149 L | 140 L | 133 L | 126 L |
| | 3 | 16.7° | 15.3° | 14.0° | 13.0° | 12.1° | 11.3° | 10.6° | 10.0° | 9.5° | 9.0° |
| | | 230 L | 210 L | 194 L | 180 L | 168 L | 157 L | 147 L | 139 L | 132 L | 125 L |
| | 4 | 21.8° | 20.0° | 18.4° | 17.1° | 15.9° | 14.9° | 14.0° | 13.2° | 12.5° | 11.9° |
| | | 223 L | 205 L | 190 L | 176 L | 165 L | 155 L | 146 L | 137 L | 130 L | 124 L |
| | 5 | 26.6° | 24.4° | 22.6° | 21.0° | 19.7° | 18.4° | 17.4° | 16.4° | 15.5° | 14.7° |
| | | 215 L | 199 L | 185 L | 172 L | 161 L | 152 L | 143 L | 135 L | 128 L | 122 L |
| | 6 | 31.0° | 28.6° | 26.6° | 24.8° | 23.2° | 21.8° | 20.6° | 19.4° | 18.4° | 17.5° |
| | | 206 L | 192 L | 179 L | 168 L | 158 L | 149 L | 140 L | 133 L | 126 L | 120 L |
| | 7 | 35.0° | 32.5° | 30.3° | 28.3° | 26.6° | 25.0° | 23.6° | 22.4° | 21.3° | 20.2° |
| | | 197 L | 184 L | 173 L | 163 L | 153 L | 145 L | 137 L | 131 L | 124 L | 119 L |
| | 8 | 38.7° | 36.0° | 33.7° | 31.6° | 29.7° | 28.1° | 26.6° | 25.2° | 24.0° | 22.8° |
| | | 187 L | 176 L | 166 L | 157 L | 149 L | 141 L | 134 L | 128 L | 122 L | 116 L |
| | 9 | 42.0° | 39.3° | 36.9° | 34.7° | 32.7° | 31.0° | 29.4° | 27.9° | 26.6° | 25.3° |
| | | 178 L | 169 L | 160 L | 152 L | 144 L | 137 L | 131 L | 125 L | 119 L | 114 L |
| | 10 | 45.0° | 42.3° | 39.8° | 37.6° | 35.5° | 33.7° | 32.0° | 30.5° | 29.1° | 27.8° |
| | | 170 L | 161 L | 154 L | 146 L | 139 L | 133 L | 127 L | 122 L | 117 L | 112 L |
| | 11 | 47.7° | 45.0° | 42.5° | 40.2° | 38.2° | 36.3° | 34.5° | 32.9° | 31.4° | 30.1° |
| | | 161 L | 154 L | 147 L | 141 L | 135 L | 129 L | 124 L | 119 L | 114 L | 109 L |
| | 12 | 50.2° | 47.5° | 45.0° | 42.7° | 40.6° | 38.7° | 36.9° | 35.2° | 33.7° | 32.3° |
| | | 154 L | 147 L | 141 L | 136 L | 130 L | 125 L | 120 L | 115 L | 111 L | 107 L |
| | 13 | 52.4° | 49.8° | 47.3° | 45.0° | 42.9° | 40.9° | 39.1° | 37.4° | 35.8° | 34.4° |
| | | 146 L | 141 L | 136 L | 131 L | 126 L | 121 L | 116 L | 112 L | 108 L | 104 L |
| | 14 | 54.5° | 51.8° | 49.4° | 47.1° | 45.0° | 43.0° | 41.2° | 39.5° | 37.9° | 36.4° |
| | | 139 L | 135 L | 130 L | 126 L | 121 L | 117 L | 113 L | 109 L | 105 L | 102 L |
| | 15 | 56.3° | 53.7° | 51.3° | 49.1° | 47.0° | 45.0° | 43.2° | 41.4° | 39.8° | 38.3° |
| | | 133 L | 129 L | 125 L | 121 L | 117 L | 113 L | 109 L | 106 L | 102 L | 99 L |
| | 16 | 58.0° | 55.5° | 53.1° | 50.9° | 48.8° | 46.8° | 45.0° | 43.3° | 41.6° | 40.1° |
| | | 127 L | 124 L | 120 L | 116 L | 113 L | 109 L | 106 L | 103 L | 100 L | 97 L |
| | 17 | 59.5° | 57.1° | 54.8° | 52.6° | 50.5° | 48.6° | 46.7° | 45.0° | 43.4° | 41.8° |
| | | 122 L | 119 L | 115 L | 112 L | 109 L | 106 L | 103 L | 100 L | 97 L | 94 L |
| | 18 | 60.9° | 58.6° | 56.3° | 54.2° | 52.1° | 50.2° | 48.4° | 46.6° | 45.0° | 43.5° |
| | | 117 L | 114 L | 111 L | 108 L | 105 L | 102 L | 100 L | 97 L | 94 L | 92 L |
| | 19 | 62.2° | 59.9° | 57.7° | 55.6° | 53.6° | 51.7° | 49.9° | 48.2° | 46.5° | 45.0° |
| | | 112 L | 109 L | 107 L | 104 L | 102 L | 99 L | 97 L | 94 L | 92 L | 89 L |

(2) Particle analysis is made with respect to the image (C), and an average (value) SM of dot areas and a standard deviation (σ) of the dot areas are calculated.

The particle analysis is made with respective to the image (C) which is a binary image, so that an individual area is grasped with respect to all the dots of the image (C). The particle analysis can be made using a commercially available software such as a particle analysis software ("GRADING ANALYSIS") made by Keyence Corp. On the basis of this data, the average SM of the dot areas and the standard deviation (σ) of the dot areas are calculated. The average SM of the dot areas is an arithmetic average (value) obtained by dividing the sum of dot areas Si by the number n of all the dots, and is obtained by a formula (2).

$$SM = \frac{1}{n}\sum_{i=1}^{n} S_i \tag{2}$$

The standard deviation (σ) of the dot areas is a square root of variance ($\sigma^2$) derived by the following formula (3) when an area of a certain dot is Si and the number of all the dots is n, and a value representing a degree of a variation in dot area. The standard deviation (σ) of the dot areas means that as a value thereof is smaller, the degree of the variation in dot area is smaller, so that the image quality lowering, i.e., a lowering in graininess (roughness) and the moire and suppressed.

$$\sigma^2 = \frac{1}{n-1}\sum_{i=1}^{n}(S_i - SM)^2 \quad (3)$$

(3) The image quality lowering index (f) is obtained by the following formula (1).

$$f=\sigma/SM \quad \text{formula (1)}$$

The standard deviation (σ) of the dot areas depends on the value of the average SM of the dot areas, and therefore the image quality lowering of the screen pattern (B) having a large dot diameter and the image quality lowering of the screen pattern (B) having a small dot diameter cannot be simply compared. Therefore, for standardization, the standard deviation (σ) of the dot areas is divided by the average SM of the dot areas.

As a result of study by the present inventors, it turned out that the image quality lowering can be suppressed by making arrangement of the recessed portions so that the image quality lowering index (f) obtained by converting the degree of the lowering in variation of the dropped dots described above into a numerical form is 14% or less.

The image quality lowering index (f) of being 14% or less means that the variation in dropped dots is small and the lowering in graininess and the moire are suppressed.

<Arrangement of Recessed Portions on Surface of Electrophotographic Photosensitive Member>

The recessed portion arrangement in which the image quality lowering index (f) is 14% or less is not limited so long as the recessed portion arrangement satisfies the features 1-3 which are the item for suppressing the image deletion. Separately, not the recessed portion arrangement, there is also a method of suppressing the image quality lowering by using the FM screening as the pseudo halftone process, but the FM screening itself tends to lower in roughness. For that reason, in the electrophotographic apparatus, in general, the AM screening and the FM screening are used properly depending on a required image quality.

With respect to the AM screening, in order to make the recessed portion arrangement for reducing the image quality lowering index, it is possible to cite, e.g., a method in which a plurality of species of recessed portion opening diameters exist in mixture. Further, it is possible to cite a method in which the recessed portion opening diameter or the recessed portion density is made much large or small compared with the dot diameter. However, the recessed portion opening diameter and the recessed portion density have proper ranges for suppressing the image deletion as another effect, and also with respect to the pattern for the AM screening, the dot diameter and density vary depending on the density and the resolution, and therefore a degree of design latitude (flexibility) is liable to narrow. For designing the recessed portion arrangement, two methods cited below are efficient.

One is a method in which the recessed portions are regularly arranged and a direction of arrangement of the recessed portion arrangements is optimized with respect to the AM screening pattern by the process of the pseudo halftone formed by the dots which are intended to be outputted. In the case where the recessed portions are regularly arranged, although the graininess (roughness) does not readily lowers, the low-wave number moire is liable to generate. The low-wave number moire is liable to generate when the recessed portion arrangement is close to the line number and the angle of the pattern for the pseudo halftone process, and therefore by arranging the recessed portions so that the angle of the arrangement of the recessed portion arrangement and the angle of the screen pattern approach a perpendicular state to the possible extent, the image quality lowering index (f) can be made low.

Another one is a method in which the recessed portions are irregularly arranged. In the case where the recessed portions are irregularly arranged, e.g., in a tandem device, the angle of the AM screening pattern is different every color, and therefore there is a need to make recessed portion arrangement design depending on each of colors, so that the degree of design latitude narrows. On the other hand, if the recessed portions are irregularly arranged, even at any AM screening pattern angle, it is possible to lower the image quality lowering index (f). However, compared with the case where the recessed portions are regularly arranged, there is a tendency that the graininess (roughness) lowers, and therefore it is preferable that the recessed portion arrangement is designed in combination with the recessed portion opening diameter and density.

As a means for irregularly arranging the recessed portions on the surface of the photosensitive member, any method may also be used if design can be made to lower the image quality lowering index (f). Particularly, in the case where the method of forming the recessed portions on the surface of the photosensitive member is a method capable of intentionally controlling the recessed portion arrangement, to the design thereof, the FM screening method which is one of the pseudo halftone processes can be applied. The method capable of intentionally controlling the recessed portion arrangement is a method in which the mold including projected portions described later is press-contacted to the surface of the electrophotographic photosensitive member or a forming method of recessed portions by laser light irradiation.

The FM screening is the pseudo halftone process in which irregular dot arrangement is made and gradation is represented by changing the dot density, and is employed in an offset printing machine, a printer of an electrophotographic type and many image forming apparatuses of an ink jet type and the like. By using a random algorithm for generating the irregular dot arrangement for the FM screening, it is possible to design the irregular recessed portion arrangement. The random algorithm is variously developed and if the image quality lowering index (f) becomes low, any method may also be used.

In this embodiment, of error diffusion methods which are a most common FM screening, Floyd-Steinberg method was used. The Floyd-Steinberg method is a method in which a difference (error) between a signal value at a noting pixel of image data and a signal value when the noting pixel is binarized is distributed among adjacent pixels.

Figure 14:
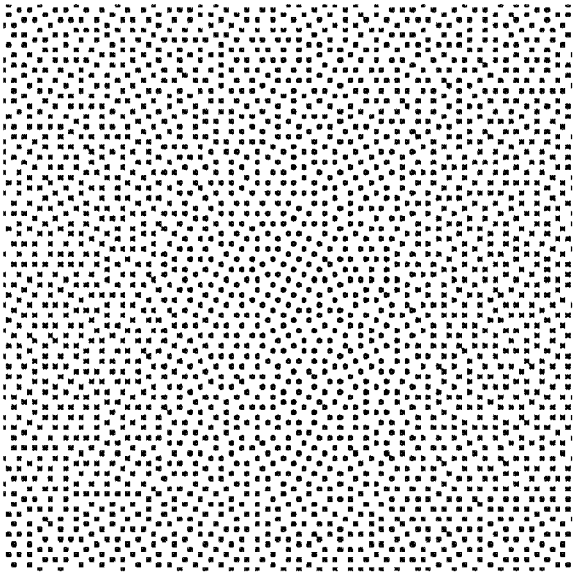
In FIG. 14, (a) is an illustration showing an algorithm of Floyd-Steinberg method, and (b) is an illustration showing an example of an irregular pattern generated by the Floyd-Steinberg method.

An example thereof is shown in (a) of FIG. 14. In this figure, of the errors of the noting pixels, 7/16 is added to a signal value of a pixel adjacent to the noting pixel on the right side. Also to pixels positioned on the lower right side, the (immediately) lower side and the lower left side, the errors of the noting pixel are distributed at proportions indicated in the figure. With respect to other pixels, binarization is successively made while reflecting this distribution result therein. As a result thereof, a pattern having a non-periodical characteristic as shown in (b) can be generated. At this time, by changing a pixel size, a distribution proportion, and the number of pixels subjected to distribution (of the errors), it is possible to design arbitrary recessed portion opening size, recessed portion density and recessed portion arrangement.

<Method of Forming Recessed Portions on Surface of Electrophotographic Photosensitive Member>

As the recessed portion forming method, if a method is capable of satisfying the above-described requirements relating to the recessed portions, the method is not particularly limited. For example, it is possible to cite a surface forming method for the electrophotographic photosensitive member by laser light irradiation having such an output characteristic that a pulse width is 100 ns (nanoseconds) or less and a method in which a mold having a predetermined shape is press-contacted to the surface of the electrophotographic photosensitive member to transfer the shape.

The recessed portion forming method by the laser light irradiation having the output characteristic that the pulse width is 100 ns (nanoseconds) or less will be described.

As specific examples of the laser used in this method, it is possible to cite an excimer laser using gas, such as ArF, KrF, XeF or XeCl, as a laser medium, and a femtosecond laser using titanium sapphire as the medium. Further, a wavelength of laser light in the laser irradiation described above may preferably be 1,000 nm or less.

The excimer laser (light) described above is laser light emitted in the following step. First, high energy such as electric discharge, electron beam or X-rays is given to a mixture gas of rare gas such as Ar, Kr or Xe with halogen gas such as F or Cl, so that the above elements are excited and bonded. Thereafter, when the resultant gas causes dissociation by drop in the ground state, excimer laser light is emitted. As the gas used in the excimer laser, it is possible to cite ArF, KrF, XeCl or XeF, but any gas may also be used. Particularly, KrF or ArF is preferable.

Figure 15:
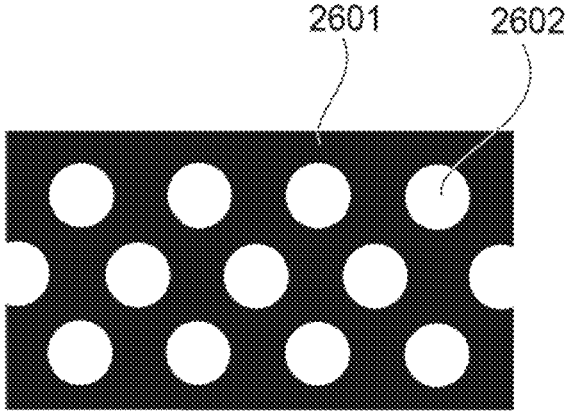
In FIG. 15, (a) is an illustration showing an example of a mask used in a method of forming recessed portions by laser light irradiation, and (b) is an illustration showing an example of a recessed portion forming device through the laser light irradiation.
Figure 15:
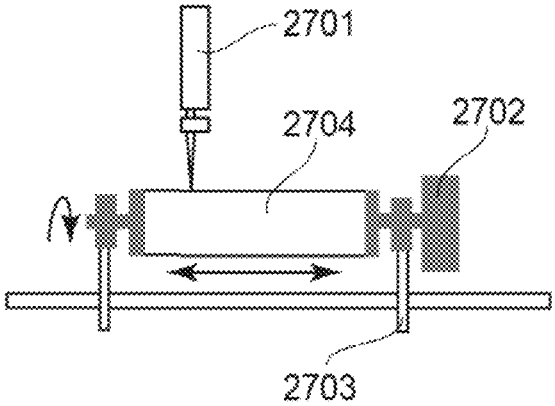

As the recessed portion forming method, as shown in (a) of FIG. 15, a mask in which a laser light blocking portion 2601 and laser light transmitting portions 2602 are appropriately arranged is used. Only the laser light passed through the mask is focused by a lens and a work to be processed is irradiated with the laser light, so that it becomes possible to form the recessed portions having a desired shape and arrangement. Many recessed portions in a certain area can be instantaneously and simultaneously processed independently of the shape and the area thereof, and therefore the step can be performed in a short time. By the laser irradiation using the mask, several $mm^2$ to several $cm^2$ is processed per one irradiation.

In the laser machining, as shown in (b) of FIG. 15, first, by a work rotating motor 2702, an electrophotographic photosensitive member 2704 which is the work is rotated on its axis. While rotating the electrophotographic photosensitive member 2704 on its axis, a laser irradiation position of a laser oscillation portion 2701 is shifted in an axial direction of the electrophotographic photosensitive member 2704 by a work moving device 2703, whereby the recessed portions can be efficiently formed over an entire gradation of the surface of the electrophotographic photosensitive member 2704. A depth of the recessed portions is adjustable to within a desired range by an irradiation time and the number of times of irradiation of the laser light, and the like. According to such a constitution, it is possible to realize surface roughening region which is high in a control property of the size, the shape and the arrangement of the recessed portions is high, so that and which is high in accuracy and latitude.

Figure 4:
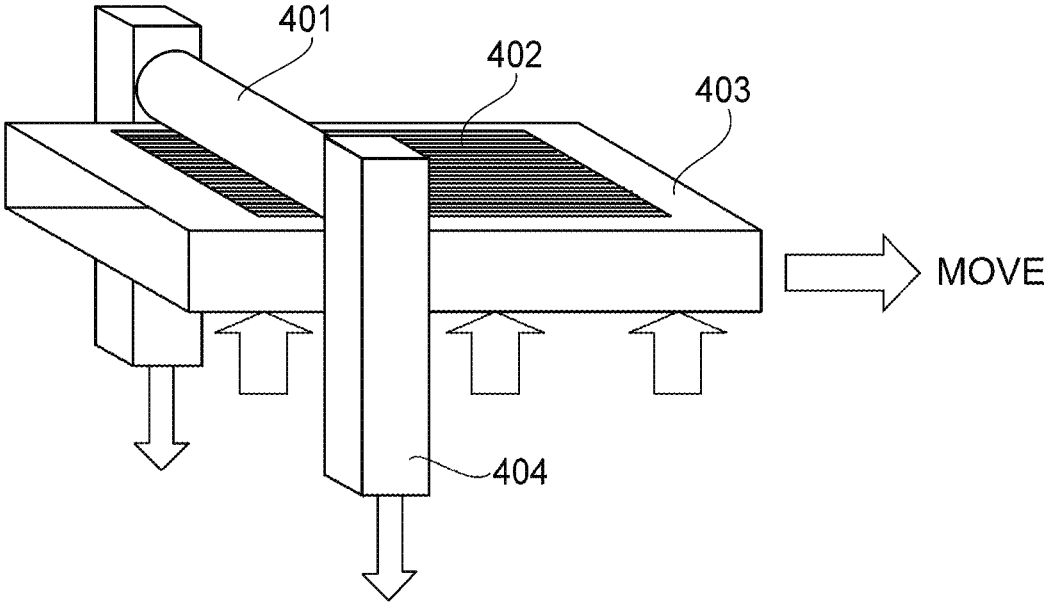
FIG. 4 is an illustration showing an example of a press-contact shape transfer processing device for forming recessed portions on the surface of the electrophotographic photosensitive member.

Next, the recessed portion forming method in which a mold including recessed portions corresponding to the recessed portions to be formed is press-contacted to the surface of the electrophotographic photosensitive member and shape transfer is made will be described. In FIG. 4, an example of a press-contact shape transfer processing device for forming the recessed portions on the surface of the electrophotographic photosensitive member is shown.

According to the press-contact shape transfer processing device shown in FIG. 4, the recessed portions and the flat portion can be formed on the surface of an electrophotographic photosensitive member 401 by continuously bringing a mold 402 into contact with the surface (peripheral surface) of the electrophotographic photosensitive member 401 and by pressing the mold 402 against the surface while rotating the electrophotographic photosensitive member 401 which is a work to be processed.

As a material for a pressing member 403, it is possible to cite, e.g., metal, metal oxide, plastics and glass. Of these, from viewpoints of a mechanical strength, a dimension accuracy and a durability, stainless steel (SUS) is preferable. On the pressing member 403, the mold is mounted at an upper surface thereof. By a supporting member (not shown) and a pressing system (not shown) in a lower surface side, the mold 402 can be contacted at a predetermined pressure to the surface of the electrophotographic photosensitive member 401 supported by a supporting member 404. Further, the supporting member 404 may also be pressed against the pressing member 403 at a predetermined pressure, and the supporting member 404 and the pressing member 403 may also be pressed against each other.

An example shown in FIG. 4 is an example in which by moving the pressing member 403, the surface of the electrophotographic photosensitive member 401 is continuously processed while rotating the electrophotographic photosensitive member 401 by the movement of the pressing member 403 or by drive of the electrophotographic photosensitive member 401. Further, it is also possible to continuously process the surface of the electrophotographic photosensitive member 401 by moving the supporting member 404 while fixing the pressing member 403 or by moving both the supporting member 404 and the pressing member 403. Incidentally, from a viewpoint that the shape transfer is efficiently made, it is preferable that the mold 402 and the electrophotographic photosensitive member 401 are heated.

As the mold, it is possible to cite, e.g., metal and a resin film which are subjected to minute surface processing or one in which a surface of the silicone wafer is subjected to patterning with a resist. Further, it is possible to cite a resin film in which fine particles are dispersed and one in which a resin film having a minute surface shape is subjected to metal coating. Further, from a viewpoint that a pressure at which the mold is pressed against the electrophotographic photosensitive member is made uniform, it is preferable that an elastic member is provided between the member and the pressing member.

<Constitution of Electrophotographic Photosensitive Member>

The electrophotographic photosensitive member in this embodiment includes a supporting member and a photosensitive layer formed on the supporting member. As a shape of the electrophotographic photosensitive member, it is possible to cite, e.g., a cylindrical shape, a belt (endless belt) shape and a sheet shape.

The photosensitive layer may be a single layer type photosensitive layer containing a charge transporting substance and a charge generating substance in the same layer and may also be a lamination type (function separation type) photosensitive layer which is separated into a charge generating layer containing the charge generating substance and a charge transporting layer containing the charge transporting substance. From a viewpoint of the electrophotographic characteristic, the lamination type photosensitive layer is preferable. Further, the lamination type photosensitive layer may be a normal layer type photosensitive layer in which from a supporting member side, the charge generating layer and the charge transporting layer are laminated in this order and may also be a reverse layer type photosensitive layer in which from the supporting member side, the charge transporting layer and the charge generating layer are laminated in this order. From the viewpoint of the electrophotographic characteristic, the normal layer type photosensitive layer is preferable. Further, the charge generating layer may also have a lamination constitution, and the charge transporting layer may also have the lamination constitution.

As the supporting member, a supporting member showing electroconductivity (electroconductive supporting member) is preferable. As a material for the supporting member, it is possible to cite, e.g., metals (alloys) such as iron, copper, gold, silver, aluminum, zinc, titanium, lead, nickel, tin, antimony, indium, chromium, aluminum alloy and stainless steel. Further, it is also possible to use a metal-made supporting member and a plastic-made supporting member which include a coating film formed by vacuum vapor deposition using, e.g., aluminum, aluminum ally or indium oxide-tin oxide alloy.

Further, it is also possible to use a supporting member constituted by plastic or paper impregnated with electroconductive particles such as carbon black, tin oxide particles, titanium oxide particles or silver particles, or a supporting member made of an electroconductive binder resin.

A surface of the supporting member may also be subjected to, e.g., cutting (machining), surface roughening or alumite process for the purpose of suppression of an interference fringe due to scattering of the laser light.

Between the supporting member and an under coat layer described later or the photosensitive layer (charge generating layer, charge transporting layer), e.g., for the purpose of suppressing the interference fringe due to the scattering of the laser light and for coating damage on the supporting member, an electroconductive layer may also be provided. The electroconductive layer can be formed, e.g., by applying an application liquid, for the electroconductive layer, obtained by dispersing carbon black, an electroconductive pigment and a resistance adjusting pigment together with a binder resin in a solvent and by drying a resultant film (layer). Further, to the application liquid for the electroconductive layer, e.g., a compound which is cured and polymerized by heating, ultraviolet irradiation or radiation exposure (irradiation) may also be added. For example, the electroconductive layer in which the electroconductive pigment and the resistance adjusting pigment are dispersed tends t be roughened at a surface thereof.

As the binder resin used in the electroconductive layer, it is possible to cite, e.g., acrylic resin, allyl resin, alkyd resin, ethyl cellulose resin, ethylene-acrylic acid copolymer, epoxy resin, casein resin, silicone resin, gelatine resin and phenolic resin. Further, it is possible to cite butyral resin, polyacrylate resin, polyacetal resin, polyamideimide resin, polyamide resin, polyallyl ether resin, polyimide resin, polyurethane resin, polyester resin, polycarbonate resin and polyethylene resin.

Further, it is possible to cite polyvinyl chloride, polyvinyl acetate, polyvinylacetal, polystyrene resin, polysulfone resin, polyvinyl alcohol resin and polyphenylene oxide. It is possible to cite polyvinyl fluoride, polybutadiene resin, polypropylene resin, melamine resin, urea resin, agarose resin and cellulose resin.

As the electroconductive pigment and the resistance adjusting pigment, it is possible to cite, e.g., particles of metals (alloys) such as aluminum, zinc, copper, chromium, nickel, silver and stainless steel, or one obtained by vapour deposition of these particles on a surface of plastic resins. Further, it is also possible to use particles of metal oxides such as zinc oxide, titanium oxide, tin oxide, antimony oxide, indium oxide, bismuth oxide, indium oxide doped with tin, and tin oxide doped with antimony or tantalum.

These may be used only in a single species or may also be used in a combination of two or more species. In the case where the two or more species are used in combination, they may be only mixed and may also be changed into a solid solution or a melted form. Further, it is possible to subject the electroconductive pigment and the resistance adjusting pigment to surface treatment. As a surface treating agent, e.g., a surfactant, a silane coupling agent and a titanium coupling agent are used.

Further, for the purpose of light scattering, particles such as silicone resin fine particles or acrylic resin fine particles may also be added. Further, an additive such as a leveling agent, a dispersing agent, an antioxidant, an ultraviolet absorber, a plasticizer or a rectifying material may also be incorporated.

A film thickness of the electroconductive layer may preferably be 0.2 μm or more and 40 μm or less, more preferably be 1 μm or more and 35 μm or less, further preferably be 5 μm or more and 30 μm or less.

Between the supporting member or the electroconductive layer and the photosensitive layer (charge generating layer, charge transporting layer), the under coat layer (intermediary layer) may also be provided for the purpose of improving an adhesive property of the photosensitive layer, of improving an application property, of improving a charge injection property from the supporting member and of protecting the photosensitive layer from electrical breakage. A constituent material for the under coat layer is not particularly limited so long as the material satisfies a function. For example, the material may be constituted by a resin alone and may also be constituted by a mixture of the resin and the metal oxide.

The under coat layer constituted by the resin alone can be formed by applying an application liquid, for the under coat layer, obtained by dissolving the resin (binder resin) in a solvent, and by drying a resultant application film.

As the resin used in the under coat layer constituted by the resin alone, it is possible to cite, e.g., polyvinyl alcohol, poly-N-vinylimidazole, polyethylene oxide, ethyl cellulose and ethylene-acrylic acid copolymer. Further, it is possible to cite casein, polyamide, N-methoxymethylated 6 nylon, nylon copolymer, glue and gelatine.

A film thickness of the under coat layer constituted by the resin alone may preferably be 0.05 μm or more and 7 μm or less, more preferably be 0.1 μm or more and 2 μm or less.

The under coat layer constituted by the mixture of the resin with the metal oxide can be formed by applying an application liquid, for the under coat layer, obtained by dispersing the metal oxide particles together with the binder resin in a solvent, and by drying a resultant application film.

The metal oxide particles contained in the under coat layer constituted by the mixture of the resin with the metal oxide may preferably be particles containing at least one species selected from a group consisting of titanium oxide, zinc oxide, tin oxide, zirconium oxide and aluminum oxide. Of the particles containing the above metal oxides, the particles containing zinc oxide is further preferable.

The metal oxide particles may also be particles treated with a surface treating agent such as silane coupling agent at a surface of the metal oxide particles in order to suppress a black spot-like image defect due to charge injection from the supporting member toward the photosensitive layer side.

As the silane coupling agent, it is possible to cite N-2-(aminoethyl)-3-aminopropylmethyldimethoxysilane, 3-aminopropylmethyldiethoxysilane and (phenylaminomethyl)methyldimethoxysilane. It is possible to cite N-2-(aminoethyl)-3-aminoisobutyldimethoxysilane, N-ethylaminoisobutylmethyldiethoxysilane and N-methylaminopropylmethyldimethoxysilane.

Further, it is possible to cite vinyltrimethoxysilane, 3-aminopropyltriethoxysilane, N-(2-aminoethyl)-3-aminopropyltrimethoxysilane, methyltrimethoxysilane and 3-glycidxypropyltrimethoxysilane. It is possible to cite 3-methacryloxypropyl-trimethxysilane, 3-chloroprpyltrimethoxysilane, 3-mercaptpropyltrimethoxysilane, etc.

As the resin contained in the under coat layer constituted by the mixture of the resin with the metal oxide, it is possible to cite, e.g., acrylic resin, allyl resin, alkyd resin, ethyl cellulose resin, ethylene-acrylic acid copolymer, epoxy resin, casein resin and silicone resin. It is possible to cite gelatine resin, phenolic resin, urethane resin, butyral resin, polyacrylate resin, polyacetal resin, polyamideimide resin, polyamide resin, polyallyl ether, polyimide resin, polyester resin and polyethylene resin.

Further, it is possible to cite polycarbonate resin, polystyrene resin, polysulfone resin, polyvinyl alcohol resin, polybutadiene resin and polypropylene resin.

Of these, from a viewpoint of suppressing a potential fluctuation under a high-temperature and high-humidity environment, it is preferable that urethane resin which is low in hygroscopicity.

The urethane resin suitably used in the under coat layer constituted by the mixture of the resin and the metal oxide consists of a polymer of a composition of an isocyanate compound or a blocked isocyanate compound with polyol resin.

As the blocked isocyanate compound, it is possible to cite, e.g., blocked compounds of 2,4-tolylenediisocyanate, 2,6-tolylenediisocyanate and diphenylmethane-4,4'-diisocyanate, with a blocking agent. It is possible to cite a blocked compound of 1-isocyanate-3,3,5-trimethyl-5-isocyanatomethylcyclohexane (isophorone diisocyanate, IPDI), with a blocking agent. It is possible to cite blocked compounds of hexamethylenediisocyanate (HDI), HDI-trimethylolpropane adduct, HDI-isocyanurate and HDI-biuret, with a blocking agent.

As the blocking agent for the blocked isocyanate compound, it is possible to cite oxime compounds such as formaldehydeoxime, acetoaldoxime, methylethylketoxime, cyclohexanone oxime, acetone oxime and methylisobutylketoxime. It is possible to cite active methylene compounds such as meldrum&s acid, dimethyl malonate, diethyl malonate, di-n-butyl malonate, ethyl acetate and acetyl acetone.

It is possible to cite amine compounds such as diisopropylamine, diphenylaniline, aniline and carbazole, and imine compounds such as ethyleneimine and polyethyleneimide. It is possible to cite acid imide compounds such as succinimide and maleic imide, and imidazole compounds such as malonate, imidazole, benzimidazole and 2-methylimidazole. It is possible to cite triazole compounds such as 1,2,3-triazole, 1,2,4-triazole, 4-amino-1,2,4-triazole and benzotriazole.

Further, it is possible to cite and amide compounds such as acetonitride, N-methylacetoamide and acetic acid amide; lactam compounds such as ϵ-caprolactam, δ-valerolactam and γ-butyrolactam; and urea compounds such as urea, thiourea and ethylene urea. It is possible to cite sulfite such as sodium bisulfite; mercaptane compounds such as butyl mercaptane and dodecylmercaptane; and phenolic compounds such as phenol and cresol.

Further, it is possible to cite pyrazole compounds such as pyrazole, 3,5-dimethylpyrazole and 3-methylpyrazole, and alcohol compounds such as methanol, ethanol, 2-propanol and n-butanol.

Further, the blocking agent may also be a blocked isocyanate compound in which one or two or more species of these blocking agents are combined. As the polyol resin, it is possible to cite, e.g., polyvinylacetal resin and polyphenolic resin.

A content ratio of the metal oxide particles may preferably be 2:1 to 4:1 (weight ratio) for (metal oxide particle): (resin) from viewpoints of the electrophotographic characteristic and crack suppression.

As a dispersing method, it is possible to cite methods using a homogenizer, a ultrasonic wave dispersion device, a ball mill, a sand mill, a roll mill, an oscillating mill, an attritor and a liquid collision high-speed dispersion device.

In the under coat layer constituted by the mixture of the resin and the metal oxide, e.g., for the purpose of adjusting a surface roughness of the under coat layer or alleviating crack of the under coat layer, organic resin particles and a leveling agent may further be incorporated. As the organic resin particles, it is possible to use hydrophobic organic resin particles such as silicone particles, and hydrophilic organic resin particles such as cross-link polymethyl methacrylate resin (PMMA) particles and the like.

In the under coat layer constituted by the mixture of the resin with the metal oxide, various additions can be incorporated. As the additives, it is possible to cite, e.g., metals such as aluminum powder or copper powder, and an electroconductive substance such as carbon black. It is possible to cite electron transporting substances such as quinone compounds, fluorenon compounds, oxadiazole compounds, diphenoquinone compounds, alizarin compounds, benzophenon compounds, and the like. It is possible to cite electron transporting substances such as polycondensed compounds, azo compounds, and the like. It is possible to cite organic metal compounds such as metal chelate compounds, silane coupling agents, and the like.

A film thickness of the under coat layer constituted by the mixture of the resin with the metal compound may preferably be 0.5 μm or more and 10 μm or less, further preferably be 2 μm or more and 8 μm or less, in the case where the above-mentioned electroconductive layer is provided. In the case where the above-mentioned electroconductive layer is not provided, the film thickness may preferably be 10 μm or more and 40 μm or less, may further preferably be 15 μm or more and 25 μm or less.

In the case where the photosensitive layer is the lamination type photosensitive layer, the charge generating layer can be formed by applying an application liquid, for the charge generating layer, obtained by dispersing the charge generating substance together with a binder resin and a solvent, and by drying this application liquid. The application liquid for the charge generating layer may also be prepared by dispersion of only the charge generating substance in the solvent and thereafter by adding a resin therein, and may also be prepared by adding and dispersing the charge generating substance together with the resin in the solvent. Further, the charge generating layer may also be a deposition film of the charge generating substance.

As the charge generating substance used in the photosensitive layer, it is possible to cite, e.g., azo pigments, phthalocyanine pigments, indigo pigments, perylene pigments, polycyclic quinone pigments, squarylium coloring agents, thiapyrylium salts, triphenylmethane coloring agents and quinacridone pigments. It is possible to cite azulenium salt pigments, cyanine dyes, anthanthrone pigments, pyranthrone pigments, xanthene coloring agents, quinonimine coloring agents, and stylyl dyes.

These charge generating substance may be used only in one species or may also be used in two or more species. Of these, from a viewpoint of sensitivity, oxytitanium phthalocyanines, chloro-galium phthalocyanines and hydroxygalium phthalocyanes are preferable. Further, of the hydroxygalium phthalocyanines, hydroxygalium phthalocyanine crystal in a crystal form having strong peaks at Bragg angles 2θ of 7.4°±0.3° and 28.2°±0.3° in CuKα characteristic X-ray analysis is preferable.

As the binder resin used in the charge generating layer, it is possible to cite, e.g., polycarbonate resin, polyester resin, butyral resin, polyvinyl acetal resin, acrylic resin, vinylacetate resin and urea resin. Of these, butyral resin is preferable. These can be used singly, in mixture or as a copolymer in one or two or more species.

As the dispersing method, it is possible to cite, e.g., methods using the homogenizer, the ultrasonic wave dispersion device, the ball mill, the sand mill, the roll mill and the attritor.

A proportion between the charge generating substance and the binder resin in the charge generating layer may preferably be 0.3 weight part or more and 10 weight parts of the charge generating substance per 1 weight part of the binder resin. In the charge generating layer, as desired, it is also possible to add, e.g., a sensitizer, the leveling agent, the dispersing agent, the antioxidant, the ultraviolet absorber, the plasticizer and the rectifying material. A film thickness of the charge generating layer may preferably be 0.01 μm or more and 5 μm or less, further preferably be 0.1 μm or more and 2 μm or less.

In the case where the pseudo halftone layer is the lamination type photosensitive layer, on the charge generating layer, the charge transporting layer is formed. The charge transporting layer can be formed by applying an application liquid, for the charge transporting layer, obtained by dissolving a charge transporting substance and a binder resin in a solvent, and by drying this application liquid.

As the charge transporting substance used in the photosensitive layer, it is possible to cite, e.g., pyrene compounds, N-alkylcarbonate compounds, hydrazone compounds, N,N-dialkylaniline compounds, diphenylamine compounds and triphenylamine compounds. It is possible to cite triphenylmethane compounds, pyrazoline compounds, stylyl compounds, stilbene compounds and butadiene compounds. These charge transporting substances may be used only in one species and may also be used in two or more. Of these charge transporting substances, from a viewpoint of mobility of charges, the triphenylamine compounds are preferable.

As the binder used in the charge transporting layer, it is possible to cite, e.g., acrylic resin, acrylonitrile resin, allyl resin, alkoxy resin, epoxy resin, silicone resin, phenolic resin, phenoxy resin, polyacrylamide resin and polyamideimide resin. It is possible to cite polyamide resin, polyallyl ether resin, polyallylate resin, polyimide resin, polyurethane resin, polyester resin and polyethylene resin. It is possible to cite polycarbonate resin, polysulfone resin, polyphenylene oxide resin, polybutadiene resin, polypropylene resin and methacrylate resin.

Of these, it is possible to cite insulative resins such as polyallylate resin, polycarbonate, polyvinyl butyral, polyvinyl acetate, polyvinyl pyridine resin, polyvinyl alcohol, polyvinyl pyrolidone, agarose resin, cellulose resin and casein.

These resins can be used singly, in mixture or as a copolymer in one species or two or more species. Further, it is also possible to use organic photoconductive polymers such as poly-N-vinyl carbazole, polyvinyl anthracene and polyvinylpyrene. Further, it is also possible to use a compound obtained as a polymeric charge transporting substance by incorporating a skeleton having a charge transporting function in a main chain or a side chain of these resins.

In the charge transporting layer, as desired, it is possible to add, e.g., the antioxidant, the ultraviolet absorber, the plasticizer and the leveling agent.

A proportion between the charge transporting substance and the binder resin in the charge transporting layer may preferably be 0.3 weight part or more and 10 weight parts or less of the charge transporting substance per 1 part of the binder resin.

In the case where the charge transporting layer is a single layer, a film thickness of the charge transporting layer may preferably be 5 μm or more and 40 μm or less, further preferably be 8 μm or more and 30 μm or less. In the case where the charge transporting layer has a lamination constitution, a film thickness of the charge transporting layer in the supporting member side may preferably be 5 μm or more and 30 μm or less, and a film thickness of the charge transporting layer in the surface side may preferably be 1 μm or more and 10 μm or less.

In this embodiment, in the case where the charge transporting layer is a surface layer of the electrophotographic photosensitive member, from a viewpoint of improving a durability of the electrophotographic photosensitive member, it is preferable that the charge transporting layer is constituted by a resin excellent in anti-wearing property.

For the purpose of improving the anti-wearing property of the electrophotographic photosensitive member and of improving a cleaning property, a protective layer may also be formed as a surface layer on the photosensitive layer or the charge transporting layer. The protective layer can be formed by forming an application film of an application liquid, for the protective layer, obtained by dissolving a resin (binder resin) excellent in anti-wearing property in a solvent, and by drying the application film.

As the resin used in the protective layer, it is possible to cite, e.g., polyvinylbutyral resin, polyester resin, polycarbonate resin, polyamide resin, polyimide resin and polyallylate resin. It is possible to cite polyurethane resin, phenolic resin, styrene-butadiene copolymer, styrene-acrylic acid copolymer and styrene-acrylonitrile copolymer.

Further, with respect to the protective layer, the protective layer may also be formed by forming an application film of an application liquid, for the protective layer, obtained by dissolving a polymerizable monomer or oligomer in a solvent, and by curing (polymerizing) the application film by using cross-linking or polymerization reaction. As the polymerizable monomer or oligomer, it is possible to cite, e.g., compounds having chain-polymerizable functional groups such as acryloyloxy group or styryl group, and compounds having step-reaction-polymerizable functional groups such as hydroxyl group, alkoxysilyl group, isocyanate group and epoxy group.

As a reaction for curing the monomer or the oligomer, it is possible to cite, e.g., radical polymerization ion polymerization, heat polymerization, photopolymerization, radiation polymerization (electron beam polymerization), plasma CVD method and photo-CVD method.

Further, a characteristic required for the protective layer is compatibility between film strength and charge transporting power, and therefore in the application liquid for the protective layer, the electroconductive particles and the charge transporting substance may also be added. As the electroconductive particles, it is possible to use the electroconductive pigments used in the above-mentioned electroconductive layer. As the charge transporting substance, it is possible to use the above-described charge transporting substance.

Further, from the viewpoint of the compatibility between the film strength and the charge transporting power, it is further preferable that a compound having both of a charge transporting structure (preferably a positive hole transporting structure) and a polymerizable functional group in the same molecule is used. From a viewpoint of maintaining the electrophotographic characteristic, as the polymerizable functional group, the acryloyloxy group is preferable. Further, from the viewpoint of improving the anti-wearing property, a compound having two or more polymerizable functional groups in the same molecule is preferable. Further, the compound having the charge transporting structure and the polymerizable functional group and the above-described charge transporting material, binder resin and polymerizable monomer or oligomer may also be mixed and used.

Further, in the surface layer (charge transporting layer or protective layer) of the electrophotographic photosensitive member, a filler can be added in order to improve the durability. As the filler, it is possible to cite organic resin particles such as acrylic resin particles and inorganic particles such as alumina, silica and titania.

Further, for the purpose of improving various functions, an additive can also be added. As the additive, it is possible to cite, e.g., the electroconductive particles, the anti-oxidant, the ultraviolet absorber, the plasticizer and the leveling agent.

In the case where the protective layer has the charge transporting power, on the charge generating layer, the protective layer also functioning as a single charge transporting layer may also be provided as the surface layer.

A film thickness of the protective layer may preferably be 0.1 μm member and 30 μm or less, further preferably be 1-10 μm.

In the case where the photosensitive layer is the single layer type photosensitive layer, with respect to the photosensitive layer, an application liquid, for the single layer type photosensitive layer, obtained by dissolving the above-mentioned charge generating substance, the charge transporting substance and one or two or more species of the group of the binder resins used for the charge generating layer, the charge transporting layer and the protective layer, in a solvent is applied. Then, by drying this application liquid, the photosensitive layer can be formed.

The polymerizable monomer or oligomer is used as the binder resin and may also be, after being dissolved in a solvent and applied, crosslinked or polymerized. As desired, e.g., the anti-oxidant, the ultraviolet absorber, the plasticizer, the leveling agent, an electron transporting substance or the filler may also be added.

As the solvent used in the application liquids for the respective layers of the above-described single layer type photosensitive layer or the lamination type photosensitive layer, it is possible to cite, e.g., alcohol solvents, sulfoxide solvents, ketone solvents, ether solvents, ester solvents, halogenated hydrocarbon solvents and aromatic solvents.

Specifically, it is possible to cite, e.g., water, methanol, ethanol, n-propanol, isopropanol, butanol, methyl cellosolve, methoxypropanol, dimethylformamide, dimethylacetoamide and dimethylsulfoxide. It is possible to cite acetone, methyl ethyl ketone, cyclohexanone, diethyl ether, dipropyl ether, propylene glycol monomethyl ether, dioxane, methyral and tetrahydrofuran.

Further, it is possible to cite method acetate, ethyl acetate, propyl acetate, methyl formate, ethyl formate, chlorobenzene, dichloromethane, chloroform, trichloroethylene, tetrachloroethylene, carbon tetrachloride, benzene, toluene, xylene and tetralin. These solvents can be used in single species or in mixture of two or more species.

As a method of applying the application liquid for each of the above-mentioned respective layers, it is possible to use, e.g., a dip application method (dip coating method), a spray coating method and a spinner coating method. Further, it is possible to use an application method such as a roller coating method, a Mayer bar coating method and a blade coating method.

<Constitution of Electrophotographic Photosensitive Member>

Figure 5:
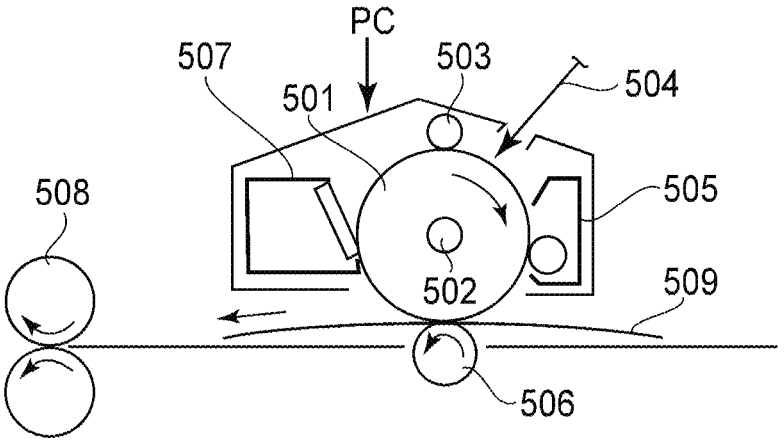
FIG. 5 is an illustration showing an example of the electrophotographic photosensitive member.

An example of an image forming apparatus of an electrophotographic type according to the present invention is shown in FIG. 5. In FIG. 5, a cylindrical electrophotographic photosensitive member 501 is rotationally driven about a shaft 502 in an arrow direction at a predetermined peripheral speed (process speed). Around the electrophotographic photosensitive member 501, an image forming portion for forming an electrostatic latent image on a surface of the electrophotographic photosensitive member 501 is disposed.

Specifically, along a rotational direction of the photosensitive member 501, a charging means (primary charging means) 503 and an exposure means (image exposure means) are disposed. When specifically described, the photosensitive member 501 is electrically charged uniformly to a predetermined potential (negative polarity in this embodiment) by a charging roller functioning as the charging means, and thereafter receives laser (image exposure light) 504 emitted from a laser optical system functioning as the exposure means on the basis of image information of an original. In this way, on a surface of the electrophotographic photosensitive member 501, an electrostatic latent image corresponding to objective image information is formed.

In this embodiment, in the case where the charging means using electric discharge is used, an effect is particularly large. The electrostatic latent image formed on the surface of the electrophotographic photosensitive member 501 is then developed (reversal development in this embodiment) with a toner (irregular toner or spherical toner) having a negative charge characteristic in a developing means 505, so that a toner image is formed. At this time, a particle size of the toner may preferably be 3-10 μm.

The toner image formed on the surface of the electrophotographic photosensitive member 501 is transferred onto a transfer material by a transfer bias from a transfer means (transfer roller in this embodiment) 506. At this time, the transfer material (sheet, recording material) 509 is taken out and fed from a transfer material feeding means (not shown) to between (contact portion) the electrophotographic photosensitive member 501 and a transfer means 506 in synchronism with rotation of the electrophotographic photosensitive member 501. At this time, from a viewpoint of improving a transfer property, a speed difference may also be provided between the rotation of the electrophotographic photosensitive member 501 and a moving speed of the transfer means.

Further, to the transfer means, a bias voltage of an opposite polarity to that of electric charges possessed by the toner is applied from a bias power source (not shown). Further, the transfer means 506 may also have a two-stage constitution consisting of primary transfer for transferring the toner image from the electrophotographic photosensitive member 501 onto an intermediary transfer member (not shown) and secondary transfer for transferring the toner image from the intermediary transfer member (not shown) onto the transfer material 509 in order to form an image of a secondary color or more.

The transfer material 509 on which the toner image is transferred separated from the surface of the electrophotographic photosensitive member 501 and is fed to a fixing means 508 to be subjected to toner image fixing, so that the transfer material 509 is printed out as an image-formed product (print, copy) to an outside of the electrophotographic photosensitive member 501.

The surface of the electrophotographic photosensitive member 501 after the toner image transfer is subjected to removal of a deposited matter such as a transfer residual toner by a cleaning means 507 including a cleaning member (blade counterdirectionally-contacted to the photosensitive member in this embodiment) disposed in contact with (contacted to) the surface of the electrophotographic photosensitive member 501, thus being cleaned. Further, the surface of the electrophotographic photosensitive member 501 is charge-removed by pre-exposure light (not shown) from a pre-exposure means (not shown), and thereafter is repetitively used for image formation. Incidentally, the pre-exposure is not necessarily required.

Of constituent elements selected from image forming process devices such as the electrophotographic photosensitive member 501, the charging means 503, the developing means 505 and the cleaning means 507, a plurality of the constituent elements may also be constituted by being accommodated in a container and by integrally connecting the elements as a process cartridge (cartridge) PC. Further, this process cartridge PC can be constituted so as to be detachably mountable to an apparatus main assembly of the electrophotographic apparatus such as a copying machine or a laser beam printer.

That is, at least the electrophotographic photosensitive member 501 and the cleaning means 507 including the cleaning member disposed in contact with the electrophotographic photosensitive member 501 are integrally supported and are constituted as the process cartridge PC detachably mountable to the electrophotographic apparatus main assembly. Further, the resultant apparatus can be constituted as an electrophotographic apparatus which includes this process cartridge PC and which uses at least the process of the pseudo halftone formed by the dots as a method of representing gradation.

The exposure light 504 is reflected light from the original or transmitted light in the case where the electrophotographic apparatus is the copying machine or the printer. Or, the exposure light 504 is light emitted by, e.g., laser beam scanning or drive of an LED array or a liquid crystal shutter array, performed by reading the original with a sensor or converting electronic data generated by an information device such as a personal computer into a signal and in accordance with this signal. The image forming apparatus (electrophotographic apparatus) in this embodiment uses the process of the pseudo halftone formed by at least the dots as the method of representing the gradation during the conversion to the signal.

Figure 6:
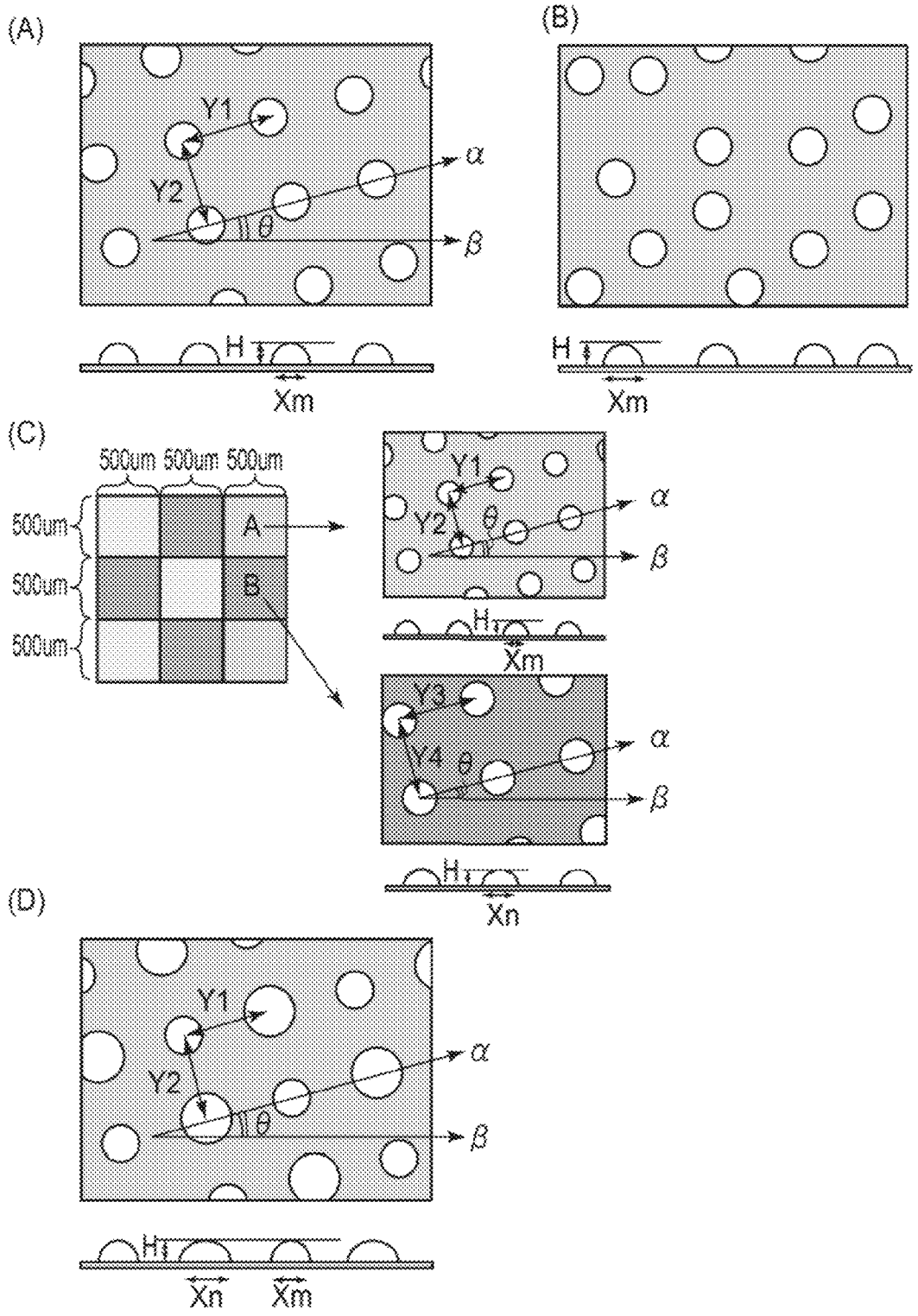
In FIG. 6, (A)-(D) are illustrations showing a mold used in Manufacturing Embodiments of the electrophotographic photosensitive member.

The electrophotographic image forming apparatus according to the present invention can generate the process of the pseudo halftone formed by the dots using dither matrix during the conversion to the signal. FIG. 6 is an example of a dot concentration type dither matrix. When this dither matrix is used, 256 gradation levels can be represented by a dot pattern of 1200 dpi, 160 lpi and 45 degrees. Specifically, multi-value image data represented by inputted values of 0-255 and a numerical value (threshold) in the dither matrix are compared, and is converted to a binary image by being converted so that the multi-level image data is replaced with black (printed) if it is lager than the threshold and is replaced with white (not printed) if it is smaller than the threshold.

With respect to the resolution used in the electrophotographic apparatus in recent years, 6000 dpi-2400 dpi go mainstream. Incidentally, the line number is 106-212 lpi in many cases. Further, black is high in luminosity factor, and therefore a screen angle is set in many cases at 45 degrees where the luminosity factor lowers angular. In this embodiment, the AM screening pattern was used as the pseudo halftone and square patterns (angle between adjacent dots: 90 degrees), with the line number of 106 lpi and 45 degrees and with the line number of 212 lpi and 45 degrees, capable of forming the pattern even at 600 dpi were used.

Incidentally, in the case where the image forming apparatus is of a so-called tandem type in which an image forming station including the member and the image forming portion is provided for each of colors, the constitution in this embodiment may only be required to be employed in at least one of the image forming stations. For example, in the image forming apparatus of the tandem type, the image forming apparatus may also be an image forming apparatus in which a heater is provided in the pseudo halftone in the image forming station for forming a black image and in which the constitution in this embodiment is not employed in this image forming station and is employed in image forming stations for forming toner images of other colors.

EMBODIMENTS

In the following, the present invention will be described more specifically by citing specific embodiments. Incidentally, "part(s)" in Embodiments means "weight part(s)". Further, the electrophotographic photosensitive member is also referred simply to as a "photosensitive member". Further, in all the following embodiments, a shape of an opening of each of recessed portions formed on the surface of the electrophotographic photosensitive member is a circular shape in which a longest diameter of the opening and a shortest diameter of the opening are substantially equal to each other.

(Manufacturing Embodiment of Photosensitive Member A Before Recessed Portion Formation)

An aluminum cylinder of 30.52 mm in diameter and 370 mm in length was used as a supporting member (cylindrical supporting member).

Next, 100 parts of zinc oxide particles (specific surface area: 19 $m^2/g$, powder resistance: $4.7\times10^6$ Ω·cm) as a metal oxide was stirred and mixed with 500 parts of toluene. Into this, 0.8 part of a silane coupling agent (compound name: N-2-(aminoethyl)-3-aminopropylmethyldimethoxysilane, trade name: KBM 602, manufactured by Shin-Etsu Chemical Co., Ltd.) was added, and was stirred 6 hours. Thereafter, toluene was distilled away under reduced pressure and was heated and dried at 130° C. for 6 hours, so that surface-treated zinc oxide particles were obtained.

Next, 15 parts of butyral resin trade name: BM-1, manufactured by Sekisui Chemical Co., Ltd.) as a polyol resin and 150 parts of blocked isocyanate (trade name: Sumidur 3175, manufactured by Sumitomo Bayer Urethane Co., Ltd.) were dissolved in a mixture solution. The mixture solution is a mixture of 73.5 parts of methyl ethyl ketone and 73.5 parts of 1-butanol.

In this solution, 80.8 parts of the surface-treated zinc oxide particles and 0.8 part of 2,3,4-trihydroxybenzophenon (manufactured by Tokyo Chemical Industry Co., Ltd.) were added, and this was dispersed for 3 hours in an atmosphere of 23±3° C. in a sand mill device using glass heads of 0.8 mm in diameter. After the dispersion, the following two substances were added and stirred, so that an application liquid for an under coat layer was prepared.

Silicone oil (trade name: SH28PA, manufactured by Dow Corning Toray Co., Ltd.) . . . 0.1 part Cross-linked polymethyl methacrylate (PMMA) particles (trade name: TECHPOLYMER SSX-102, manufactured by Sekisui Chemical Co., Ltd. average primary particle size: 2.5 μm) . . . 5.6 parts This application liquid for the undercoat layer was dip-coated on the above-mentioned supporting member, and a resultant application film was dried for 40 minutes at 160° C., so that the under coat layer of 18 μm in film thickness was formed.

Next, the following 4 substances were placed in a sand mill using glass beads of 1 mm in diameter and was dispersed for 4 hours, and thereafter 700 parts of ethyl acetate was added, so that an application liquid for a charge generating layer was prepared.

| | |
|---|---|
| Hydroxygalium phthalocyanine crystal having crystal form having strong peaks at 7.4° and 28.2° in Bragg angles 2θ ± 0.2° in CuKα characteristic X-ray analysis (charge generating substance) | 20 parts |
| Carixarene compound represented by the following structural formula (A) | 0.2 part |

(A)

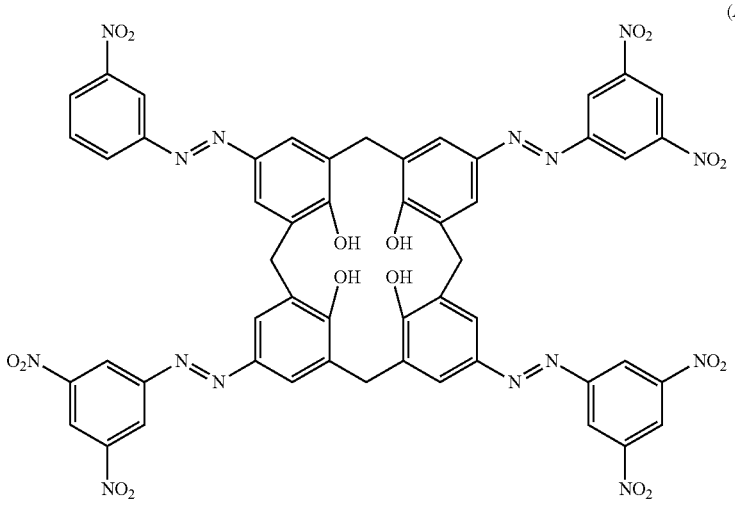

| | |
|---|---|
| Polyvinyl butyral (trade name: S-LEC BX-1, manufactured by Sekisui Chemical Co., Ltd.) | 10 parts |
| Cyclohexane | 600 parts |

This application liquid for the charge generating layer was dip-coated on the under coat layer, and a resultant application film was dried for 15 minutes at 80° C., so that the charge generating layer of 0.17 μm in film thickness was formed.

Next, the following 5 substances was dissolved in a mixture solvent of 600 parts of mixed xylene and 200 parts of dimethoxy methane, whereby an application liquid for a charge transporting layer was prepared.

| | |
|---|---|
| Compound represented by the following structural formula (B) (charge transporting substance) | 30 parts |
| Compound represented by the following structural formula (C) (charge transporting substance) | 60 parts |
| Compound represented by the following structural formula (D) | 10 parts |
| Polycarbonate resin (trade name: Iupilon Z400, manufactured by Mitsubishi Engineering -Plastics Corp., bisphenol-Z-polycarbonate) | 100 parts |

-continued

| | |
|---|---|
| Polycarbonate represented by the following structural formula (E) (viscosity-average molecular weight Mv: 20000) | 0.02 part |

(B)

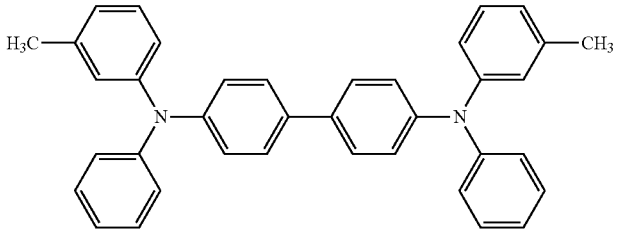

(C)

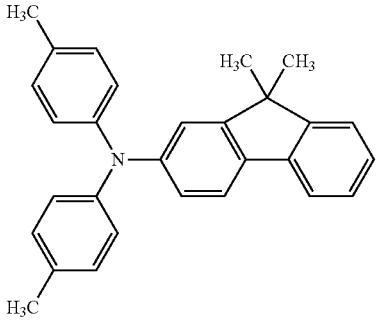

(D)

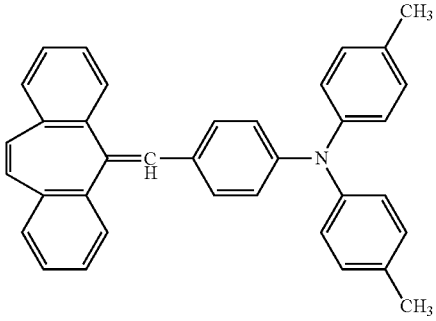

(E)

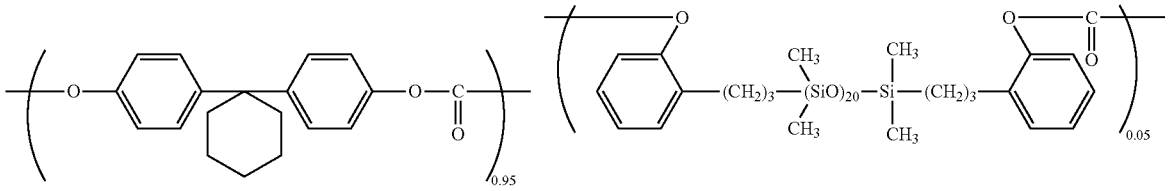

This application liquid for the charge transporting layer was dip-coated no the charge generating layer, and a resultant application liquid was dried for 30 minutes at 115° C., whereby the charge generating layer was formed.

Next, a mixture solvent of 20 parts of 1,1,2,2,3,3,4-heptafluorocyclopentane (trade name: ZEOROLA H, manufactured by Zeon Corp.)/20 parts of 1-propanol was filtered with polyflon filter (trade name: PF-040, manufactured by Advantec Toyo Kaisha, Ltd.). To this mixture solvent, the following 3 substances were added. This mixture was filtered with the polyflon filter (trade name: PF-020, manufactured by Advantec Toyo Kaisha, Ltd.), whereby an application liquid for a second charge transporting layer (protective layer) was prepared.

| | |
|---|---|
| Positive hole transporting compound represented by the following structure formula (F) | 90 parts |

(F)

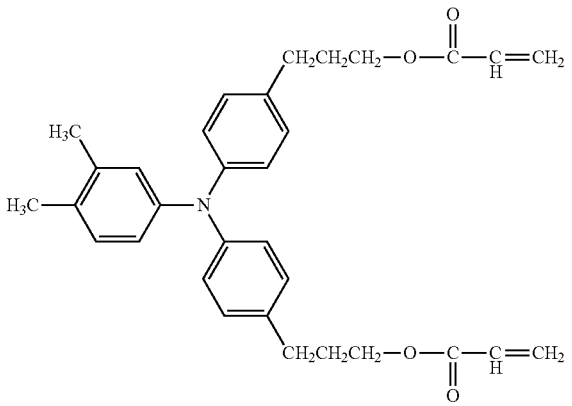

| | |
|---|---|
| 1,1,2,2,3,3,4-heptafluorocyclopentane | 70 parts |
| 1-propanol | 70 parts |

This application liquid for the second charge transporting layer was dip-coated on the charge transporting layer, and a resultant application film was dried for 6 minutes at 50° C. in ambient air. Thereafter, in nitrogen, while rotating the supporting member (member to be irradiated) at 200 rμm, the application film was irradiated with electron beam for 1.6 sec under a condition of acceleration voltage of 70 kV and absorbed dose of 8000 Gy.

Subsequently, in nitrogen, the application film was heated by increasing a temperature from 25° C. to 125° C. in 30 sec. Ambient oxygen concentration during the electron beam irradiation and subsequent heating was 15 ppm. Next, in the ambient air, heating was made for 30 minutes at 100° C., whereby the Second charge transporting layer (protective layer) of 5 μm in film thickness was prepared.

In the above-described manner, a photosensitive member A which is the electrophotographic photosensitive member before formation of recessed portions on the surface was prepared.

Surface observation of the photosensitive member A was performed, so that a depth of specific recessed portions, a longest diameter and area of openings, an area of a flat portion and arrangement of the recessed portions were obtained. Subsequently, calculation of an image quality lowering index (f) was made with respect to SCR1 and SCR2 described later. A result is shown in Table 2.

(Manufacturing Embodiment of Photosensitive Member B Before Recessed Portion Formation)

A photosensitive member B which is the electrophotographic photosensitive member before formation of the recessed portions on the surface was prepared similarly as in Manufacturing Embodiment of the photosensitive member A except that an aluminum cylinder of 84 mm in diameter and 370 mm in length was used as the supporting member (cylindrical supporting member).

Surface observation of the photosensitive member B was performed, so that a depth of specific recessed portions, a longest diameter and area of openings, an area of a flat portion and arrangement of the recessed portions were obtained. Subsequently, calculation of an image quality lowering index (f) was made with respect to SCR1 and SCR2 described later. A result is shown in Table 2.

(Manufacturing Embodiment of Photosensitive Member C Before Recessed Portion Formation)

Similarly as in Manufacturing Embodiment of the photosensitive member A, the electroconductive layer, the under coat layer, the charge generating layer and the charge transporting layers were formed on the supporting member. Next, a lubricant dispersion was obtained in the following procedure.

0.5 part of a fluorine (atom)-containing resin (trade name: GF-300, manufactured by Toagosei Co., Ltd.) was dissolved in the following mixture solvent.

| | |
|---|---|
| 1,1,2,2,3,3,4-heptafluorocyclopentane (trade name: ZEOROLA H, manufactured by Zeon Corp.) | 30 parts |
| 1-propanol | 30 parts |

In this, 10 parts of polytetrafluoroethylene (trade name: LUBRON L-2, manufactured by Daikin Industries, Ltd.) was added. This mixture was placed in a high-pressure dispersing device (trade name: Microfluidizer M-110EH, manufactured by Microfluidics Corp.) and was dispersed four times at a pressure of 600 kgf/cm$^2$. This dispersion was filtered with the polyolefin filter (trade name: PF-040, manufactured by Advantec Toyo Kaisha, Ltd.), whereby a lubricant dispersion was obtained.

Thereafter, 90 parts of a positive hole transporting compound represented by the above-mentioned structural formula (F), 70 parts of 1,1,2,2,3,3,4-heptafluorocyclopentane and 70 parts of 1-propanol were added to the above lubricant dispersion. This dispersion was filtered with the polyflon filter (trade name: PF-020, manufactured by Advantec Toyo Kaisha, Ltd.), whereby an application liquid for a second charge transporting layer (protective layer) was prepared.

This application liquid for the second charge transporting layer was dip-coated on the charge transporting layer, and a resultant application film was dried for 6 minutes at 50° C. in ambient air. Thereafter, in nitrogen, while rotating the supporting member (member to be irradiated) at 200 rμm, the application film was irradiated with electron beam for 1.6 sec under a condition of acceleration voltage of 70 kV and absorbed dose of 8000 Gy.

Subsequently, in nitrogen, the application film was heated by increasing a temperature from 25° C. to 125° C. in 30 sec. Ambient oxygen concentration during the electron beam irradiation and subsequent heating was 15 ppm. Next, in the ambient air, heating was made for 30 minutes at 100° C., whereby the Second charge transporting layer (protective layer) of 5 μm in film thickness was prepared.

In the above-described manner, a photosensitive member C which is the electrophotographic photosensitive member before formation of recessed portions on the surface was prepared. Surface observation of the photosensitive member C was performed, so that a depth of specific recessed portions, a longest diameter and area of openings, an area of a flat portion and arrangement of the recessed portions were obtained. Subsequently, calculation of an image quality lowering index (f) was made with respect to SCR1 and SCR2 described later. A result is shown in Table 2.

(Manufacturing Embodiment of Photosensitive Member D Before Recessed Portion Formation)

Similarly as in Manufacturing Embodiment of the photosensitive member A, the electroconductive layer, the under coat layer, the charge generating layer and the charge transporting layers were formed on the supporting member.

Next, an application liquid for a second charge transporting layer (protective layer) was prepared in the following procedure.

The following mixture was placed in the high-pressure dispersing device (trade name: Microfluidizer M-110EH, manufactured by Microfluidics Corp.) and was dispersed three times at a pressure of 600 kgf/cm$^2$.

| | |
|---|---|
| Alumina particles (average particle size: 0.1 μm, trade name: LS-231, manufactured by Nippon Light Metal Co., Ltd.) | 10 parts |
| Chlorobenzene | 90 parts |

Further, this dispersed mixture liquid was fitted with the polyflon filter (trade name: PF-040, manufactured by Advantec Toyo Kaisha, Ltd.), so that a dispersion was prepared.

The application liquid for the second charge transporting layer (protective layer) was prepared by mixing:

| | |
|---|---|
| Compound having the structure represented by the above-described structure formula (C) | 70 parts |
| Polycarbonate (trade name: Iupilon Z400, manufactured by Mitsubishi Engineering-Plastics Corp.) | 100 parts |
| Dispersion described above | 200 parts |
| Monochlorobenzene | 400 parts |
| Dimethoxymethane | 200 parts |

This application liquid for the second charge transporting layer was spray-coated on the charge transporting layer, and a resultant application film was dried for 20 minutes at 130° C., whereby the second charge transporting layer (protective layer) of 5 μm in film thickness was prepared.

In the above-described manner, a photosensitive member D which is the electrophotographic photosensitive member before formation of recessed portions on the surface was prepared. Surface observation of the photosensitive member D was performed, so that a depth of specific recessed portions, a longest diameter and area of openings, an area of a flat portion and arrangement of the recessed portions were obtained. Subsequently, calculation of an image quality lowering index (f) was made with respect to SCR1 and SCR2 described later. A result is shown in Table 2.

(Manufacturing Embodiment of Photosensitive Member E Before Recessed Portion Formation)

Similarly as in Manufacturing Embodiment of the photosensitive member A before the recessed portion formation, the electroconductive layer, the under coat layer, the charge generating layer and the charge transporting layers were formed on the supporting member. Next, an application liquid for a second charge transporting layer (protective layer) was prepared by dissolving the following substances in 0.9 part of 1-methoxy-2-propanol.

| | |
|---|---|
| Acrylpolyol (trade name: JONCRYL-587, manufactured by Johonson Polymers Corp.) | 1.5 parts |
| Melamin resin (trade name: CYMEL-303, manufactured by Cytec Industries Inc.) | 2.1 parts |
| N,N,N',N'-tetrakis-[(4-hydroxymethyl)phenyl]-biphenyl-4,4'-diamine (THM-TBD) as charge transporting component | 1.16 parts |
| N,N'-diphenyl-N,N'-di(3-hydroxyphenyl)-terphenyldiamine (DHTER) as charge transporting component | 1.93 parts |
| Acid catalysis (trade name: Nacure 5225, manufactured by King Chemical Industries, Inc.) | 0.05 part |

This application liquid for the second charge transporting layer was dis-coated on the charge transporting layer and was thermally cured for 40 minutes at 140° C., whereby the second charge transporting layer (protective layer) of 6 μm in film thickness was prepared.

With respect to the photosensitive member E. Surface observation was performed in the above-mentioned method, so that a depth of specific recessed portions, a longest diameter and area of openings, an area of a flat portion and arrangement of the recessed portions were obtained. Subsequently, calculation of an image quality lowering index (f) was made with respect to SCR1 and SCR2 described later. A result is shown in Table 2.

TABLE 2

| | Surface of EPM | | | | IQLI (f) | |
|---|---|---|---|---|---|---|
| EPM | SRPOLD (μm) | SRPD (μm) | SRPA (μm$^2$) | FPA (μm$^2$) | SCR1 106 dpi | SCR2 212 dpi |
| PM A | — | — | 0 | 250000 | 0.0% | 0.0% |
| PM B | — | — | 0 | 250000 | 0.0% | 0.0% |
| PM C | — | — | 0 | 250000 | 0.0% | 0.0% |
| PM D | — | — | 0 | 250000 | 0.0% | 0.0% |
| PM E | — | — | 0 | 250000 | 0.0% | 0.0% |

"EPM" is the electrophotographic photosensitive member.

"PM" is the photosensitive member.

"SRPOLD" is the specific recessed portion opening longest diameter.

"SRPD" is the specific recessed portion depth.

"SRPA" is the specific recessed portion area.

"FPA" is the flat portion area.

"IQLI" is the image quality lowering index.

(Recessed Portion Formation by Mold Press-Contact Shape Transfer)

In a press-contact shape transfer processing device having a structure roughly shown in FIG. 4, a mold having a projected shape was provided and surface processing was performed with respect to the electrophotographic photosensitive member.

The mold having the projected shape is shown in FIG. 6. In this embodiment, a mold with a regular arrangement shown in (A) of FIG. 6 and a mold with an irregular arrangement shown in (B) of FIG. 6 were used. In FIG. 6, Xm is a longest diameter (longest diameter when the projected portions on the mold is viewed from above, the same applies hereinafter) of the projected portions, θ is a slope with respect to a main scan direction (horizontal direction in FIG. 6) of the exposure light in a square arrangement, and H shows a height of the projected portions. Preparation of the molds was made in the following manner.

First, arrangement of the projected portions was designed. In the following description of arrangement design, an area and an area ratio are the area and the area ratio when the projected portions on the mold are viewed from above.

In FIG. 6, (A) is the square arrangement in which Y1 and Y2 have an equal interval. In design of the square arrangement, a conversion method from a gray scale to monochromatic 2 gradation levels (halftone screen) in "Photoshop" of Adobe Systems Inc. was used.

First, a grayscale with a density corresponding to an area ratio of the projected portions intended to be designed is prepared. For example, in the case where the area ratio of the projected portions is intended to be 20%, the grayscale of 20% in density is prepared. Next, by the conversion to the monochromatic 2 gradation levels, a dot shape was made circular, and line numbers (distances of Y1 and Y2) and the angle θ which are calculated from the longest diameter Xm and the area ratio which are intended to be designed were set, and the grayscale was converted to the halftone screen. In the case where the resolution is insufficient, coordinates were extracted from the resultant halftone screen, and the projected portions having the longest diameter Xm were re-arranged. In the above-described manner, the square arrangement was prepared.

In FIG. 6, (B) is an irregular arrangement by the above-mentioned Floyd-Steinberg method. First, a grayscale with a density corresponding to an area ratio of the projected portions intended to be designed is prepared. Next, a square having the same area as an area of one of the projected portions having the longest diameter Xm was set as a unit pixel, and a threshold was used as the density of the gray-scale, so that an irregular pattern binarized using a dispersion (distribution) rule shown in (a) of FIG. 14 was formed. At this time, arithmetic processing was started after only a first pixel was set to have a density of a 255 gradation level. Next, in the binarized irregular pattern, the projected portions having the longest diameter Xm were disposed at pixels corresponding to the pattern, so that the irregular arrangement was prepared.

In FIG. 6, (c) is a square arrangement like a checker mark in which a square arrangement region A in which Y1 and Y2 have the equal interval and a square arrangement region B in which Y3 and Y4 have an equal interval are alternately arranged every 500 μm-square. Design of Xm in the region A and Xn in the region B and design of Y1 (Y2) in the region A and Y3 (Y4) in the region B were made with different sizes, respectively.

In FIG. 6, (D) is a square arrangement in which after the square arrangement of (A) of FIG. 6 is made, Xm are alternately replaced with Xn to alternate the longest diameters.

Electronic data in which a height H of the projected portions was added to the projected portion arrangement designed as described above were prepared. A three-dimensional shape of the projected portions can be arbitrarily selected, but in this embodiment, a circular dome shape was employed. A resist was irradiated with light on the basis of the prepared electronic data, so that the projected shape was prepared, and a mold in which the projected shape was reversed was prepared and subsequently electroforming with nickel was made, whereby a nickel-made mold having the projected shape was prepared.

In the above method, Xm, Yn, Y1(Y2), Y3(Y4), H and θ were changed, so that various molds were prepared.

During the surface processing, temperatures of the electrophotographic photosensitive member and the mold are controlled so that the temperature of the surface of the electrophotographic photosensitive member is a predetermined temperature, and the electrophotographic photosensitive member is rotated in a circumferential direction while pressing the electrophotographic photosensitive member and a pressing member against each other at a desired pressure. By this, the recessed portions were formed on an entirety of the surface (peripheral surface) of the electrophotographic photosensitive member. In the above-mentioned manner, the electrophotographic photosensitive member including the recessed portions on the surface was prepared.

(Observation of Surface of Electrophotographic Photosensitive Member)

The surface of the electrophotographic photosensitive member including the recessed portions on the surface was observed through the laser microscope (manufactured by Keyence Corp., trade name: VK-9500) in an enlarged manner using a lens with a magnification of 10 to 50, so that discrimination of the specific recessed portions and the flat portion which were provided on the surface of the electrophotographic photosensitive member as described above was made.

During the observation, adjustment was made so that there was no inclination with respect to a longitudinal direction of the electrophotographic photosensitive member and so that the lens was focused on a vertex of the arc of the electrophotographic photosensitive member with respect to the circumferential direction. A square region of 500 μm×500 μm was obtained by connecting images observed in the enlarged manner with an image connecting application. Further, an obtained result was subjected to filter processing with a filter type median by selecting image processing height data with an attached image analysis software. By the above observation, the depth of the specific recessed portion, the longest diameter and the area of the opening, and the area of the flat portion, and the arrangement of the recessed portions were obtained.

Incidentally, the surface of the electrophotographic photosensitive member including the recessed portions on the surface was observed in the same manner as that described above using another laser microscope (manufactured by Keyence Corp., trade name: X-200). Also in this case, an effect similar to that in the case where the above-mentioned laser microscope (manufactured by Keyence Corp., trade name: VK-9500) was used. In the following embodiments, for observation of the electrophotographic photosensitive member including the recessed portions on the surface, the laser microscope (manufactured by Keyence Corp., trade name: VK-9500) and a 50-power lens were used.

(Calculation of Image Quality Lowering Index)

With respect to the electrophotographic photosensitive member including the recessed portions on the surface, between through a CCD camera was made by GX-700 manufactured by Revox Inc., so that photographic data in a square region with a side of 10.84 mm was obtained. An obtained image was subjected to binarization, so that coordinates of the recessed portion arrangement were obtained. Next, the opening shape of the specific recessed portions obtained by the laser microscope observation was reflected in the coordinates of the recessed portion arrangement, so that an arrangement (A) of a plurality of the recessed portions was obtained.

Incidentally, observation of the mold was made using the above-mentioned laser microscope, and in the case where an outer peripheral shape of the projected portions of the mold and an opening shape of the specific recessed portions observed in advance were coincide with each other, the electronic data of the projected portion arrangement used when the mold was prepared were used as the arrangement (A) of the plurality of the recessed portions.

As screen patterns (B), the following two patterns were prepared using the conversion method from the grayscale to the monochromatic 2 gradation levels (halftone screen) with "Photoshop" of Adobe Systems Inc.

Square arrangement screen pattern 1 (SCR1) in which a dot shape is a circular shape, and line number: 106 lpi, angle: 45° and print ratio: 40%

Square arrangement screen pattern 2 (SCR2) in which a dot shape is a circular shape, and line number: 212 lpi, angle: 45° and print ratio: 40%

The arrangement (A) of the plurality of the recessed portions and the screen patterns (B) which are obtained above were used, and calculation of the image quality lowering index was made in accordance with the above-described calculating method. In preparation of an image (C), "Photoshop" of Adobe Systems Inc. In particle analysis, a particle analysis software manufactured by Keyence Corp. ((GRADING ANALYSIS) VH-H1G1) was used.

(Image Quality Evaluation 1)

The electrophotographic photosensitive member including the recessed portions on the surface was mounted in a cyan station of a modified machine of an electrophotographic apparatus (copying machine) manufactured by Canon Inc. (trade name: iR-ADV C7065), and evaluation was made in the following manner.

First, in an environment of 23° C./50% RH, conditions of a charging device, an image exposure device and a developing device were set so that a dark-portion potential (Vd) of the electrophotographic photosensitive member is −700 V, a light-portion potential (Vl) is −200 V, and a developing potential is −540 V.

A dither matrix set for cyan in the electrophotographic apparatus was changed to a dither matrix of 106 lpi in line number, 45° in angle and 1200 dpi in resolution.

In "Photoshop" of Adobe Systems Inc., a grayscale of 40% in density was prepared in A4 size. Output was made via a printer driver, a halftone 1 (HT1) constituted by the screen pattern 1 (SCR1) of 212 lpi in line number, 45° in angle and 40% in print ratio was obtained. With respect to the obtained halftone 1 (HT1), ranking by eye observation similar to that in image quality evaluation 1 was made.

With respect to the halftone 1 (HT1), the ranking by eye observation was made by being compared with a boundary sample. The boundary sample was set by comparison of halftones with no image quality lowering with a plurality of halftone images different in degree of an image quality outputted using the electrophotographic photosensitive member including the recessed portions on the surface when 20 persons of developers of the electrophotographic apparatus served as test subjects. The contents of the boundary sample are shown below.

A: Image discriminated as no image quality lowering by all the test subjects.

B: Image for which discrimination as too whether or not roughness is lowered differs depending on the test subjects.

C: Image for which discrimination as to whether or not the moire is lowered differs depending on the test subjects.

D: Image best in degree of images discriminated as being lowered in roughness by all the test subjects.

E: Image best degree of images discriminated as being lowered in moire by all the test subjects.

(Image Quality Evaluation 2)

The dither matrix set for cyan in the electrophotographic apparatus in the image output in image quality evaluation 1 was changed to a dither matrix of 106 lpi in line number, 45° in angle and 1200 dpi in resolution.

In "Photoshop" of Adobe Systems Inc., a grayscale of 40% in density was prepared in A4 size. Output was made via a printer driver, a halftone 2 (HT2) constituted by the screen pattern 2 (SCR2) of 212 lpi in line number, 45° in angle and 40% in print ratio was obtained. With respect to the obtained halftone 2 (HT2), ranking by eye observation similar to that in image quality evaluation 1 was made.

(Image Quality Evaluation 3)

The electrophotographic photosensitive member including the recessed portions on the surface was mounted in a black station of a modified machine of an electrophotographic apparatus (copying machine) manufactured by Canon Inc. (trade name: iR-ADV C7065), and evaluation was made in the following manner.

First, in an environment of 23° C./50% RH, conditions of a charging device, an image exposure device and a developing device were set so that a dark-portion potential (Vd) of the electrophotographic photosensitive member is −700 V, a light-portion potential (Vl) is −200 V, and a developing potential is −540 V.

A dither matrix set for black in the electrophotographic apparatus was changed to a dither matrix of 106 lpi in line number, 45° in angle and 1200 dpi in resolution.

In "Photoshop" of Adobe Systems Inc., a grayscale of 40% in density was prepared in A4 size. Output was made via a printer driver, a halftone 3 (HT3) constituted by the screen pattern 1 (SCR1) of 212 lpi in line number, 45° in angle and 40% in print ratio was obtained. With respect to the obtained halftone 3 (HT3), ranking by eye observation similar to that in image quality evaluation 1 was made.

(Image Quality Evaluation 4)

The electrophotographic photosensitive member including the recessed portions on the surface was mounted in a black station of a modified machine of an electrophotographic apparatus (copying machine) manufactured by Canon Inc. (trade name: iR-ADV C7065), and evaluation was made in the following manner.

First, in an environment of 23° C./50% RH, conditions of a charging device, an image exposure device and a developing device were set so that a dark-portion potential (Vd) of the electrophotographic photosensitive member is −700 V, a light-portion potential (Vl) is −200 V, and a developing potential is −540 V.

In "Photoshop" of Adobe Systems Inc., a grayscale of 40% in density was prepared in A4 size and was outputted via a printer driver. Output was made so as to select halftone: resolution and resolution: 1200 dpi in setting of the printer driver, a halftone 4 (HT4) constituted by the screen pattern 2 (SCR2) of 212 lpi in line number, 45° in angle and 40% in print ratio was obtained. With respect to the obtained halftone 4 (HT4), ranking by eye observation similar to that in image quality evaluation 1 was made.

(Image Deletion Evaluation 1)

The photosensitive member including the recessed portions on the surface was mounted in a cyan station (contact charging type) of a modified machine of an electrophotographic apparatus (copying machine) manufactured by Canon Inc. (trade name: iR-ADV C7055).

First, in an environment of 30° C./80% RH, conditions of a charging device, an image exposure device and a developing device were set so that a dark-portion potential (Vd) of the electrophotographic photosensitive member is −700 V, a light-portion potential (Vl) is −200 V, and a developing potential is −540 V. Further, the dither matrix was changed to the dither matrix used for image quality evaluation.

Next, as shown in Table 2, a polyurethane-made cleaning blade of 77° in hardness was set so as to be 28° in contact angle and 15 g/cm in contact pressure with respect to the surface of the electrophotographic photosensitive member. In a state in which a heater (drum heater) for the electrophotographic photosensitive member was turned off, in an environment of 30° C./80% RH, output of 5000 sheets of a chart for evaluation of A4 (landscape orientation) in size and 5% in print ratio was continuously made.

Subsequently, in a state in which the heater (drum heater) for the electrophotographic photosensitive member was turned off, in the environment of 30° C./80% RH, output of 5000 sheets of the chart for evaluation of A4 (landscape orientation) in size and 5% in print ratio was continuously made, and in a state in which a power source was turned off, the electrophotographic apparatus was left standing for 3 days in the environment of 30° C./80% RH.

After being left standing for 3 days, the electrophotographic apparatus was actuated, image formation of A4 (landscape orientation) in size, 6000 dpi in output resolution and 1 dot-1 space in image was effected, and an image density and image reproducibility on an entire surface of A4-sized sheet in the neighborhood of the charging device were evaluated in the following manner.

A: In the neighborhood of the charging device, there are not disorder and no scattering (i.e., no image deletion), and the image reproducibility is good.

B: In the neighborhood of the charging device, the dot disorder is slightly observed during enlargement observation, but there is no scattering, and at another portion, the image reproducibility is good.

C: In the neighborhood of the charging device, the dot disorder and the scattering are somewhat generated during enlargement observation, but at another portion, the image reproducibility is good.

D: In the neighborhood of the charging device, the dot disorder and the scattering are generated during enlargement between, but at another portion, the image reproducibility is good.

E: In the neighborhood of the charging device, white dropout is generated on the image, and also at another portion, the image reproducibility is somewhat low.

(Image Deletion Evaluations 2-10)

An actual machine evaluation of the electrophotographic photosensitive member was made similarly as in image quality evaluation 1 of the photosensitive member including the recessed portions on the surface except that a hardness and setting (contact angle and contact pressure) of the cleaning blade were as shown in Table 3.

TABLE 3

| | Cleaning Blade | | |
|---|---|---|---|
| | Hardness (° C.) | Contact Angle (° C.) | Contact Pressure (g/cm$^2$) |
| IDE 1 | 77 | 28 | 15 |
| IDE 2 | 77 | 28 | 30 |
| IDE 3 | 77 | 28 | 45 |
| IDE 4 | 77 | 20 | 30 |
| IDE 5 | 65 | 28 | 15 |
| IDE 6 | 65 | 28 | 30 |
| IDE 7 | 65 | 28 | 45 |
| IDE 8 | 80 | 28 | 15 |
| IDE 9 | 80 | 28 | 30 |
| IDE 10 | 80 | 28 | 45 |

"IDE" is the image deletion evaluation.

(Image Deletion Evaluations 11-20)

The photosensitive member including the recessed portions on the surface was mounted in a black station (corona charging type) of a modified machine of an electrophotographic apparatus (copying machine) manufactured by Canon Inc. (trade name: iR-ADV C7055). An actual machine evaluation of the electrophotographic photosensitive member was made similarly as in image quality evaluation 1 of the photosensitive member including the recessed portions on the surface except that a hardness and setting (contact angle and contact pressure) of the cleaning blade were as shown in Table 3.

TABLE 4

| | Cleaning Blade | | |
|---|---|---|---|
| | Hardness (° C.) | Contact Angle (° C.) | Contact Pressure (g/cm$^2$) |
| IDE 11 | 77 | 24 | 15 |
| IDE 12 | 77 | 24 | 20 |
| IDE 13 | 77 | 24 | 30 |
| IDE 14 | 77 | 24 | 45 |
| IDE 15 | 65 | 24 | 15 |
| IDE 16 | 65 | 24 | 30 |
| IDE 17 | 65 | 24 | 45 |
| IDE 18 | 80 | 24 | 15 |
| IDE 19 | 80 | 24 | 30 |
| IDE 20 | 80 | 24 | 45 |

"IDE" is the image deletion evaluation.

(Manufacturing Embodiment 1 of Electrophotographic Photosensitive Member Including Recessed Portions on Surface)

Electrophotographic photosensitive members AA1-40, BA1-3, CA-1 and DA-1 including the recessed portions on the surfaces were prepared by effecting recessed portion formation by the mold press-contact shape transfer using the photosensitive members A, B, C and D before the recessed portion formation and the square arrangement mold of (A) of FIG. 6. Molds used in the press-contact shape transfer and temperatures of the electrophotographic photosensitive members during surface processing are shown in Table 5.

With respect to these electrophotographic photosensitive members, surface observation was made by the above-described method, so that the depth of the specific recessed portions, the longest diameter and the area of the openings, the area of the flat portion and the recessed portion arrangement were obtained. Subsequently, calculation of the image quality lowering index (f) was made. As the screen patterns (B), the screen pattern 1 (SCR1) and the screen pattern 2 (SCR2) which were described above were used. A result is shown in Table 5.

Figure 8:
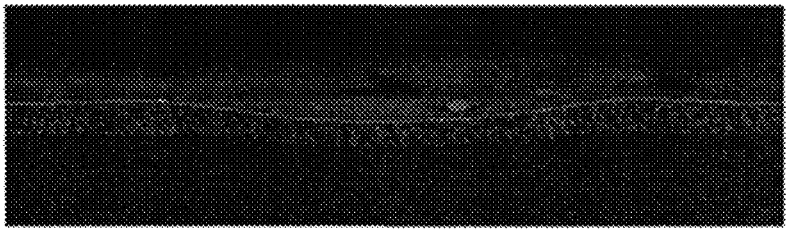
FIG. 8 includes illustrations showing a result of cross-sectional observation performed in the neighborhood of a surface layer of the electrophotographic photosensitive member.
Figure 8:
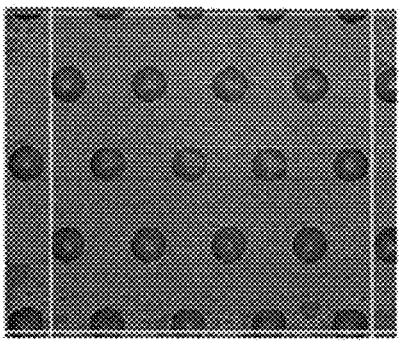

Further, when cross-section observation in the neighborhood, of the second charge transporting layer, which was a surface layer of the electrophotographic photosensitive member CA-1 was made, as shown in (A) of FIG. 8, not only on the surface of the second charge transporting layer but also on the surface (interface between the charge transporting layer and the second charge transporting layer) of the charge transporting layer, corresponding recessed portions were formed. Incidentally, on the surface of the electrophotographic photosensitive member CA-1, the recessed portions as shown in (B) of FIG. 8 were formed. A quadrangle of a white line in (B) of FIG. 8 is a square region of 500 μm×500 μm.

TABLE 5

| | | MOLD | | | PC | | SURFACE OF EPM | | | | IQLI (f) | |
|---|---|---|---|---|---|---|---|---|---|---|---|---|
| | | LD | RPI | RPH | | | | | | | | |
| EPM | RPA | (Xm) [μm] | (Y1 = Y2) [μm] | (H) [μm] | PT [° C.] | PP [Mpa] | SRPOLD [μm] | SRPD [μm] | SRPA [μm$^2$] | FPA [μm$^2$] | SCR1 106 lpi | SCR2 212 lpi |
| PM AA-1 | A | 5 | 31 | 2 | 140 | 3.0 | 5 | 2 | 5000 | 240000 | 0.6% | 1.1% |
| PM AA-2 | A | 15 | 105 | 0.5 | 140 | 2.5 | 15 | 0.3 | 4000 | 70000 | 0.8% | 3.2% |
| PM AA-3 | A | 15 | 105 | 5 | 140 | 2.5 | 15 | 6 | 4000 | 70000 | 0.8% | 3.2% |
| PM AA-4 | A | 15 | 22 | 0.5 | 140 | 2.5 | 15 | 0.3 | 90000 | 70000 | 11.4% | 27.3% |
| PM AA-5 | A | 15 | 22 | 5 | 140 | 2.5 | 15 | 6 | 90000 | 70000 | 11.4% | 27.3% |
| PM AA-6 | A | 15 | 33 | 2 | 140 | 3.0 | 15 | 2 | 39000 | 180000 | 1.0% | 3.6% |
| PM AA-7 | A | 20 | 125 | 2 | 140 | 3.0 | 20 | 2 | 5000 | 240000 | 1.0% | 4.0% |
| PM AA-8 | A | 20 | 89 | 0.5 | 110 | 3.0 | 20 | 0.5 | 11000 | 230000 | 1.2% | 4.7% |
| PM AA-9 | A | 20 | 89 | 5 | 110 | 3.0 | 20 | 5 | 11000 | 230000 | 1.2% | 4.7% |
| PM AA-10 | A | 20 | 30 | 0.5 | 110 | 3.0 | 20 | 0.5 | 90000 | 120000 | 13.0% | 29.2% |
| PM AA-11 | A | 20 | 30 | 5 | 110 | 3.0 | 20 | 5 | 90000 | 120000 | 13.0% | 29.2% |
| PM AA-12 | A | 20 | 44 | 4 | 160 | 3.0 | 20 | 2 | 38000 | 180000 | 1.3% | 5.1% |
| PM AA-13 | A | 25 | 55 | 2 | 110 | 3.0 | 25 | 2 | 39000 | 150000 | 1.4% | 7.2% |
| PM AA-14 | A | 40 | 177 | 2 | 110 | 3.0 | 40 | 2 | 11000 | 200000 | 2.6% | 10.3% |
| PM AA-15 | A | 40 | 89 | 2 | 110 | 3.0 | 40 | 2 | 43000 | 170000 | 2.9% | 11.2% |
| PM AA-16 | A | 40 | 59 | 2 | 110 | 3.0 | 40 | 2 | 89000 | 100000 | 17.4% | 35.6% |
| PM AA-17 | A | 50 | 313 | 2 | 110 | 3.0 | 50 | 2 | 7000 | 240000 | 2.9% | 10.8% |
| PM AA-18 | A | 50 | 222 | 2 | 110 | 3.0 | 50 | 2 | 10000 | 220000 | 3.1% | 11.1% |
| PM AA-19 | A | 50 | 128 | 2 | 110 | 3.0 | 50 | 2 | 31000 | 200000 | 3.3% | 11.7% |
| PM AA-20 | A | 50 | 128 | 3 | 110 | 3.0 | 50 | 3 | 31000 | 180000 | 3.3% | 11.7% |
| PM AA-21 | A | 50 | 111 | 0.5 | 140 | 3.0 | 50 | 0.2 | 40000 | 180000 | 3.5% | 12.4% |
| PM AA-22 | A | 50 | 111 | 0.5 | 110 | 3.0 | 50 | 0.5 | 40000 | 180000 | 3.5% | 12.4% |

| | | MOLD | | | PC | | SURFACE OF EPM | | | | IQLI | |
|---|---|---|---|---|---|---|---|---|---|---|---|---|
| | | LD | RPI | RPH | | | | | | | | |
| EPM | RPA | (Xm) [μm] | (Y1 = Y2) [μm] | (H) [μm] | PT [° C.] | PP [Mpa] | SRPOLD [μm] | SRPD [μm] | SRPA [μm$^2$] | FPA [μm$^2$] | SCR1 106 lpi | SCR2 212 lpi |
| PM AA-23 | A | 50 | 111 | 2 | 110 | 3.0 | 50 | 2 | 40000 | 180000 | 3.5% | 12.4% |
| PM AA-24 | A | 50 | 111 | 5 | 110 | 3.0 | 50 | 5 | 40000 | 180000 | 3.5% | 12.4% |
| PM AA-25 | A | 50 | 111 | 8 | 140 | 3.0 | 50 | 7 | 40000 | 180000 | 3.5% | 12.4% |
| PM AA-26 | A | 50 | 74 | 1 | 110 | 3.0 | 50 | 1 | 90000 | 90000 | 21.7% | 37.9% |
| PM AA-27 | A | 50 | 70 | 2 | 140 | 3.0 | 50 | 1 | 96000 | 50000 | 23.8% | 40..3% |
| PM AA-28 | A | 70 | 310 | 2 | 110 | 3.0 | 70 | 2 | 15000 | 220000 | 4.1% | 13.0% |
| PM AA-29 | A | 70 | 155 | 2 | 110 | 3.0 | 70 | 2 | 34000 | 180000 | 4.7% | 14.9% |
| PM AA-30 | A | 70 | 103 | 2 | 110 | 3.0 | 70 | 2 | 88000 | 110000 | 25.0% | 42.3% |
| PM AA-31 | A | 80 | 354 | 0.5 | 110 | 3.0 | 80 | 0.5 | 10000 | 230000 | 5.1% | 17.2% |
| PM AA-32 | A | 80 | 354 | 5 | 110 | 3.0 | 80 | 5 | 10000 | 230000 | 5.1% | 17.2% |
| PM AA-33 | A | 80 | 118 | 0.5 | 110 | 3.0 | 80 | 0.5 | 82000 | 140000 | 28.6% | 40.3% |
| PM AA-34 | A | 80 | 118 | 5 | 110 | 3.0 | 80 | 5 | 82000 | 140000 | 28.6% | 40.3% |
| PM AA-35 | A | 80 | 177 | 2 | 110 | 3.0 | 80 | 2 | 45000 | 180000 | 5.7% | 19.0% |
| PM AA-36 | A | 90 | 631 | 0.5 | 140 | 2.5 | 90 | 0.3 | 6000 | 70000 | 4.4% | 16.3% |
| PM AA-37 | A | 90 | 631 | 5 | 140 | 2.5 | 90 | 6 | 6000 | 70000 | 4.4% | 16.3% |
| PM AA-38 | A | 90 | 133 | 0.5 | 140 | 2.5 | 90 | 0.3 | 98000 | 70000 | 30.4% | 48.4% |
| PM AA-39 | A | 90 | 133 | 5 | 140 | 2.5 | 90 | 6 | 98000 | 70000 | 30.4% | 48.4% |
| PM AA-40 | A | 90 | 199 | 2 | 140 | 3.0 | 90 | 2 | 40000 | 180000 | 5.5% | 23.3% |
| PM BA-1 | A | 50 | 111 | 2 | 110 | 3.0 | 50 | 2 | 40000 | 180000 | 3.5% | 12.4% |
| PM BA-2 | A | 50 | 313 | 2 | 110 | 3.0 | 50 | 2 | 7000 | 240000 | 2.9% | 10.8% |
| PM BA-3 | A | 50 | 70 | 2 | 140 | 3.0 | 50 | 1 | 96000 | 50000 | 23.8% | 40..3% |
| PM CA-1 | A | 50 | 111 | 2 | 110 | 3.0 | 50 | 2 | 40000 | 180000 | 3.5% | 12.4% |
| PM DA-1 | A | 50 | 111 | 2 | 110 | 3.0 | 50 | 2 | 40000 | 180000 | 3.5% | 12.4% |

Abbreviations in Table 5 and subsequent tables are as follows:

"EMB." is Embodiment.

"EPM" is the electrophotographic photosensitive member.

"PM" is the photosensitive member.

"RPM" is the recessed portion arrangement.

"LD" is the longest diameter.

"RPI" is the recessed portion interval.

"RPH" is the recessed portion height.

"SRPOLD" is the specific recessed portion opening longest diameter.

"SRPD" is the specific recessed portion depth.

"SRPA" is the specific recessed portion area.

"FPA" is the flat portion area.

"IQLI" is the image quality lowering index.

(Manufacturing Embodiment 2 of Electrophotographic Photosensitive Member Including Recessed Portions on Surface)

Electrophotographic photosensitive members AB1-40, BB1-3, CB-1 and DB-1 including the recessed portions on the surfaces were prepared by effecting recessed portion formation by the mold press-contact shape transfer using the photosensitive members A, B, C and D before the recessed portion formation and the irregular arrangement mold of (B) of FIG. 6. Molds used in the press-contact shape transfer and temperatures of the electrophotographic photosensitive members during surface processing are shown in Table 6.

With respect to these electrophotographic photosensitive members, observation was made similarly as in Manufacturing Embodiment 1 of the electrophotographic photosensitive member including the recessed portions n the surface, so that the depth of the specific recessed portions, the longest diameter and the area of the openings, the area of the flat portion and the recessed portion arrangement were obtained, and calculation of the image quality lowering index (f) was made. A result is shown in Table 6.

TABLE 6

| | MOLD | | | | PC | | SURFACE OF EPM | | | | IQLI (f) | |
|---|---|---|---|---|---|---|---|---|---|---|---|---|
| | | LD | | RPH | | | | | | | | |
| EPM | RPA | (Xm) [μm] | AR [%] | (H) [μm] | PT [° C.] | PP [Mpa] | SRPOLD [μm] | SRPD [μm] | SRPA [μm$^2$] | FPA [μm$^2$] | SCR1 106 lpi | SCR2 212 lpi |
| PM AB-1 | B | 5 | 2% | 2 | 140 | 3.0 | 5 | 2 | 5000 | 240000 | 0.5% | 1.0% |
| PM AB-2 | B | 15 | 1.6% | 0.5 | 140 | 2.5 | 15 | 0.3 | 4000 | 70000 | 0.8% | 2.0% |
| PM AB-3 | B | 15 | 1.6% | 5 | 140 | 2.5 | 15 | 6 | 4000 | 70000 | 0.8% | 2.0% |
| PM AB-4 | B | 15 | 36% | 0.5 | 140 | 2.5 | 15 | 0.3 | 90000 | 60000 | 22.7% | 26.0% |
| PM AB-5 | B | 15 | 36% | 5 | 140 | 2.5 | 15 | 6 | 90000 | 60000 | 22.7% | 26.0% |
| PM AB-6 | B | 15 | 16% | 2 | 140 | 3.0 | 15 | 2 | 40000 | 160000 | 0.9% | 2.3% |
| PM AB-7 | B | 20 | 2% | 2 | 140 | 3.0 | 20 | 2 | 5000 | 240000 | 1.0% | 3.1% |
| PM AB-8 | B | 20 | 4% | 0.5 | 110 | 3.0 | 20 | 0.5 | 10000 | 230000 | 1.1% | 3.6% |
| PM AB-9 | B | 20 | 4% | 5 | 110 | 3.0 | 20 | 5 | 10000 | 230000 | 1.1% | 3.6% |
| PM AB-10 | B | 20 | 36% | 0.5 | 110 | 3.0 | 20 | 0.5 | 90000 | 90000 | 28.6% | 29.3% |
| PM AB-11 | B | 20 | 36% | 5 | 110 | 3.0 | 20 | 5 | 90000 | 90000 | 28.6% | 29.3% |
| PM AB-12 | B | 20 | 16% | 4 | 160 | 3.0 | 20 | 2 | 40000 | 160000 | 1.2% | 3.3% |
| PM AB-13 | B | 25 | 16% | 2 | 110 | 3.0 | 25 | 2 | 40000 | 140000 | 1.4% | 4.7% |
| PM AB-14 | B | 40 | 4% | 2 | 110 | 3.0 | 40 | 2 | 10000 | 180000 | 2.8% | 8.3% |
| PM AB-15 | B | 40 | 16% | 2 | 110 | 3.0 | 40 | 2 | 40000 | 130000 | 3.0% | 9.1% |
| PM AB-16 | B | 40 | 36% | 2 | 110 | 3.0 | 40 | 2 | 90000 | 90000 | 34.7% | 38.5% |
| PM AB-17 | B | 50 | 2% | 2 | 110 | 3.0 | 50 | 2 | 7000 | 240000 | 2.9% | 9.8% |
| PM AB-18 | B | 50 | 4% | 2 | 110 | 3.0 | 50 | 2 | 10000 | 180000 | 3.1% | 10.5% |
| PM AB-19 | B | 50 | 12% | 2 | 110 | 3.0 | 50 | 2 | 30000 | 170000 | 3.2% | 13.6% |
| PM AB-20 | B | 50 | 12% | 3 | 110 | 3.0 | 50 | 3 | 30000 | 160000 | 3.2% | 13.6% |
| PM AB-21 | B | 50 | 16% | 0.5 | 140 | 3.0 | 50 | 0.2 | 40000 | 180000 | 3.4% | 11.9% |
| PM AB-22 | B | 50 | 16% | 0.5 | 110 | 3.0 | 50 | 0.5 | 40000 | 180000 | 3.4% | 11.9% |

| | MOLD | | | | PC | | SURFACE OF EPM | | | | IQLI | |
|---|---|---|---|---|---|---|---|---|---|---|---|---|
| | | LD | | RPH | | | | | | | | |
| EPM | RPA | (Xm) [μm] | AR [%] | (H) [μm] | PT [° C.] | PP [Mpa] | SRPOLD [μm] | SRPD [μm] | SRPA [μm$^2$] | FPA [μm$^2$] | SCR1 106 lpi | SCR2 212 lpi |
| PM AB-23 | B | 50 | 16% | 2 | 110 | 3.0 | 50 | 2 | 40000 | 170000 | 3.4% | 11.9% |
| PM AB-24 | B | 50 | 16% | 5 | 110 | 3.0 | 50 | 5 | 40000 | 160000 | 3.4% | 11.9% |
| PM AB-25 | B | 50 | 16% | 8 | 140 | 3.0 | 50 | 7 | 40000 | 140000 | 3.4% | 11.9% |
| PM AB-26 | B | 50 | 36% | 1 | 110 | 3.0 | 50 | 1 | 90000 | 80000 | 38.1% | 44.6% |
| PM AB-27 | B | 50 | 40% | 2 | 140 | 3.0 | 50 | 1 | 96000 | 50000 | 40.0% | 46.3% |
| PM AB-28 | B | 70 | 4% | 2 | 110 | 3.0 | 70 | 2 | 15000 | 200000 | 7.7% | 12.2% |
| PM AB-29 | B | 70 | 16% | 2 | 110 | 3.0 | 70 | 2 | 30000 | 140000 | 7.1% | 20.9% |
| PM AB-30 | B | 70 | 36% | 2 | 110 | 3.0 | 70 | 2 | 90000 | 100000 | 40.9% | 48.4% |
| PM AB-31 | B | 80 | 4% | 0.5 | 110 | 3.0 | 80 | 0.5 | 10000 | 230000 | 9.4% | 11.4% |
| PM AB-32 | B | 80 | 4% | 5 | 110 | 3.0 | 80 | 5 | 10000 | 230000 | 9.4% | 11.4% |
| PM AB-33 | B | 80 | 36% | 0.5 | 110 | 3.0 | 80 | 0.5 | 90000 | 140000 | 39.1% | 55.6% |
| PM AB-34 | B | 80 | 36% | 5 | 110 | 3.0 | 80 | 5 | 90000 | 140000 | 39.1% | 55.6% |
| PM AB-35 | B | 80 | 16% | 2 | 110 | 3.0 | 80 | 2 | 40000 | 160000 | 9.3% | 17.7% |
| PM AB-36 | B | 90 | 1.6% | 0.5 | 140 | 2.5 | 90 | 0.3 | 4000 | 70000 | 6.1% | 7.8% |
| PM AB-37 | B | 90 | 1.6% | 5 | 140 | 2.5 | 90 | 6 | 4000 | 70000 | 6.1% | 7.8% |
| PM AB-38 | B | 90 | 36% | 0.5 | 140 | 2.5 | 90 | 0.3 | 90000 | 60000 | 43.5% | 62.5% |
| PM AB-39 | B | 90 | 36% | 5 | 140 | 2.5 | 90 | 6 | 90000 | 60000 | 43.5% | 62.5% |
| PM AB-40 | B | 90 | 16% | 2 | 140 | 3.0 | 90 | 2 | 40000 | 180000 | 14.3% | 14.0% |
| PM BB-1 | B | 50 | 16% | 2 | 110 | 3.0 | 50 | 2 | 40000 | 170000 | 3.4% | 11.9% |
| PM CB-1 | B | 50 | 16% | 2 | 110 | 3.0 | 50 | 2 | 40000 | 170000 | 3.4% | 11.9% |
| PM DB-1 | B | 50 | 16% | 2 | 110 | 3.0 | 50 | 2 | 40000 | 170000 | 3.4% | 11.9% |

"AR" in Tables 6 and 9 is the area ratio.

(Manufacturing Embodiment 3 of Electrophotographic Photosensitive Member Including Recessed Portions on Surface)

Electrophotographic photosensitive members AC-1 and AD-1 including the recessed portions on the surfaces were prepared by effecting recessed portion formation by the mold press-contact shape transfer using the photosensitive members A, B, C and D before the recessed portion formation and the molds with arrangements of (C) and (D) of FIG. 6. Molds used in the press-contact shape transfer and temperatures of the electrophotographic photosensitive members during surface processing are shown in Table 7.

With respect to these electrophotographic photosensitive members, surface observation was made similarly as in Manufacturing Embodiment 1 of the electrophotographic photosensitive member including the recessed portions on the surface, so that the depth of the specific recessed portions, the longest diameter and the area of the openings, the area of the flat portion and the recessed portion arrangement were obtained, and calculation of the image quality lowering index (f) was made. A result is shown in Table 7.

TABLE 7

| | MOLD | | | | | | | | | | |
|---|---|---|---|---|---|---|---|---|---|---|---|
| | | LD | RPI | RPH | PC | | SURFACE OF EPM | | | | IQLI (f) | |
| EPM | RPA | (Xm) [μm] | (Y1 = Y2) [μm] | (H) [μm] | PT [° C.] | PP [Mpa] | SRPOLD [μm] | SRPD [μm] | SRPA [μm²] | FPA [μm²] | SCR1 106 lpi | SCR2 212 lpi |
| PM AC-1 | C | 50 | 111/74 | 2 | 110 | 3.0 | 50 | 2 | 40000/ 90000 | 130000/ 180000 | 12.6% | 25.2% |
| PM AD-1 | D | 50/70 | 179 | 2 | 110 | 3.0 | 50/70 | 2 | 25000 | 220000 | 3.8% | 12.8% |

(Manufacturing Embodiment 4 of Electrophotographic Photosensitive Member Including Recessed Portions on Surface)

Similarly as in Manufacturing Embodiment of the electrophotographic photosensitive member A before the recessed portion formation, on the supporting member, the electroconductive layer, the undercoat layer, the charge generating layer and the charge transporting layer were formed. Next, the following substances were dissolved in 20.0 parts of 1-methoxy-2-propanol, whereby an application liquid for a second charge transporting layer (protective layer) was prepared.

| | |
|---|---|
| Acryl polyol (trade name: JONCRYL-587, manufactured by Johonson Polymers LTd.) | 1.5 parts |
| Melamine resin (trade name: CYMEL-303, manufactured by Cytec Industries, Inc.) | 2.1 parts |

-continued

| | |
|---|---|
| N,N,N',N'-tetrakis-[(4-hydroxymethyl)phenyl]-biphenyl-4,4'-diamine (THM-TBD) | 1.16 parts |
| N,N'-diphenyl-N,N'-di(3-hydroxyphenyl)-terphenyldiamine (DHTER) as charge transporting component | 1.93 parts |
| Acid catalyst (trade name: Nacure 5225, manufactured by King Chemical Industries, Inc.) | 0.05 part |

This application liquid for the second charge transporting layer was dip-coated on the charge transporting layer, and before a resultant application film was cured, shapes of molds were transferred onto the surface of the application film by using the molds shown in Tables 8 and 9 in a state in which a surface temperature of the application film was maintained at normal temperature (25° C. Then, the application film was thermally cured for 40 minutes at 140° C., so that the second charge transporting layer (protective layer) of 6 μm in film thickness was formed.

In the above-described manner, electrophotographic photosensitive members EA-1 and EB-1 each including recessed portions on the surface were prepared. The molds used for the press-contact shape transfer and surface temperatures of the electrophotographic photosensitive members during surface processing are shown in Tables 8 and 9.

With respect to these electrophotographic photosensitive members, observation was made similarly as in Manufacturing Embodiment 1 of the electrophotographic photosensitive member including the recessed portions on the surface, and the depth of the specific recessed portions, the longest diameter and the area of the openings, and the area of the flat portion and the recessed portion arrangement were obtained, and calculation of the image quality lowering index (f) was made. Results are shown in Tables 8 and 9.

TABLE 8

| | MOLD | | | | | | | | | | | |
|---|---|---|---|---|---|---|---|---|---|---|---|---|
| | | LD | RPI | RPH | PC | | SURFACE OF EPM | | | | IQLI (f) | |
| EPM | RPA | (Xm) [μm] | (Y1 = Y2) [μm] | (H) [μm] | PT [° C.] | PP [Mpa] | SRPOLD [μm] | SRPD [μm] | SRPA [μm²] | FPA [μm²] | SCR1 106 lpi | SCR2 212 lpi |
| PM EA-1 | A | 40 | 89 | 2 | 25 | 10 | 40 | 1 | 43000 | 60000 | 2.9% | 11.2% |

TABLE 9

| | MOLD | | | | | | | | | | | |
|---|---|---|---|---|---|---|---|---|---|---|---|---|
| | | LD | | RPH | PC | | SURFACE OF EPM | | | | IQLI (f) | |
| EPM | RPA | (Xm) [μm] | AR [%] | (H) [μm] | PT [° C.] | PP [Mpa] | SRPOLD [μm] | SRPD [μm] | SRPA [μm²] | FPA [μm²] | SCR1 106 lpi | SCR2 212 lpi |
| PM EB-1 | B | 40 | 16% | 2 | 25 | 10 | 40 | 1 | 43000 | 50000 | 3.0% | 9.1% |

Incidentally, in Manufacturing Embodiments 1-4 of the electrophotographic photosensitive members including the recessed portions on the surfaces, the case where either of the shape (size/depth) of the recessed portions formed on the surface of the photosensitive member is substantially uniform is described as an example, but an example as shown below may also be employed. That is, so long as the moire is not visually recognized, a portion out of the above-described rang of the size/depth of the recessed portions, e.g., a large recessed portion may also be slightly formed due to a deviation during manufacturing.

(Manufacturing Embodiment 5 of Electrophotographic Photosensitive Member Including Recessed Portions on Surface)

Figure 9:
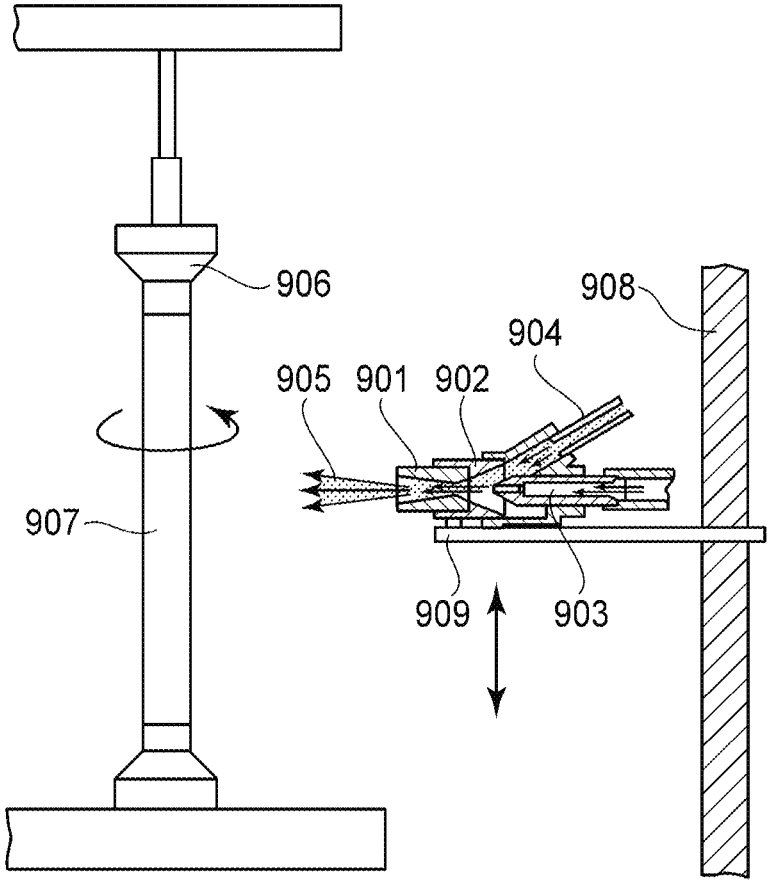
FIG. 9 is an illustration showing an example of a dry blasting device.

The electrophotographic photosensitive member A before the recessed portion formation was subjected to dry blasting using a dry blasting device having a structure roughly shown in FIG. 9, so that a plurality of dimple-shaped recessed portions were formed on an entirety of the surface (peripheral surface of the electrophotographic photosensitive member.

In FIG. 9, 901 is an ejection nozzle of particles (abrasive particles) 905. 902 is a nozzle fixing jig for fixing the ejection nozzle 901. 903 is an introducing path for air (compressed air). 904 is a path for guiding the particles (compressed particles) 905 stored in a container to the ejection nozzle 901. 905 is the particles (compressed particles). 906 is a work supporting member for supporting a work 907. 907 is the work (electrophotographic photosensitive member which is an object no which the recessed portions are formed on a surface). 908 is an ejection nozzle supporting member for supporting the ejection nozzle 901. 909 is an ejection nozzle fixing jig for fixing the ejection nozzle 901.

In the manner described above, the electrophotographic photosensitive member P including the recessed portions on the surface was prepared. A condition of the dry blasting is as follows. Incidentally, after the dry blasting, the particles (compressed particles) remaining and depositing on the peripheral surface of the work were removed by blowing of the compressed air.

Particles (compressed particles): spherical glass beads of 30 μm in average particle size (trade name: UB-01L, manufactured by Union Corp.)

Air (compressed air) blowing pressure: 0.343 MPa (3.5 kgf/cm$^2$)

Ejection nozzle moving speed: 430 mm/s (up-down arrow direction in FIG. 9)

Rotation speed of work: 288 rμm (rotational arrow direction in FIG. 9)

Distance between ejection outlet of ejection nozzle and work: 100 mm

Ejection angle of particles (abrasive particles): 90°

Supply amount of particles (abrasive particles): 200 g/min

Times of blasting: one-way×2 times

With respect to the photosensitive member P, observation was performed similarly as in Manufacturing Embodiment 1 of the electrophotographic photosensitive member including the recessed portions on the surface, so that the depth of specific recessed portions, the longest diameter and the area of openings, the area of the flat portion and the arrangement of the recessed portions were obtained, and calculation of the image quality lowering index (f) was made. A result is shown in Table 10.

TABLE 10

| | Surface of EPM | | | | IQLI (f) | |
|---|---|---|---|---|---|---|
| EPM | SRPOLD (μm) | SRPD (μm) | SRPA (μm$^2$) | FPA (μm$^2$) | SCR1 106 dpi | SCR2 212 dpi |
| PM P | 40 | 2 | 18000 | 40000 | 74.0% | 76.2% |

Embodiments 1 to 42

With respect to the photosensitive members AA-8 to 15, 18 to 20, 22 to 24, 28, 29, 31, 32 and 35 each including the recessed portions on the surface, the above-described image quality evaluation 1 was made. Further, with respect to the photosensitive members AB-8, 9, 12 to 15, 18 to 20, 22 to 24, 28, 29, 31, 32 and 35 and the photosensitive member AC-1, the photosensitive member AD-1, the photosensitive member CA-1, the photosensitive member DA-1, the photosensitive member CB-1 and the photosensitive member DB-1, the above-described image quality evaluation 1 was made. Further, of the image deletion evaluations 1-10, evaluations shown in Table 11 were made. A result is shown in Table 11.

TABLE 11

| | | IQE 1 HT1 | IMAGE DELETION EVALUATION | | | | | | | | | |
|---|---|---|---|---|---|---|---|---|---|---|---|---|
| | EPM | 106 lpi | EV 1 | EV 2 | EV 3 | EV 4 | EV 5 | EV 6 | EV 7 | EV 8 | EV 9 | EV 10 |
| EMB. 1 | PM AA-8 | A | B | B | B | B | B | B | B | B | B | B |
| EMB. 2 | PM AA-9 | A | A | A | A | A | A | A | A | A | A | A |
| EMB. 3 | PM AA-10 | C | B | B | B | B | B | B | B | B | B | B |
| EMB. 4 | PM AA-11 | C | A | A | A | A | A | A | A | A | A | A |
| EMB. 5 | PM AA-12 | A | — | A | — | — | — | A | — | — | A | — |
| EMB. 6 | PM AA-13 | A | — | A | — | — | — | — | — | — | — | — |
| EMB. 7 | PM AA-14 | A | — | A | — | — | — | — | — | — | — | — |
| EMB. 8 | PM AA-15 | A | — | A | — | — | — | — | — | — | — | — |
| EMB. 9 | PM AA-18 | A | — | A | — | — | — | A | — | — | A | — |
| EMB. 10 | PM AA-19 | A | — | A | — | — | — | A | — | — | A | — |
| EMB. 11 | PM AA-20 | A | — | A | — | — | — | A | — | — | A | — |
| EMB. 12 | PM AA-22 | A | — | A | — | — | — | A | — | — | A | — |
| EMB. 13 | PM AA-23 | A | — | A | — | — | — | A | — | — | A | — |
| EMB. 14 | PM AA-24 | A | — | A | — | — | — | A | — | — | A | — |
| EMB. 15 | PM AA-28 | A | — | A | — | — | — | A | — | — | A | — |
| EMB. 16 | PM AA-29 | A | — | A | — | — | — | A | — | — | A | — |
| EMB. 17 | PM AA-31 | A | B | B | B | B | B | B | B | B | B | B |
| EMB. 18 | PM AA-32 | A | A | A | A | A | A | A | A | A | A | A |
| EMB. 19 | PM AA-35 | A | — | A | — | — | — | A | — | — | A | — |
| EMB. 20 | PM AB-8 | A | B | B | B | B | B | B | B | B | B | B |
| EMB. 21 | PM AB-9 | A | A | A | A | A | A | A | A | A | A | A |
| EMB. 22 | PM AB-12 | A | — | A | — | — | — | A | — | — | A | — |
| EMB. 23 | PM AB-13 | A | — | A | — | — | — | — | — | — | — | — |
| EMB. 24 | PM AB-14 | A | — | A | — | — | — | — | — | — | — | — |
| EMB. 25 | PM AB-15 | A | — | A | — | — | — | — | — | — | — | — |
| EMB. 26 | PM AB-18 | A | — | A | — | — | — | A | — | — | A | — |
| EMB. 27 | PM AB-19 | A | — | A | — | — | — | A | — | — | A | — |
| EMB. 28 | PM AB-20 | A | — | A | — | — | — | A | — | — | A | — |
| EMB. 29 | PM AB-22 | A | — | A | — | — | — | A | — | — | A | — |

TABLE 11-continued

| | EPM | IQE 1 HT1 106 lpi | IMAGE DELETION EVALUATION EV 1 | EV 2 | EV 3 | EV 4 | EV 5 | EV 6 | EV 7 | EV 8 | EV 9 | EV 10 |
|---|---|---|---|---|---|---|---|---|---|---|---|---|
| EMB. 30 | PM AB-23 | A | — | A | — | — | — | A | — | — | A | — |
| EMB. 31 | PM AB-24 | A | — | A | — | — | — | A | — | — | A | — |
| EMB. 32 | PM AB-28 | A | — | A | — | — | — | A | — | — | A | — |
| EMB. 33 | PM AB-29 | A | — | A | — | — | — | A | — | — | A | — |
| EMB. 34 | PM AB-31 | A | B | B | B | B | B | B | B | B | B | B |
| EMB. 35 | PM AB-32 | A | A | A | A | A | A | A | A | A | A | A |
| EMB. 36 | PM AB-35 | A | — | A | — | — | — | A | — | — | A | — |
| EMB. 37 | PM AC-1 | A | — | C | — | — | — | C | — | — | C | — |
| EMB. 38 | PM AD-1 | A | — | A | — | — | — | A | — | — | A | — |
| EMB. 39 | PM CA-1 | A | — | A | — | — | — | A | — | — | A | — |
| EMB. 40 | PM DA-1 | A | — | A | — | — | — | A | — | — | A | — |
| EMB. 41 | PM CB-1 | A | — | A | — | — | — | A | — | — | A | — |
| EMB. 42 | PM DB-1 | A | — | A | — | — | — | A | — | — | A | — |

Abbreviations in Table 11 and subsequent tables are as follows:

"EMB." is Embodiment.

"EPM" is the electrophotographic photosensitive member.

PM" is the photosensitive member.

"IQE" is the image quality evaluation.

"EV" is the evaluation.

From the above result, it can be said that the image forming apparatus of the electrophotographic type satisfying the above-described requirements is an electrophotographic apparatus in which the image deletion does not readily generate and the image quality lowering is suppressed.

Embodiments 43 and 44

With respect to the photosensitive members BA-1 and BB-1 each including the recessed portions on the surface, the above-described image quality evaluation 3 was made. Further, the image deletion evaluations 11-20 were made. A result is shown in Table 12.

TABLE 12

| | EPM | IQE 3 HT3 106 lpi | IMAGE DELETION EVALUATION EV 11 | EV 12 | EV 13 | EV 14 | EV 15 | EV 16 | EV 17 | EV 18 | EV 19 | EV 20 |
|---|---|---|---|---|---|---|---|---|---|---|---|---|
| EMB. 43 | PM BA-1 | A | A | A | A | A | A | A | A | A | A | A |
| EMB. 44 | PM BB-1 | A | A | A | A | A | A | A | A | A | A | A |

From the above result, it can be said that the image forming apparatus of the electrophotographic type is, even of the corona charging type, an apparatus in which the image deletion does not readily generate and the image quality lowering is suppressed.

Embodiments 45 to 75

With respect to the photosensitive members AA-8, 9, 12 to 15, 18 to 20 and 22 to 24 each including the recessed portions on the surface, the above-described image quality evaluation 2 was made. Further, with respect to the photosensitive members AB-8, 9, 12 to 15, 18 to 20, 22 to 24, 31 and 32 and the photosensitive member AD-1, the photosensitive member CA-1, the photosensitive member DA-1, the photosensitive member CB-1 and the photosensitive member DB-1, the above-described image quality evaluation 2 was made. Further, of the image deletion evaluations 1-10, evaluations shown in Table 13 were made. A result is shown in Table 13.

TABLE 13

| | EPM | IQE 2 HT2 212 lpi | IMAGE DELETION EVALUATION EV 1 | EV 2 | EV 3 | EV 4 | EV 5 | EV 6 | EV 7 | EV 8 | EV 9 | EV 10 |
|---|---|---|---|---|---|---|---|---|---|---|---|---|
| EMB. 45 | PM AA-8 | A | B | B | B | B | B | B | B | B | B | B |
| EMB. 46 | PM AA-9 | A | A | A | A | A | A | A | A | A | A | A |
| EMB. 47 | PM AA-12 | A | — | A | — | — | — | A | — | — | A | — |
| EMB. 48 | PM AA-13 | A | — | A | — | — | — | — | — | — | — | — |
| EMB. 49 | PM AA-14 | A | — | A | — | — | — | — | — | — | — | — |
| EMB. 50 | PM AA-15 | A | — | A | — | — | — | — | — | — | — | — |
| EMB. 51 | PM AA-18 | A | — | A | — | — | — | A | — | — | A | — |
| EMB. 52 | PM AA-19 | A | — | A | — | — | — | A | — | — | A | — |
| EMB. 53 | PM AA-20 | A | — | A | — | — | — | A | — | — | A | — |
| EMB. 54 | PM AA-22 | A | — | A | — | — | — | A | — | — | A | — |
| EMB. 55 | PM AA-23 | A | — | A | — | — | — | A | — | — | A | — |
| EMB. 56 | PM AA-24 | A | — | A | — | — | — | A | — | — | A | — |
| EMB. 57 | PM AB-8 | A | B | B | B | B | B | B | B | B | B | B |
| EMB. 58 | PM AB-9 | A | A | A | A | A | A | A | A | A | A | A |
| EMB. 59 | PM AB-12 | A | — | A | — | — | — | A | — | — | A | — |
| EMB. 60 | PM AB-13 | A | — | A | — | — | — | — | — | — | — | — |
| EMB. 61 | PM AB-14 | A | — | A | — | — | — | — | — | — | — | — |
| EMB. 62 | PM AB-15 | A | — | A | — | — | — | — | — | — | — | — |
| EMB. 63 | PM AB-18 | A | — | A | — | — | — | A | — | — | A | — |
| EMB. 64 | PM AB-19 | B | — | A | — | — | — | A | — | — | A | — |
| EMB. 65 | PM AB-20 | B | — | A | — | — | — | A | — | — | A | — |
| EMB. 66 | PM AB-22 | A | — | A | — | — | — | A | — | — | A | — |
| EMB. 67 | PM AB-23 | A | — | A | — | — | — | A | — | — | A | — |
| EMB. 68 | PM AB-24 | A | — | A | — | — | — | A | — | — | A | — |

TABLE 13-continued

| | EPM | IQE 2 HT2 212 lpi | IMAGE DELETION EVALUATION EV 1 | EV 2 | EV 3 | EV 4 | EV 5 | EV 6 | EV 7 | EV 8 | EV 9 | EV 10 |
|---|---|---|---|---|---|---|---|---|---|---|---|---|
| EMB. 69 | PM AB-31 | A | B | B | B | B | B | B | B | B | B | B |
| EMB. 70 | PM AB-32 | A | A | A | A | A | A | A | A | A | A | A |
| EMB. 71 | PM AD-1 | C | — | A | — | — | — | A | — | — | A | — |
| EMB. 72 | PM CA-1 | A | — | A | — | — | — | A | — | — | A | — |
| EMB. 73 | PM DA-1 | A | — | A | — | — | — | A | — | — | A | — |
| EMB. 74 | PM CB-1 | A | — | A | — | — | — | A | — | — | A | — |
| EMB. 75 | PM DB-1 | A | — | A | — | — | — | A | — | — | A | — |

From the above result, it can be said that the image forming apparatus of the electrophotographic type satisfying the above-described requirements is an apparatus in which the image deletion does not readily generate and the image quality lowering is suppressed.

Embodiments 76 and 77

With respect to the photosensitive members BA-1 and BB-1 each including the recessed portions on the surface, the above-described image quality evaluation 4 was made. Further, the image deletion evaluations 11-20 were made. A result is shown in Table 14.

TABLE 14

| | EPM | IQE 4 HT4 212 lpi | IMAGE DELETION EVALUATION EV 11 | EV 12 | EV 13 | EV 14 | EV 15 | EV 16 | EV 17 | EV 18 | EV 19 | EV 20 |
|---|---|---|---|---|---|---|---|---|---|---|---|---|
| EMB. 76 | PM BA-1 | A | A | A | A | A | A | A | A | A | A | A |
| EMB. 77 | PM BB-1 | A | A | A | A | A | A | A | A | A | A | A |

From the above result, it can be said that the image forming apparatus of the electrophotographic type in these embodiments is, not only of the contact charging type but also even of the corona charging type, an apparatus in which the image deletion does not readily generate and the image quality lowering is suppressed.

Comparison Examples 1 to 5

With respect to the photosensitive members A to E each including no recessed portion on the surface, the above-described image quality evaluation 1 was made. Further, the image deletion evaluations 2, 6 and 9 were made. A result is shown in Table 15.

TABLE 15

| | EPM | IQE 1 HT1 106 lpi | IMAGE DELETION EVALUATION EV 1 | EV 2 | EV 3 | EV 4 | EV 5 | EV 6 | EV 7 | EV 8 | EV 9 | EV 10 |
|---|---|---|---|---|---|---|---|---|---|---|---|---|
| COMP. EX. 1 | PM A | A | — | E | — | — | — | E | — | — | E | — |
| COMP. EX. 2 | PM B | A | — | E | — | — | — | E | — | — | E | — |
| COMP. EX. 3 | PM C | A | — | E | — | — | — | E | — | — | E | — |
| COMP. EX. 4 | PM D | A | — | E | — | — | — | E | — | — | E | — |
| COMP. EX. 5 | PM E | A | — | E | — | — | — | E | — | — | E | — |

"COMP.EX" in Table 15 and subsequent tables is Comparison Example.

From the above result, it can be said that the electrophotographic apparatus using the photosensitive member including no recessed portion on the surface is an apparatus in which suppression of the image deletion and/or the image quality lowering is insufficient.

Comparison Examples 6 to 52

With respect to the photosensitive members AA-1 to 7, 16, 17, 21, 25 to 27, 30, 33, 334 and 36 to 40 each including the recessed portions on the surface, the above-described image quality evaluation 1 was made. Further, with respect to the photosensitive members AB-1 to 7, 10, 11, 16, 17, 21, 25 to 27, 30, 33, 34 and 36 to 40 and the photosensitive member EA-1, the photosensitive member EB-1 and the photosensitive member P, the above-described image quality evaluation 1 was made. Further, of the image deletion evaluations 1-10, evaluations shown in Table 16 were made. A result is shown in Table 16.

TABLE 16

| | EPM | IQE 1 HT1 106 lpi | IMAGE DELETION EVALUATION EV 1 | EV 2 | EV 3 | EV 4 | EV 5 | EV 6 | EV 7 | EV 8 | EV 9 | EV 10 |
|---|---|---|---|---|---|---|---|---|---|---|---|---|
| COMP. EX. 6 | PM AA-1 | A | — | E | — | — | — | — | — | — | — | — |
| COMP. EX. 7 | PM AA-2 | A | E | — | E | — | E | — | E | E | — | E |
| COMP. EX. 8 | PM AA-3 | A | E | — | E | — | E | — | E | E | — | E |
| COMP. EX. 9 | PM AA-4 | A | E | — | E | — | E | — | E | E | — | E |
| COMP. EX. 10 | PM AA-5 | A | E | — | E | — | E | — | E | E | — | E |
| COMP. EX. 11 | PM AA-6 | A | — | E | — | — | — | E | — | — | E | — |
| COMP. EX. 12 | PM AA-7 | A | — | E | — | — | — | — | — | — | — | — |
| COMP. EX. 13 | PM AA-16 | E | — | A | — | — | — | — | — | — | — | — |
| COMP. EX. 14 | PM AA-17 | A | — | E | — | — | — | E | — | — | E | — |
| COMP. EX. 15 | PM AA-21 | A | — | E | — | — | — | E | — | — | E | — |
| COMP. EX. 16 | PM AA-25 | A | — | E | — | — | — | E | — | — | E | — |
| COMP. EX. 17 | PM AA-26 | E | — | B | — | — | — | B | — | — | B | — |

TABLE 16-continued

| | EPM | IQE 1 HT1 106 lpi | IMAGE DELETION EVALUATION EV 1 | EV 2 | EV 3 | EV 4 | EV 5 | EV 6 | EV 7 | EV 8 | EV 9 | EV 10 |
|---|---|---|---|---|---|---|---|---|---|---|---|---|
| COMP. EX. 18 | PM AA-27 | E | — | E | — | — | — | E | — | — | E | — |
| COMP. EX. 19 | PM AA-30 | E | — | A | — | — | — | A | — | — | A | — |
| COMP. EX. 20 | PM AA-33 | E | B | B | B | B | B | B | B | B | B | B |
| COMP. EX. 21 | PM AA-34 | E | A | A | A | A | A | A | A | A | A | A |
| COMP. EX. 22 | PM AA-36 | A | E | — | E | — | E | — | E | E | — | E |
| COMP. EX. 23 | PM AA-37 | A | E | — | E | — | E | — | E | E | — | E |
| COMP. EX. 24 | PM AA-38 | E | E | — | E | — | E | — | E | E | — | E |
| COMP. EX. 25 | PM AA-39 | E | E | — | E | — | E | — | E | E | — | E |
| COMP. EX. 26 | PM AA-40 | A | — | E | — | — | — | E | — | — | E | — |
| COMP. EX. 27 | PM AB-1 | A | — | E | — | — | — | — | — | — | — | — |
| COMP. EX. 28 | PM AB-2 | A | E | — | E | — | E | — | E | E | — | E |
| COMP. EX. 29 | PM AB-3 | A | E | — | E | — | E | — | E | E | — | E |
| COMP. EX. 30 | PM AB-4 | D | E | — | E | — | E | — | E | E | — | E |
| COMP. EX. 31 | PM AB-5 | D | E | — | E | — | E | — | E | E | — | E |
| COMP. EX. 32 | PM AB-6 | A | — | E | — | — | — | E | — | — | E | — |
| COMP. EX. 33 | PM AB-7 | A | — | E | — | — | — | — | — | — | — | — |
| COMP. EX. 34 | PM AB-10 | D | B | B | B | B | B | B | B | B | B | B |
| COMP. EX. 35 | PM AB-11 | D | A | A | A | A | A | A | A | A | A | A |
| COMP. EX. 36 | PM AB-16 | D | — | A | — | — | — | — | — | — | — | — |
| COMP. EX. 37 | PM AB-17 | A | — | E | — | — | — | E | — | — | E | — |
| COMP. EX. 38 | PM AB-21 | A | — | E | — | — | — | E | — | — | E | — |
| COMP. EX. 39 | PM AB-25 | A | — | E | — | — | — | E | — | — | E | — |
| COMP. EX. 40 | PM AB-26 | D | — | B | — | — | — | B | — | — | B | — |
| COMP. EX. 41 | PM AB-27 | D | — | E | — | — | — | E | — | — | E | — |
| COMP. EX. 42 | PM AB-30 | D | — | A | — | — | — | A | — | — | A | — |
| COMP. EX. 43 | PM AB-33 | D | B | B | B | B | B | B | B | B | B | B |
| COMP. EX. 44 | PM AB-34 | D | A | A | A | A | A | A | A | A | A | A |
| COMP. EX. 45 | PM AB-36 | A | E | — | E | — | E | — | E | E | — | E |
| COMP. EX. 46 | PM AB-37 | A | E | — | E | — | E | — | E | E | — | E |
| COMP. EX. 47 | PM AB-38 | D | E | — | E | — | E | — | E | E | — | E |
| COMP. EX. 48 | PM AB-39 | D | E | — | E | — | E | — | E | E | — | E |
| COMP. EX. 49 | PM AB-40 | D | — | E | — | — | — | E | — | — | E | — |
| COMP. EX. 50 | PM EA-1 | A | — | E | — | — | — | E | — | — | E | — |
| COMP. EX. 51 | PM EB-1 | A | — | E | — | — | — | E | — | — | E | — |
| COMP. EX. 52 | PM P | D | — | E | — | — | — | — | — | — | — | — |

From the above result, it can be said that the image forming apparatus of the electrophotographic type which does not satisfy the above-described requirements is an electrophotographic apparatus in which the image deletion and/or the image quality lowering is insufficient.

Particularly, with respect to Comparison Examples 50 and 51, requirements similar to those in Embodiments are satisfied in terms of the longest diameter, the depth, the area and the arrangement of the openings of the specific recessed portions of the electrophotographic photosensitive members EA-1 and EB-1. However, the shape transfer with the mold is performed before the application film is cured, and therefore the area of the flat portion is small, so that the image deletion suppressing effect was insufficient.

Further, with respect to Comparison Example 52, the area of the specific recessed portions of the photosensitive member P is larger and the area of the flat portion is small, and therefore the image deletion suppressing effect is insufficient, and the recessed portion arrangement does not satisfy the requirements in Embodiments and therefore the roughness was lowered.

Comparison Examples 53 and 54

With respect to the photosensitive members BA-2 and 3 each including the recessed portions on the surface, the above-described image quality evaluation 3 was made. Further, the image deletion evaluations 13, 16 and 19 were made. A result is shown in Table 17.

TABLE 17

| | EPM | IQE 3 HT3 106 lpi | IMAGE DELETION EVALUATION EV 11 | EV 12 | EV 13 | EV 14 | EV 15 | EV 16 | EV 17 | EV 18 | EV 19 | EV 20 |
|---|---|---|---|---|---|---|---|---|---|---|---|---|
| COMP. EX. 53 | PM BA-2 | A | — | — | E | — | — | E | — | — | E | — |
| COMP. EX. 54 | PM BA-3 | E | — | — | E | — | — | E | — | — | E | — |

From the above result, it can be said that the image forming apparatus of the electrophotographic type which does not satisfy the requirements similar to those in Embodiments is an apparatus in which the image deletion and/or the image quality lowering is insufficient.

Comparison Examples 55 to 112

With respect to the photosensitive members AA-1 to 11, 16, 17, 21, 25 to 40 each including the recessed portions on the surface, and the photosensitive members AB-1 to 11, 16, 17, 21, 25 to 30 and 33 to 40, and the photosensitive member AC-1, the photosensitive member EA-1, the photosensitive member EB-1 and the photosensitive member P, the above-described image quality evaluation 2 was made. Further, of the image deletion evaluations 1-10, evaluations shown in Table 18 were made. A result is shown in Table 18.

TABLE 18

| | EPM | IQE 2 HT2 212 lpi | IMAGE DELETION EVALUATION EV 1 | EV 2 | EV 3 | EV 4 | EV 5 | EV 6 | EV 7 | EV 8 | EV 9 | EV 10 |
|---|---|---|---|---|---|---|---|---|---|---|---|---|
| COMP. EX. 55 | PM AA-1 | A | — | E | — | — | — | — | — | — | — | — |
| COMP. EX. 56 | PM AA-2 | A | E | — | E | — | E | — | E | E | — | E |
| COMP. EX. 57 | PM AA-3 | A | E | — | E | — | E | — | E | E | — | E |
| COMP. EX. 58 | PM AA-4 | E | E | — | E | — | E | — | E | E | — | E |
| COMP. EX. 59 | PM AA-5 | E | E | — | E | — | E | — | E | E | — | E |
| COMP. EX. 60 | PM AA-6 | A | — | E | — | — | — | E | — | — | E | — |
| COMP. EX. 61 | PM AA-7 | A | — | E | — | — | — | — | — | — | — | — |
| COMP. EX. 62 | PM AA-10 | E | B | B | B | B | B | B | B | B | B | B |
| COMP. EX. 63 | PM AA-11 | E | A | A | A | A | A | A | A | A | A | A |
| COMP. EX. 64 | PM AA-16 | E | — | A | — | — | — | — | — | — | — | — |
| COMP. EX. 65 | PM AA-17 | A | — | E | — | — | — | E | — | — | E | — |
| COMP. EX. 66 | PM AA-21 | A | — | E | — | — | — | E | — | — | E | — |
| COMP. EX. 67 | PM AA-25 | A | — | E | — | — | — | E | — | — | E | — |
| COMP. EX. 68 | PM AA-26 | E | — | B | — | — | — | B | — | — | B | — |
| COMP. EX. 69 | PM AA-27 | E | — | E | — | — | — | E | — | — | E | — |
| COMP. EX. 70 | PM AA-28 | C | — | A | — | — | — | A | — | — | A | — |
| COMP. EX. 71 | PM AA-29 | E | — | A | — | — | — | A | — | — | A | — |
| COMP. EX. 72 | PM AA-30 | E | — | A | — | — | — | A | — | — | A | — |
| COMP. EX. 73 | PM AA-31 | E | B | B | B | B | B | B | B | B | B | B |
| COMP. EX. 74 | PM AA-32 | E | A | A | A | A | A | A | A | A | A | A |
| COMP. EX. 75 | PM AA-33 | E | B | B | B | B | B | B | B | B | B | B |
| COMP. EX. 76 | PM AA-34 | E | A | A | A | A | A | A | A | A | A | A |
| COMP. EX. 77 | PM AA-35 | E | — | A | — | — | — | A | — | — | A | — |
| COMP. EX. 78 | PM AA-36 | E | E | — | E | — | E | — | E | E | — | E |
| COMP. EX. 79 | PM AA-37 | E | E | — | E | — | E | — | E | E | — | E |
| COMP. EX. 80 | PM AA-38 | E | E | — | E | — | E | — | E | E | — | E |
| COMP. EX. 81 | PM AA-39 | E | E | — | E | — | E | — | E | E | — | E |
| COMP. EX. 82 | PM AA-40 | E | — | E | — | — | — | E | — | — | E | — |
| COMP. EX. 83 | PM AB-1 | A | — | E | — | — | — | — | — | — | — | — |
| COMP. EX. 84 | PM AB-2 | A | E | — | E | — | E | — | E | E | — | E |
| COMP. EX. 85 | PM AB-3 | A | E | — | E | — | E | — | E | E | — | E |
| COMP. EX. 86 | PM AB-4 | D | E | — | E | — | E | — | E | E | — | E |
| COMP. EX. 87 | PM AB-5 | D | E | — | E | — | E | — | E | E | — | E |
| COMP. EX. 88 | PM AB-6 | A | — | E | — | — | — | E | — | — | E | — |
| COMP. EX. 89 | PM AB-7 | A | — | E | — | — | — | — | — | — | — | — |
| COMP. EX. 90 | PM AB-10 | D | B | B | B | B | B | B | B | B | B | B |

TABLE 18-continued

| | EPM | IQE 2 HT2 212 lpi | IMAGE DELETION EVALUATION EV 1 | EV 2 | EV 3 | EV 4 | EV 5 | EV 6 | EV 7 | EV 8 | EV 9 | EV 10 |
|---|---|---|---|---|---|---|---|---|---|---|---|---|
| COMP. EX. 91 | PM AB-11 | D | A | A | A | A | A | A | A | A | A | A |
| COMP. EX. 92 | PM AB-16 | D | — | A | — | — | — | — | — | — | — | — |
| COMP. EX. 93 | PM AB-17 | A | — | E | — | — | — | E | — | — | E | — |
| COMP. EX. 94 | PM AB-21 | A | — | E | — | — | — | E | — | — | E | — |
| COMP. EX. 95 | PM AB-25 | A | — | E | — | — | — | E | — | — | E | — |
| COMP. EX. 96 | PM AB-26 | D | — | B | — | — | — | B | — | — | B | — |
| COMP. EX. 97 | PM AB-27 | D | — | E | — | — | — | E | — | — | E | — |
| COMP. EX. 98 | PM AB-28 | A | — | A | — | — | — | A | — | — | A | — |
| COMP. EX. 99 | PM AB-29 | D | — | A | — | — | — | A | — | — | A | — |
| COMP. EX. 100 | PM AB-30 | D | — | A | — | — | — | A | — | — | A | — |
| COMP. EX. 101 | PM AB-33 | D | B | B | B | B | B | B | B | B | B | B |
| COMP. EX. 102 | PM AB-34 | D | A | A | A | A | A | A | A | A | A | A |
| COMP. EX. 103 | PM AB-35 | D | — | A | — | — | — | A | — | — | A | — |
| COMP. EX. 104 | PM AB-36 | A | E | — | E | — | E | — | E | E | — | E |
| COMP. EX. 105 | PM AB-37 | A | E | — | E | — | E | — | E | E | — | E |
| COMP. EX. 106 | PM AB-38 | D | E | — | E | — | E | — | E | E | — | E |
| COMP. EX. 107 | PM AB-39 | D | E | — | E | — | E | — | E | E | — | E |
| COMP. EX. 108 | PM AB-40 | B | — | E | — | — | — | E | — | — | E | — |
| COMP. EX. 109 | PM AC-1 | E | — | C | — | — | — | C | — | — | C | — |
| COMP. EX. 110 | PM EA-1 | A | — | E | — | — | — | E | — | — | E | — |
| COMP. EX. 111 | PM EB-1 | A | — | E | — | — | — | E | — | — | E | — |
| COMP. EX. 112 | PM P | D | — | E | — | — | — | — | — | — | — | — |

From the above result, it can be said that the image forming apparatus of the electrophotographic type which does not satisfy the requirements similar to those in Embodiments is an electrophotographic apparatus in which the image deletion and/or the image quality lowering is insufficient.

Comparison Examples 113 and 114

With respect to the photosensitive members BA-2 and 3 each including the recessed portions on the surface, the above-described image quality evaluation 4 was made. Further, the image deletion evaluations 13, 16 and 19 were made. A result is shown in Table 19.

TABLE 19

| | EPM | IQE 4 HT4 212 lpi | IMAGE DELETION EVALUATION EV 11 | EV 12 | EV 13 | EV 14 | EV 15 | EV 16 | EV 17 | EV 18 | EV 19 | EV 20 |
|---|---|---|---|---|---|---|---|---|---|---|---|---|
| COMP. EX. 113 | PM BA-2 | A | — | — | E | — | — | E | — | — | E | — |
| COMP. EX. 114 | PM BA-3 | E | — | — | E | — | — | E | — | — | E | — |

From the above result, it can be said that the image forming apparatus of the electrophotographic type which does not satisfy the requirements similar to those in Embodiments is an apparatus in which the image deletion and/or the image quality lowering is insufficient.

Thus, when the constitutions in Embodiments are employed, the prior art is further developed, s that it is possible to provide the electrophotographic apparatus and the electrophotographic photosensitive member in which the image deletion does not further readily generate and the image quality lowering due to the recessed portions on the surface of the electrophotographic photosensitive member is further suppressed.

INDUSTRIAL APPLICABILITY

According to the present invention, it is possible to provide the image forming apparatus and the electrophotographic photosensitive member in which the image deletion does not further readily generate and the image quality lowering due to the recessed portions on the surface of the electrophotographic photosensitive member can be suppressed.

The invention claimed is:

1. An image forming apparatus comprising:

an electrophotographic photosensitive member including at least a supporting member and a photosensitive layer formed on the supporting member; and an image forming portion configured to form an electrostatic latent image on said electrophotographic photosensitive member using at least a process of a pseudo halftone formed by dots as a method of representing gradation, wherein said electrophotographic photosensitive member is provided on a surface thereof with a plurality of recessed portions of 0.5 to 5 μm in depth and 20 to 80 μm in longest diameter of an opening, when a square region of 500 μm×500 μm is arbitrarily extracted on the surface of said electrophotographic photosensitive member, in the square region, a total area of the recessed portions is 10000 to 90000 $\mu m^2$ and a total area of a flat portion contained in a portion other than the recessed portion is 80000 to 240000 $\mu m^2$, and an arrangement (A) of the plurality of recessed portions is such an arrangement that an image quality lowering index (f) is 14% or less calculated by the following condition (1) a portion overlapping with the plurality of recessed portions is deleted from a screen pattern (B) formed by the process of the pseudo halftone formed by the dots is an image (C), (2) particle analysis of the image (C) is made to calculate an average SM of a dot area and a standard deviation (σ), and (3) the image quality lowering index (f) is obtained by the formula: f=σ/SM.

2. An image forming apparatus according to claim 1, wherein said electrophotographic photosensitive member includes a protective layer on the photosensitive layer, and the plurality of recessed portions are formed on the protective layer.

3. An image forming apparatus comprising:

an electrophotographic photosensitive member including at least a supporting member and a photosensitive layer formed on the supporting member;

an image forming portion configured to form an electrostatic latent image on said electrophotographic photosensitive member using at least a process of a pseudo halftone formed by dots as a method of representing gradation; and a blade configured to clean said electrophotographic photosensitive member in contact with said electrophotographic photosensitive member, wherein said electrophotographic photosensitive member is provided at least in a contact region with said blade on a surface thereof with a plurality of recessed portions of 0.5 to 5 μm in depth and 20 to 80 μm in longest diameter of an opening, when a square region of 500 μm×500 μm is arbitrarily extracted in the contact region, in the square region, a total area of the recessed portions is 10000 to 90000 $\mu m^2$ and a total area of a flat portion contained in a portion other than the recessed portion is 80000 to 240000 $\mu m^2$, and an arrangement (A) of the plurality of recessed portions is such an arrangement that an image quality lowering index (f) is 14% or less calculated by the following condition (1) a portion overlapping with the plurality of recessed portions is deleted from a screen pattern (B) formed by the process of the pseudo halftone formed by the dots is an image (C), (2) particle analysis of the image (C) is made to calculate an average SM of a dot area and a standard deviation (σ), and (3) the image quality lowering index (f) is obtained by the formula: f=σ/SM.

4. An image forming apparatus according to claim 3, wherein said electrophotographic photosensitive member includes a protective layer on the photosensitive layer, and the plurality of recessed portions are formed on the protective layer.

5. An electrophotographic photosensitive member on which an electrostatic latent image is formed using at least a process of a pseudo halftone formed by dots as a method of representing gradation, said electrophotographic photosensitive member comprising:

a supporting member; and a photosensitive layer formed on the supporting member, wherein said electrophotographic photosensitive member is provided on a surface thereof with a plurality of recessed portions of 0.5 to 5 μm in depth and 20 to 80 μm in longest diameter of an opening, when a square region of 500 μm×500 μm is arbitrarily extracted on the surface of said electrophotographic photosensitive member, in the square region, a total area of the recessed portions is 10000 to 90000 $\mu m^2$ and a total area of a flat portion contained in a portion other than the recessed portion is 80000 to 240000 $\mu m^2$, and an arrangement (A) of the plurality of recessed portions is such an arrangement that an image quality lowering index (f) is 14% or less calculated by the following condition (1) a portion overlapping with the plurality of recessed portions is deleted from a screen pattern (B) formed by the process of the pseudo halftone formed by the dots is an image (C), (2) particle analysis of the image (C) is made to calculate an average SM of a dot area and a standard deviation (σ), and (3) the image quality lowering index (f) is obtained by the formula: f=σ/SM.

6. An electrophotographic photosensitive member according to claim 5, wherein said electrophotographic photosensitive member includes a protective layer on the photosensitive layer, and the plurality of recessed portions are formed on the protective layer.

7. An electrophotographic photosensitive member on which an electrostatic latent image is formed using at least a process of a pseudo halftone formed by dots as a method of representing gradation, on which a surface thereof is cleaned by a blade, said electrophotographic photosensitive member comprising:

a supporting member; and a photosensitive layer formed on the supporting member, wherein said electrophotographic photosensitive member is provided in a contact region with the blade on the surface thereof with a plurality of recessed portions of 0.5 to 5 μm in depth and 20 to 80 μm in longest diameter of an opening, when a square region of 500 μm×500 μm is arbitrarily extracted in the contact region, in the square region, a total area of the recessed portions is 10000 to 90000 $\mu m^2$ and a total area of a flat portion contained in a portion other than the recessed portion is 80000 to 240000 $\mu m^2$, and an arrangement (A) of the plurality of recessed portions is such an arrangement that an image quality lowering index (f) is 14% or less calculated by the following condition (1) a portion overlapping with the plurality of recessed portions is deleted from a screen pattern (B) formed by the process of the pseudo halftone formed by the dots is an image (C), (2) particle analysis of the image (C) is made to calculate an average SM of a dot area and a standard deviation (a), and (3) the image quality lowering index (f) is obtained by the formula: f=σ/SM.

8. An electrophotographic photosensitive member according to claim 7, wherein said electrophotographic photosensitive member includes a protective layer on the photosensitive layer, and the plurality of recessed portions are formed on the protective layer.

* * * * *